US007057587B2

(12) United States Patent
Numao

(10) Patent No.: US 7,057,587 B2
(45) Date of Patent: Jun. 6, 2006

(54) DISPLAY APPARATUS AND PORTABLE DEVICE

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 138 days.

(21) Appl. No.: 10/184,761

(22) Filed: Jun. 27, 2002

(65) Prior Publication Data

US 2003/0107535 A1 Jun. 12, 2003

(30) Foreign Application Priority Data

Jul. 4, 2001 (JP) ..... 2001-204099
Apr. 2, 2002 (JP) ..... 2002-100538

(51) Int. Cl.
*G09G 3/30* (2006.01)

(52) U.S. Cl. ..... 345/76; 345/212

(58) Field of Classification Search ..... 345/76–83, 345/87–102, 690–693, 211–213; 315/169.3, 315/169.1; G09G 3/30, 3/32, 3/34
See application file for complete search history.

(56) References Cited

U.S. PATENT DOCUMENTS 5,627,557 A 5/1997 Yamaguchi et al.
5,748,160 A * 5/1998 Shieh et al. ..... 345/82
6,329,974 B1 * 12/2001 Walker et al. ..... 345/98
6,331,844 B1 12/2001 Okumura et al.
6,456,301 B1 * 9/2002 Huang ..... 345/691
6,664,943 B1 12/2003 Nakajima et al.
6,853,370 B1 2/2005 Numao
2001/0043173 A1 * 11/2001 Troutman ..... 345/82
2001/0054999 A1 12/2001 Azami
2002/0044110 A1 * 4/2002 Prache ..... 345/82
2002/0093472 A1 7/2002 Numao
2004/0150607 A1 8/2004 Nakajima et al.

FOREIGN PATENT DOCUMENTS

JP 08-204208 8/1996
JP 08-250749 9/1996
JP 2000-227608 8/2000
JP 2000-330527 11/2000
JP 2001-042826 2/2001
KR 2000-0052541 8/2000
KR 10-0286492 4/2001

OTHER PUBLICATIONS

U.S. Appl. No. 10/034,251, filed Jan. 3, 2002, T. Numao.

* cited by examiner

*Primary Examiner*—Alexander Eisen
(74) *Attorney, Agent, or Firm*—David G. Conlin; Steven M. Jensen; Edwards Angell Palmer & Dodge LLP

(57) ABSTRACT

A display apparatus is arranged such that each of a plurality of pixels formed on a display area has, for instance, an organic EL device as a display device, and each of the organic EL devices has a voltage variation section which can change the value of a display voltage supplied to each of the organic EL devices. Moreover, the display apparatus preferably includes voltage keeping sections for keeping the input voltage of the voltage variation sections and storage sections for storing image data. On this account, it is possible to further reduce the power consumption of the display apparatus and downsize the display apparatus as display means, so that the display apparatus can be suitably adopted as display means of a mobile device.

17 Claims, 21 Drawing Sheets

DISPLAY APPARATUS AND PORTABLE DEVICE

FIELD OF THE INVENTION

The present invention relates to (i) a thin display apparatus which is preferably realized as a liquid crystal display apparatus or an organic EL (Electro Luminescence) display apparatus and a driving method thereof, and (ii) a portable device or a time ratio grayscale display apparatus including the above-mentioned display apparatus, and more particularly to a low-power-consumption display apparatus suitable for display means of the portable device or that of the time division display apparatus and a driving method thereof.

BACKGROUND OF THE INVENTION

There has been a great deal of interest in developing a thin display apparatus such as a liquid crystal display apparatus, an organic EL (Electro Luminescence) display apparatus, and an FED (Field Emission Device) display apparatus. Among them, the liquid crystal display apparatus and a thin EL display apparatus have particularly attracted attention as a display apparatus for mobile phones and portable PCs, due to the lightness and low power consumption.

The portable devices have become multifunctional so that the power consumption thereof has become increased. Thus it has been strongly demanded to reduce the power consumption of various means provided in the portable device as well as to increase the capacity of a battery for power supply. Compared to other means in the portable device, display means is generally used at length so as to consume a lot of electricity, thereby it has been demanded to further reduce the power consumption of the display means to elongate the hour of use. Therefore the first objective of the present invention is to further reduce the power consumption of the display means.

Moreover, lightness and portability are quintessence of portable devices so that the display means has been required to be smaller and thinner, along with the reduction of the power consumption. That is to say, the display means includes a drive circuit (drive means or driver), etc. for displaying an image as well as a display section on which images are displayed, and to downsize the portable devices, the proportions of the display section is required to be as large as possible, while the drive circuit, etc. are required to be small and thin as much as possible. This reduction of the size and thickness of the display means is the second objective of the present invention.

Generally a liquid crystal panel (liquid crystal display apparatus) is used as the display means of the portable devices. This liquid crystal panel can achieve both the first and second objectives so as to be widely used as the display means of the portable devices.

Incidentally, there are several types of the liquid crystal panel classified by the difference in driving method and mode of liquid crystal, and among them, a TFT (Thin Film Transistor) drive active matrix TN (Twisted Nematic) liquid crystal panel (hereinafter, will be simply referred to as a TFT liquid crystal panel) has characteristics in high quality displaying and fast drive speed. Thus this liquid crystal panel is highly promising to be used as the display means for the multipurpose portable devices.

However, as the display means of the portable device, a simple matrix drive STN (Super Twisted Nematic) liquid crystal panel (hereinafter, will be simply referred to as a simple STN liquid crystal panel) has generally been adopted. Apart from the relatively high cost, the reason of the poor demand for the TFT liquid crystal panel is mainly considered that the power consumption thereof is too large to be adopted as the display means of the portable device.

Liquid crystal panels basically consume small amounts of electric power compared to conventional CRT display apparatuses. However, as a kind of the liquid crystal panel, the TFT liquid crystal panel can realize high-definition displaying but requires relatively large amounts of electric power, so as to be inadequate for the display means of the portable device.

Thus, there have been various efforts to achieve the above-identified first objective. For instance, a technique (1) disclosed in Japanese Laid-Open Patent Application No. 2000-227608 (Tokukai 2000-227608; published on Aug. 15, 2000) attempts to reduce the power consumption of the TFT liquid crystal panel by providing image memories outside the display screen of the display apparatus.

More specifically, conventional TFT liquid crystal panels are arranged such that the data written in all pixels of the TFT liquid crystal panel are updated in every frame time to realize displaying without flicker, and this increases the power consumption.

In the meantime, the technique (1) adopts the image memories, and hence when a static image is displayed, it is unnecessary to update the image in every frame time. Moreover, the image memories are arranged in a bit map manner so that the image memories and pixels of the display section is assigned to the same address. Therefore, when a part of the displayed image is altered, only image data of a single line including pixels corresponding to the altered part of the image is required to be updated, and hence it is possible to realize a low-power-consumption TFT liquid crystal panel.

Also, there have been various efforts to achieve the above-identified second objective. For instance, according to a technique (2) disclosed in Japanese Laid-Open Patent Application No. 2000-330527 (Tokukai 2000-330527; published on Nov. 30, 2000), when a grayscale display of m bits is carried out, a D/A conversion circuit generates the voltage of n bits (m>n), and the grayscale display of remaining (m−n) bits are conducted in a time ratio grayscale manner.

A digitally driven TFT liquid crystal panel adopts the D/A conversion circuit (D/A conversion means) which converts digital image data, which is supplied from the outside, to analog image data. The performance of multi-grayscale display is an important factor to realize the high-definition displaying, and to improve the performance of the multi-grayscale display, it is necessary to improve the performance of the D/A conversion circuit. However, the improvement above requires to enlarge the D/A conversion circuit so that the space occupied with the circuit is expanded.

Moreover, in the manufacturing process of the TFT liquid crystal panel, the D/A conversion circuit is often manufactured in a polysilicon TFT process along with a TFT, etc. In this case, however, the arrangement of the circuit is so complicated that the drive circuit (especially a source driver) of the TFT liquid crystal panel requires a larger area.

Thus, the technique (2) is arranged such that among digital image data of m bits (m is an integer not less than 2) supplied from the outside, data of n bits (n is an integer not less than 2 and not more than m) is used as information for voltage grayscale, and data of m−n bits is used as information for time ratio grayscale. In this arrangement, the voltage grayscale and the time ratio grayscale are simultaneously carried out, so that $2^m-(2^{m-n}-1)$ patterns of the display grayscale can be acquired.

In other words, this technique can realize the multi-grayscale display which surpasses the ability of the D/A conversion circuit, so that the increase of the areas occupied with the D/A conversion circuit and the drive circuit can be avoided and the TFT liquid crystal panel can be further downsized.

However, the first and second objectives are not fully achieved with the aforementioned techniques, when the TFT liquid crystal panel is used as the display means of the portable device.

First of all, a rigorous examination of the power consumption of the TFT liquid crystal panel has proved that the D/A conversion circuit is the biggest consumer of electricity among the drive circuits. More specifically, the D/A conversion circuit generates an intermediate voltage from an externally supplied power supply voltage, and supplies the intermediate voltage to a source electrode of the TFT. Thus on the occasion of generating the intermediate voltage (i.e. a display voltage), a lot of electricity is consumed.

Concerning this, the technique (2) is arranged such that the number of bits is reduced to avoid the complication of the D/A conversion circuit. On this account, it is possible to supply a power supply voltage, including the voltage for the power consumption of the D/A conversion circuit, from the external power source, so that the increase of the power consumption can be restrained. However, in this arrangement, corresponding to the time ratio grayscale display, a frequency supplied from the D/A conversion circuit is multiplied by a factor of (m−n) and in proportion to this increase of the frequency, the power consumption of wire capacitance increases.

In the meantime, when a binary output buffer circuit is adopted instead of the D/A conversion circuit as in the technique (1), the increase of the power consumption due to the D/A conversion circuit can be avoided. However, in this case, also a frequency supplied from the buffer is multiplied by a factor of m (bits) so that the power consumption of wire capacitance increases.

As described above, the source electrode of the TFT in the liquid crystal panel has a load-carrying capacitance C, so that in the case of carrying out the time ratio grayscale display, the increase of the power consumption in accordance with this load-carrying capacitance has to be taken into consideration. The increase of the frequency in accordance with the time ratio grayscale gives rise to the increase of the power consumption, and this hinders the reduction of the power consumption.

Incidentally, the larger the dimensions of the panel is, the more the influence of the load-carrying capacitance C of the source electrode is prominent. This load-carrying capacitance C and a resistance R of the source electrode determine a time constant CR of the rise (drop) of the output waveform of the source driver. Thus, on the occasion of carrying out the time ratio grayscale display, the output frequencies of the source driver and the gate driver are multiplied by a factor of the number of bits (generally 6–8 bits), and when the dimensions of the panel further increase, the speed of the rise (drop) of the output waveform of each of the drivers becomes slower than the speed necessary for the time ratio grayscale. Resolving this problem is the third objective of the present invention.

To reduce the load-carrying capacitance C of the source electrode, there are methods such as changing the arrangement of the liquid crystal panel and reducing the relative permittivity of an interlayer insulating film included in the TFT. However, no matter which method is adopted, the arrangement of the liquid crystal panel has to be significantly changed, and hence the increase of the costs, the alteration of the manufacturing process, etc. are inevitable so that adopting the aforementioned methods is considered to be unrealistic.

Consequently, both the techniques (1) and (2) cannot achieve the objectives (1) and (3) adequately.

The technique (2) adopts a D/A conversion circuit with an ability of voltage grayscale of n bits so as to realize the multi-grayscale display surpassing the ability of the D/A conversion circuit. However, among the drive circuits in the TFT liquid crystal panel, a source driver for inputting image data has to have an ability corresponding to the above-mentioned ability of the voltage grayscale of n bits. Moreover, even though the D/A conversion circuit can be arranged without complicacy, the increase of the area occupied with the D/A conversion circuit cannot be avoided adequately. Thus the area occupied with the source driver cannot be reduced and hence the second objective cannot be achieved sufficiently by this technique.

Apart from the liquid crystal panel, recently an organic EL display using an organic EL device has been considered as a promising candidate for the display means of the portable device. In this organic EL display, however, the problems related to the D/A conversion circuit and the source driver also occur, as in the case of the liquid crystal panel. Thus, after all the first, second, and third objectives have to be achieved adequately too, when the organic EL device is adopted as the display means of the portable device.

SUMMARY OF THE INVENTION

The objective of the present invention is to provide a display apparatus arranged such that: the power consumption is further reduced; the driver output frequency is increased or the increase of the power consumption accompanied with the increase of the driver output frequency is restrained; and display means is further downsized, all accomplished without changing the arrangement so much, and suitably used for the display means of a mobile device and that of a time ratio grayscale display apparatus. The present invention also aims at providing a mobile device adopting the above-mentioned display apparatus.

To achieve the above-identified objectives, the display apparatus in accordance with the present invention includes: a plurality of display devices formed in a display area; and voltage variation section, provided for each of the display devices, for respectively changing a display voltage supplied to the display devices.

According to this arrangement, it is possible to restrain the voltage supplied from a source driver to each of the display devices so that output voltage from a D/A conversion circuit or a buffer circuit can be reduced. As a result, this makes it possible to reduce the electricity used for charging up/down the load-carrying capacity of a data line. Moreover, the sizes of switching devices such as TFTs can be reduced if the output voltage is reduced, and hence the area occupied with the source driver can be reduced so that the display apparatus en masse can be downsized.

Furthermore, the portable device in accordance with the present invention includes a display apparatus provided with a plurality of display devices formed in a display area, and voltage variation means, provided for the respective display devices, for changing a value of a display voltage supplied to the display devices.

According to this arrangement, the display apparatus consumes fewer amount of electricity and smaller in size, compared to conventional display apparatuses, so that the display apparatus can be suitably adopted as the display means of various mobile devices such as a mobile phone and a PDA.

For a fuller understanding of the nature and advantages of the invention, reference should be made to the ensuing detailed description taken in conjunction with the accompanying drawings.

BRIEF DESCRIPTION OF THE DRAWINGS

FIG. 11(*b*) is a partial circuit diagram showing an example of an arrangement of a memory circuit in the memory cell in FIG. 11(*a*).

FIG. 17(*b*) is a partial circuit diagram showing an example of an arrangement of a memory circuit in a memory cell indicated in FIG. 17(*a*).

FIG. 17(*c*) is a partial circuit diagram of an example of an arrangement of a voltage variation section included in the memory cell in FIG. 17(*a*).

DESCRIPTION OF THE EMBODIMENTS

Embodiment 1

Figure 1:
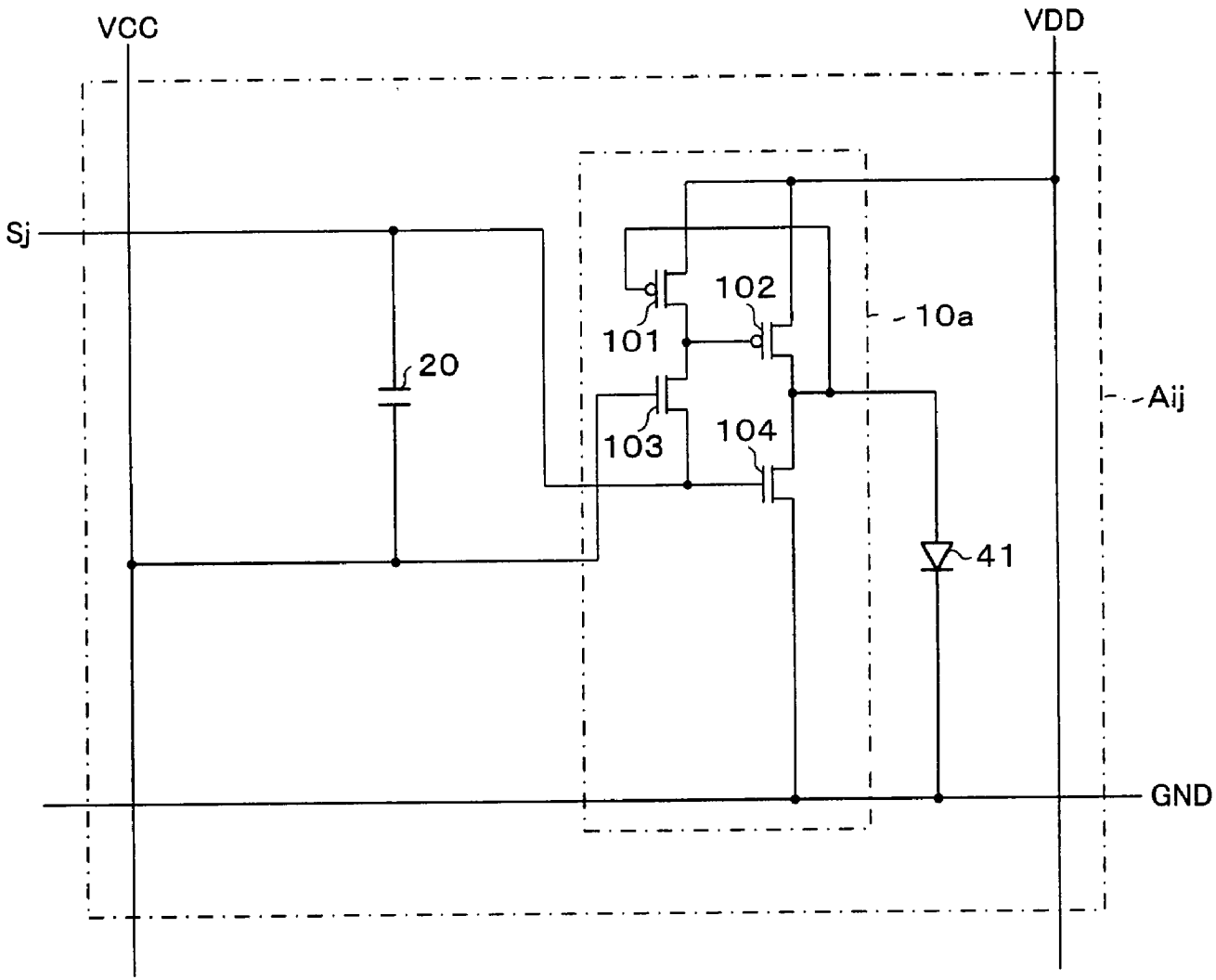
FIG. 1 is a circuit diagram illustrating an example of an arrangement of a pixel included in a display apparatus of a first embodiment in accordance with the present invention.
Figure 2:
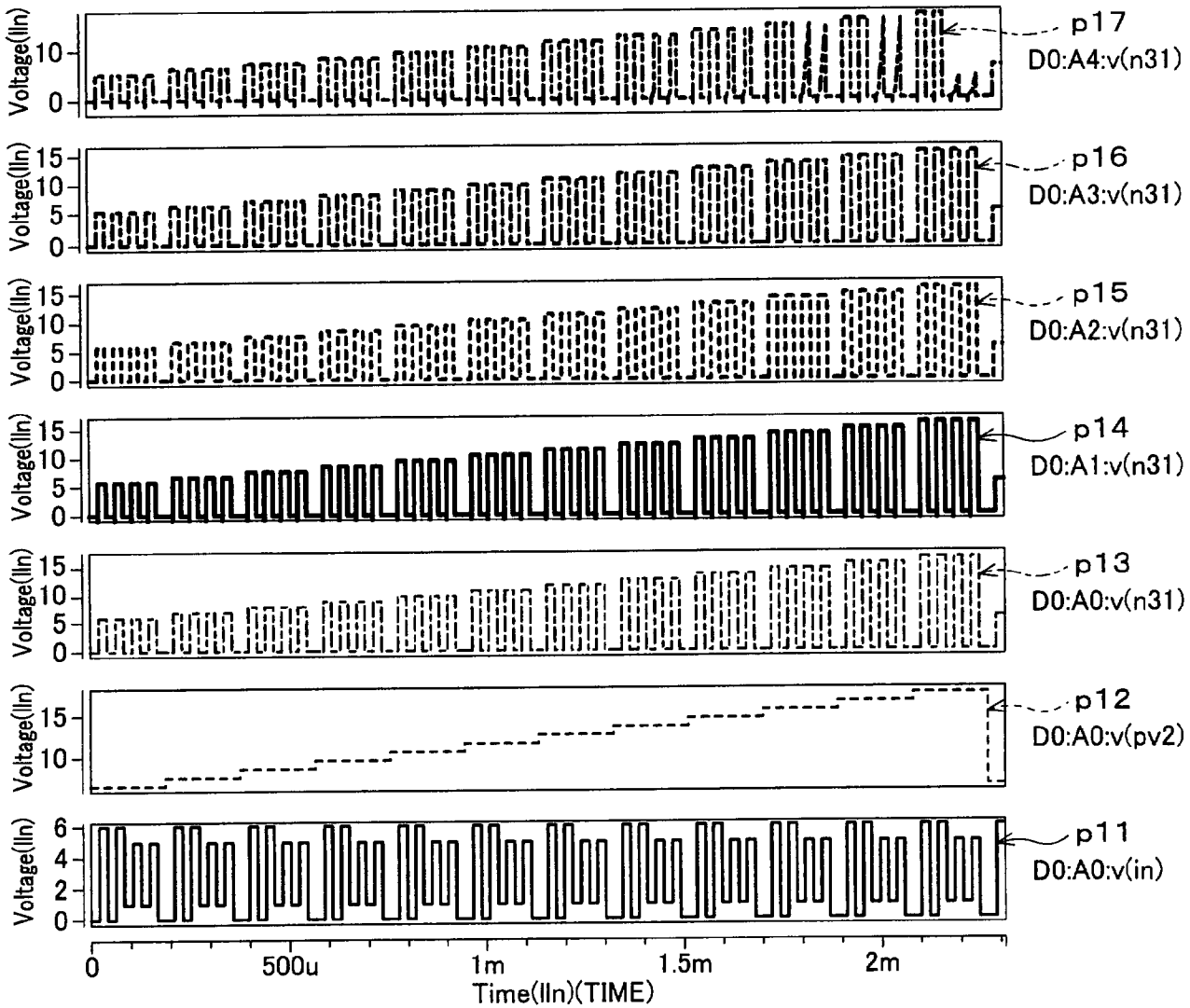
FIG. 2 is a graph showing the results of motion simulations of a voltage variation section in the display apparatus in FIG. 1.

The following description will discuss a first embodiment in accordance with the present invention in reference to FIGS. 1 and 2. It is noted that the present invention is not limited to this embodiment.

A display apparatus in accordance with the present invention, in which a plurality of display devices is provided in a display area, includes voltage variation means between an output terminal of a drive circuit and the respective display device.

More specifically, as FIG. 1 shows, for instance, a single pixel Aij is arranged such that a single voltage variation section (voltage variation means) 10*a* is provided so as to correspond to an organic EL device 41 which is the display device.

In the arrangement in FIG. 1, an output terminal of a source driver (drive circuit) which is not illustrated is connected to a data line (first line) Sj, the data line Sj is connected to a capacitor (voltage keeping section) 20, and the voltage variation section 10*a* is connected between the data line Sj and the organic EL device 41.

The display apparatus in accordance with the present invention includes a display section in which a plurality of the pixels Aij is provided, and the drive circuit such as the source driver connected to the display section controls the displaying of images. The display area (pixel area) is an area where the plurality of the pixels Aij is provided, and the drive circuit such as the source driver is provided in an area (outer-display area or outer-pixel area) outside the display area.

An arrangement of the drive circuit such as the source driver is not specifically limited as long as drive control over image displaying in accordance with image data can be carried out in the display area, so that conventional arrangements such as a charge pump circuit can be suitably adopted.

An arrangement of the display device is not specifically limited as long as the device can be provided in the display section and can display images by flickering. As such device, devices consuming a small amount of electricity when displaying images, more specifically an electro-optical device such as a liquid crystal device and a self-luminous device having high luminous efficiency such as the organic EL device 41, are especially suitable for the display device of the present invention. Thus the display apparatus of the present invention may be a liquid crystal panel (liquid crystal display) or an organic EL display.

The organic EL device 41 can be conventionally arranged such that a cathode (made of aluminum, etc.) is formed on a TFT substrate, above the same an electron transporting layer (made of Alq3, etc.), a luminous layer (made of Zn(oxz)2, etc.), a positive hole transporting layer (made of TPD, etc.), and an anode buffer layer (made of CuPC, etc.) are formed in this order, and an anode (made of ITO, etc.) is formed on the top of the layers. The liquid crystal device is arranged identical with a commercially available TFT panel so that the description thereof is omitted.

The display apparatus in accordance with the present invention is particularly suitable for reducing the power consumption of a drive circuit using a TFT. The electricity required for displaying is not only the electricity for the drive circuit so that, for instance, in a PDP (Plasma Display Panel), carrying out plasma emission consumes a large amount of electricity and hence in this case the reduction of the power consumption of the drive circuit does not really contribute to reduce the power consumption of the displaying apparatus on the whole. Thus, display devices preferably adopted in the present invention are such as the aforementioned liquid crystal device which is a low-power-consumption device and the organic EL device 41 which has good luminous efficiency. Especially the organic EL device is suitably accommodated to the driving method of the present embodiment, since the device is a high-speed response device which can follow the time ratio grayscale display.

Incidentally, the present invention is arranged so that a circuit using electronic devices such as the voltage variation section 10*a* and the TFT are provided in the pixel Aij and hence, when the display device is transparent-type, an aperture ratio (transmittance) of the pixel decreases due to the voltage variation section, etc. and thus the quality of displaying may be degraded. Thus it is preferable to adopt a reflective display device such as a reflective liquid crystal device and a self-luminous device such as the organic EL device 41. When these devices are adopted, it is not at all necessary to take the degradation of the aperture ratio or the transmittance into account so that the effect of the present invention can be further accentuated.

The capacitor 20 is a voltage keeping section (voltage keeping means). This voltage keeping section (voltage keeping means) can keep a voltage (input signal such as image data), which is supplied to each of the pixels Aij by the voltage keeping section (voltage keeping means), stable, and hence this arrangement is preferable.

The voltage keeping section is not necessarily be arranged as the capacitor 20. Thus, for instance, when a liquid crystal device is adopted as the display device, the liquid crystal device itself also serves as the voltage keeping section.

Also, a gate terminal of the TFT constituting an input end of the voltage variation section 10*a* has stray capacitance and this capacitance fulfils a role of the capacitor 20. Thus this capacity 20 may not be visually seen as a component.

The voltage variation section 10*a* is provided for amplifying the voltage applied to each display device, and the arrangement of the section 10*a* is not specifically limited as long as the same can reduce the value of a display voltage supplied from a buffer circuit of the source driver to the display section. The circuit arrangement illustrated in FIG. 1 is a preferable one in which a voltage amplifier circuit is realized with the least number of TFTs. As described later, the display apparatus in accordance with the present invention is preferably provided with an electrode substrate arranged such that electrodes, etc. that constitute the display devices are provided on a single displaying substrate. Moreover, it is preferable that the voltage variation section 10*a* is constituted in accordance with the above-mentioned electrode. The constitution, operation, and effect of the voltage variation section 10*a* will be described later.

The TFT does not necessarily have a particular arrangement as long as switching of signals can be carried out effectively and certainly. However, the above-identified TFT is the most preferable one for the present invention. A specific arrangement of this TFT is not particularly limited as well so that conventional techniques can be suitably used.

Next, the following description will discuss the reason why providing the voltage variation section 10*a* in the display apparatus of the present invention makes it possible to reduce the power consumption.

The voltage of the image data required for displaying in the display device, i.e. the value of the display voltage supplied to the display device is generally high, so that the voltage of the image data supplied from the output terminal of the source driver has to be high from the beginning. In the meantime, the present invention is arranged so that the voltage of the image data is adjusted to be a requisite value in the voltage variation section 10*a* and then supplied to the display device. Thus it is possible to reduce the output current from the source driver and hence the drive circuit consumes fewer amount of electricity, and consequently the low-power-consumption display apparatus can be realized.

More specifically, provided that image data (image signal) supplied from the output terminal of the source driver has a voltage Vxy and a voltage (display voltage) of the image data, which is necessary for displaying in the display device, is Vpx which is higher than Vxy (Vpx>Vxy), to the voltage variation section, the image data having the voltage Vxy is supplied from the source driver, and after being increased to Vpx, the voltage is supplied to the display device.

The output current from the source driver is in proportion to (i) the load-carrying capacitance from the output terminal of the source driver to the display device and (ii) the voltage (output voltage) at the moment of outputting the output current. Thus, provided that (i) the load-carrying capacitance from the output terminal to the voltage variation section 10*a* is Cxy, (ii) the load-carrying capacitance from the voltage variation section to the display device is Cpx, and (iii) the proportional invariable of these two is K, it is possible to represent a current Ist, which is necessary for directly outputting the voltage (display voltage) Vpx required for displaying in the display device from the source driver, by the following formula (1).

$$Ist=K\times(Cxy+Cpx)\times Vpx \tag{1}$$

Meanwhile, in the present invention, provided that the output voltage from the source driver is Vxy, this output voltage is increased from Vxy to Vpx (Vpx>Vxy) in the voltage variation section 10*a* so as to be supplied to the display device. Thus, in the arrangement of the present invention, a current Imo supplied from the source driver can be represented by the following formula (2).

$$Imo=K\times Cxy\times Vxy \tag{2}$$

Since Vpx>Vxy, it is obvious that Ist>Imo. Thus the output current running from the source driver to the display device can be reduced so that the drive circuit consumes fewer amount of electricity, and consequently the low-power-consumption display apparatus can be realized.

Moreover, as for the output current of the voltage variation section 10*a*, provided that the output current of the voltage variation section 10*a* is Itr, the current supplied to the display device can be represented by the following formula (3).

$$Imo+Itr=K\times(Cxy\times Vxy+Cpx\times Vpx) \tag{3}$$

Since Vpx>Vxy, it is obvious that Ist>Imo+Itr. Thus the display apparatus of the present invention, which includes the voltage variation section 10*a*, can reduce the output current from the source driver so that the driver circuit consumes fewer amount of electricity, and consequently the low-power-consumption display apparatus can be realized.

Furthermore, since the output currents of the D/A conversion circuit and a buffer circuit in the source driver can be reduced, the size of the TFT which is used as a switching element of a driver circuit of the display apparatus can be reduced. As a result the source driver occupies a smaller space, so that the display apparatus can be downsized.

Incidentally, when the voltage variation section 10*a* is provided near the display device (organic EL device 41) as in the present invention, the load-carrying capacitance Cxy from the output terminal to the voltage variation section 10*a* and the load-carrying capacitance Cpx from the voltage variation section 10*a* to the display device establish relations as Cxy>Cpx. Thus providing the voltage variation section 10*a* close to the display device as much as possible enables to further reduce Cpx, and hence the output current from the source driver can be further reduced.

The present invention may be arranged such that the voltage variation sections 10*a* are formed in advance on the display substrate constituting the display apparatus. That is to say, the present invention includes not only the display apparatus but also at least (i) the electrodes constituting the plurality of the display devices and (ii) the display substrate on which the voltage variation sections 10*a* are formed.

For instance, in the TFT liquid crystal panel, the TFT, which is a switching device provided in each pixel and for controlling displaying, does not necessarily have a high charge transfer ratio, so that a TFT substrate can be formed on the electrode substrate through an amorphous silicon process. In this case, to provide the source driver outside the display area, an IC formed in an IC process is externally provided.

Now, if the source driver is also formed on the TFT substrate altogether, it is possible not only to simplify the manufacturing process but also to reduce the size of the display apparatus, compared with providing the IC externally. Thus, the present invention may be arranged such that using a polysilicon process, an electrode, etc. to be the voltage variation sections 10*a* are formed on the electrode substrate along with the electrodes constituting the TFT, so that the TFT substrate (displaying substrate) is manufactured, and with the use of this substrate, the display apparatus such as a liquid crystal panel is manufactured.

As the above-identified polysilicon process, conventional techniques can be applied so that the process does not necessarily adopt any particular technique. For instance, a CGS (Continuous Grain Silicon) TFT manufacturing process disclosed in Japanese Laid-Open Patent Application No. 8-204208 (Tokukaihei 8-204208; published on Aug. 9, 1996) and Japanese Laid-Open Patent Application No. 8-250749 (Tokukaihei 8-250749; published on Sep. 27, 1996) can be suitably adopted.

Now, the following description will describe an arrangement, etc. of the voltage variation section 10*a* of the present embodiment. Incidentally, although a source terminal of the TFT is distinguished from a drain terminal of the same, practically these terminals are identical so as not to have to be distinguished. Thus, just for making the explanation of circuit arrangement easier, the source terminal and the drain terminal are distinguished in the following description.

As FIG. 1 illustrates, the display apparatus of the present embodiment is arranged such that in one pixel Aij, the data line (input voltage) Sj is connected to the capacitor 20, and between the data line Sj and the organic EL device 41, the voltage variation section (voltage variation means) 10*a* is connected.

The voltage variation section 10*a* is provided with a p-type TFT 101 (sixth TFT), a p-type TFT 102 (eighth TFT), an n-type TFT 103 (seventh TFT), and an n-type TFT 104 (ninth TFT). The p-type TFT 101 and the n-type TFT 103 constitute a third inverter, and the p-type TFT 102 and the n-type TFT 104 constitute a fourth inverter. An output terminal of the fourth inverter is connected to the organic EL device 41.

The p-type TFT 101 is arranged so that the source terminal is connected to a high voltage power supply line (first power source) VDD, the drain terminal is connected to a gate terminal of the p-type TFT 102, and the gate terminal is connected to a drain terminal of the p-type TFT 102. The p-type TFT 102 is arranged such that the source terminal is connected to the high voltage power supply line VDD, the drain terminal is connected to a source terminal of the n-type TFT 104, and the gate terminal is connected to the drain terminal of the p-type TFT 101 and a source terminal of the n-type TFT 103. The n-type TFT 103 is arranged such that the source terminal is connected to the drain terminal of the p-type TFT 101 and the gate terminal of the p-type TFT 102, the gate terminal is connected to a low voltage power supply line (logic power supply line, second power source) VCC, and the drain terminal is connected to the data line Sj. The n-type TFT 104 is arranged such that the source terminal is connected to the drain terminal of the p-type TFT 102 and the gate terminal of the p-type TFT 101, the drain terminal is connected to a reference voltage line GND, and the gate terminal is connected to the data line Sj and the drain terminal of the n-type TFT 103.

In the voltage variation section 10*a*, the data line Sj is the input terminal of the section 10*a*, and the drain terminal of the p-type TFT 102 is the output terminal of the section 10*a*. The anode of the organic EL device 41 is connected to the drain terminal (output terminal of the voltage variation section 10*a*) of the p-type TFT 102, while the cathode of the organic EL device 41 is connected to the reference voltage line GND. Incidentally, in the voltage variation section 10*a* arranged as above, the conducting resistances of the n-type TFT 103 and the n-type TFT 104 is set so as to be lower than the conducting resistances of the p-type TFTs 101 and 102.

In the voltage variation section 10*a* arranged as above, the input voltage and output voltage to/from the voltage variation section 10*a* establish relations as shown in table. 1. Table. 1 also shows the voltage of the drain terminal of the p-type TFT 101 constituting the voltage variation section 10*a*. Moreover, a ground voltage is represented as Vgnd, a low voltage is represented as Vcc, and a high voltage is represented as Vdd, wherein Vdd>Vcc.

TABLE 1

| | Input Terminal Data Line Sj | Drain Terminal of p-Type TFT 101 | Output Terminal Drain Terminal of p-Type TFT 102 |
|---|---|---|---|
| (I) | Vcc | Vdd | Vgnd |
| (II) | Vgnd | Vgnd | Vdd |

The relationship between (I) and (II) in table. 1 will be described in detail.

First of all, in (I), when the input voltage of the data line Sj which is the input terminal is the low voltage Vcc, the voltage Vcc is applied to the gate terminal of the n-type TFT 104, so that the n-type TFT 104 is brought into conduction. As a result of this, the drain terminal of the p-type TFT 102 has the ground voltage Vgnd.

Since the output from the drain terminal of the p-type TFT 102 is also supplied to the gate terminal of the p-type TFT 101, the gate terminal of the p-type TFT 101 has the ground voltage Vgnd and at the same time the p-type TFT 101 is brought into conduction. At this moment, the low voltage Vcc is applied to the drain terminal of the n-type TFT 103, so that the n-type TFT 103 is brought out of conduction. Consequently the drain terminal of the p-type TFT 101 has the high voltage Vdd. The output from the drain terminal of the p-type TFT 101 is supplied to the gate terminal of the p-type TFT 102, so that the p-type TFT 102 is brought out of conduction. Therefore, the drain terminal of the p-type TFT 102, which is the output terminal of the voltage variation section 10*a*, has the output voltage equivalent to the ground voltage Vgnd.

Next, in (II), when the input voltage of the data line Sj which is the input terminal is the ground voltage Vgnd, since (i) the low voltage Vcc is applied to the gate terminal of the n-type TFT 103 and (ii) the ground voltage Vgnd is applied to the drain terminal of the n-type TFT 103, the n-type TFT 103 is brought into conduction. As a result the output voltage of the drain terminal of the p-type TFT 101 varies towards the ground voltage Vgnd, even if the initial value of the output voltage is the high voltage Vdd. Since the output from the drain terminal of the p-type TFT 101 is supplied to the gate terminal of the p-type TFT 102, the gate terminal of the p-type TFT 102 has a voltage lower than Vdd so as to be brought into conduction.

At this moment, since the ground voltage Vgnd is applied to the gate terminal of the n-type TFT 104, the n-type TFT 104 is brought into conduction. As a result, the drain terminal of the p-type TFT 102 has the output voltage equal to the high voltage Vdd. Moreover, since the output from the drain terminal of the p-type TFT 102 is supplied to the gate terminal of the p-type TFT 101, the p-type TFT 101 is brought out of conduction. Thus the output voltage of the drain terminal of the p-type TFT 102, which is the output terminal of the voltage variation section 10*a*, has the high voltage Vdd so that the p-type TFT 101 is brought out of conduction, and hence the drain terminal of the p-type TFT 101 outputs the ground voltage Vgnd.

Figure 20:
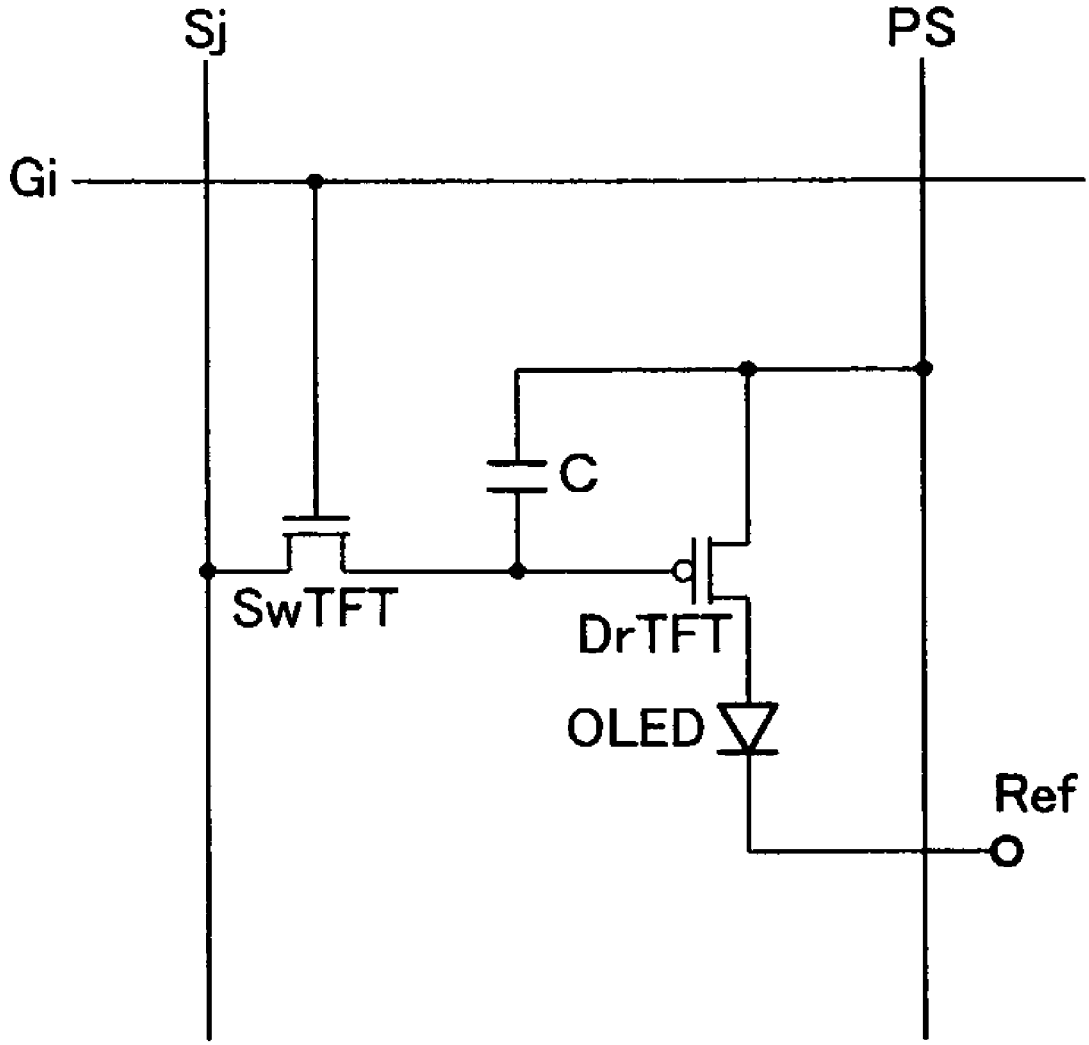
FIG. 20 is a circuit diagram illustrating an arrangement such that an output terminal of an inverter circuit is connected to a DrTFT.

Incidentally, generally the output terminal of the voltage amplifier circuit should be connected to the gate terminal of a Dr-TFT as illustrated in FIG. 20. However, in the arrangement above, since the p-type TFT in the second inverter circuit serves as the Dr-TFT, it is unnecessary to additionally provide the Dr-TFT.

As described above, the voltage variation section 10*a* in accordance with the present invention is composed of two inverters, and between two TFTs constituting the third inverter, the gate terminal of the seventh TFT receives Vcc and the gate terminal of the sixth TFT receives the output voltage of the fourth inverter circuit. Thus, either the low voltage Vcc or the ground voltage Vgnd is applied to the data line Sj, so that either the ground voltage Vgnd or the high voltage Vdd can be applied to the anode of the organic EL device 41. On this account, it is possible to increase the voltage of the image data to the voltage required for the luminescence of the organic EL device 41 in the voltage variation section 10*a*, and then supply the increased voltage to the organic EL device 41. As a result, the output current from the source driver can be reduced and hence the driver circuit consumes fewer amount of electricity, and consequently the low-power-consumption display apparatus can be realized.

By the way, the display apparatus of the embodiment 1 is affected by the fluctuations of threshold voltages and the mobility of the n-type TFT 103, the n-type TFT 104, and the p-type TFTs 101 and 102 all constituting the voltage variation section 10*a*. Accordingly, the operation of the voltage variation section 10*a* in the conditions of prospective fluctuations of the threshold voltages and the mobility is tested through the motion simulations. The results thereof are illustrated in the graph of FIG. 2.

In the graph of FIG. 2, a horizontal axis indicates the time and a vertical axis indicates the voltage. A graph p11 is a graph illustrating the voltage of the data line Sj, which is the input voltage of this voltage variation section 10*a*. A single cycle of the voltage is arranged such that after two pulses each having amplitude between 0V and 6V are repeated, two pulses each having amplitude between 1V and 5V are repeated and then the voltage returns to 0V. A graph p12 is a graph illustrating the voltage of the high voltage power supply line VDD, arranged such that from 5V to 16V, the voltage of the data line Sj increases by 1V with respect to each cycle.

Graphs p13 through p17 are graphs illustrating the simulations of voltages of the output terminal (drain terminal of the p-type TFT 102), and the mobility and the threshold voltage of the p-type TFT and the mobility and the threshold voltage of the n-type TFT are varied in 5 conditions as (1) the p-type TFT has the maximum mobility and the minimum threshold voltage and the n-type TFT has the minimum mobility and the maximum threshold voltage, (2) the p-type TFT has the minimum mobility and the maximum threshold voltage and the n-type TFT has the maximum mobility and the minimum threshold voltage, (3) the p-type TFT has the maximum mobility and the maximum threshold voltage and the n-type TFT has the minimum mobility and the minimum threshold voltage, (4) the p-type TFT has the minimum mobility and the minimum threshold voltage and the n-type TFT has the maximum mobility and the maximum threshold voltage, and (5) both the p-type and n-type TFTs have standard mobility and threshold voltage, so that the operations of the voltage variation section 10*a* are examined. That is to say, the results of the simulations in FIG. 2 indicate that when the input voltage of the voltage variation section 10*a* has amplitude between 0V and 6V, the voltage of the high voltage power supply line VDD can be varied from 5V to 16V.

Incidentally, in the present embodiment, not only the operation of supplying binary output image data to the data line Sj but also the operation of supplying multi-valued image data to the data line Sj consume fewer amount of electricity. Also, as a voltage variation section corresponding to this multi-valued image data, an amplifier, etc. using an operational amplifier, etc. can be adopted.

Embodiment 2

Figure 3:
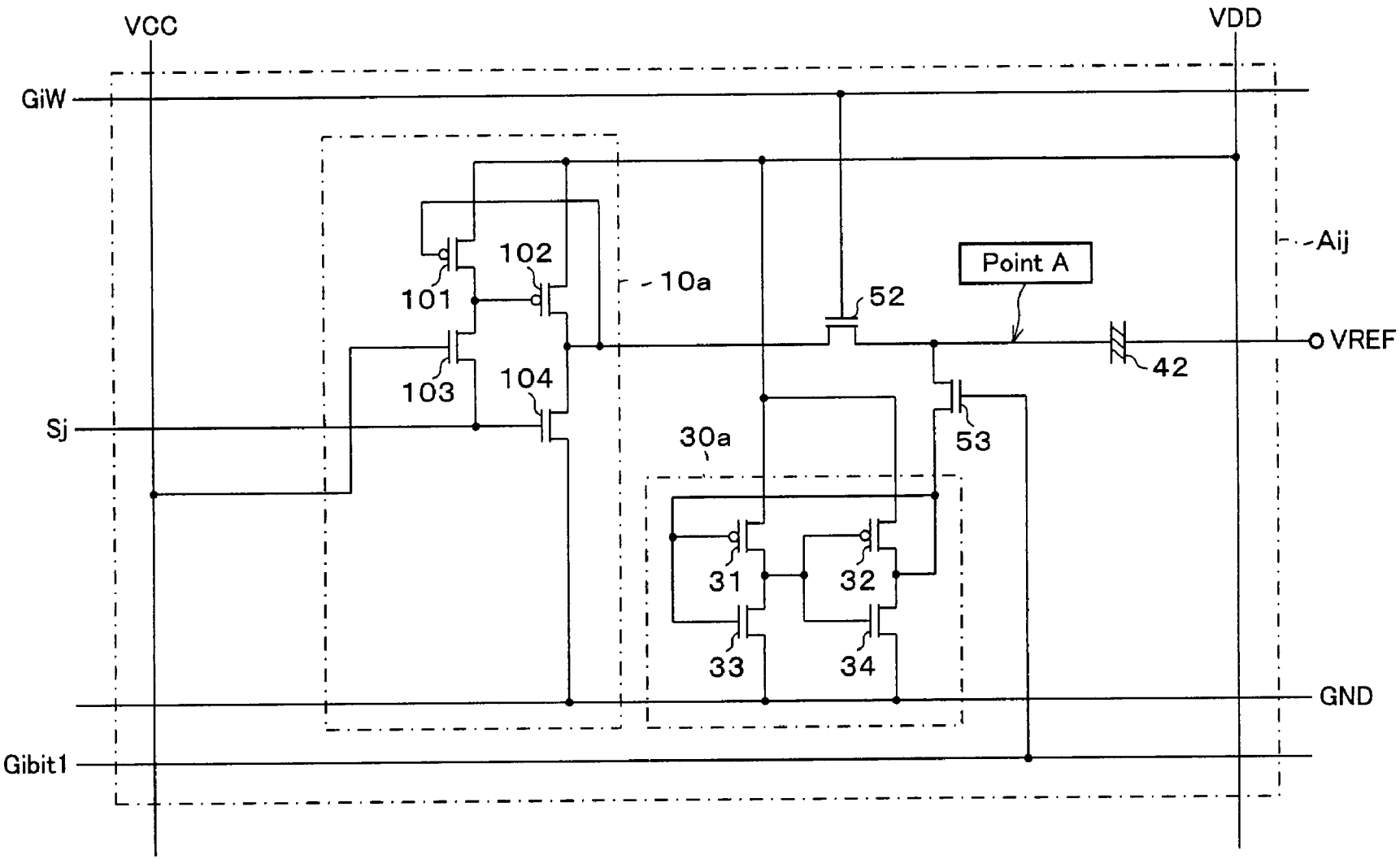
FIG. 3 is a circuit diagram illustrating an example of an arrangement of a pixel included in a display apparatus of a second embodiment in accordance with the present invention.
Figure 4:
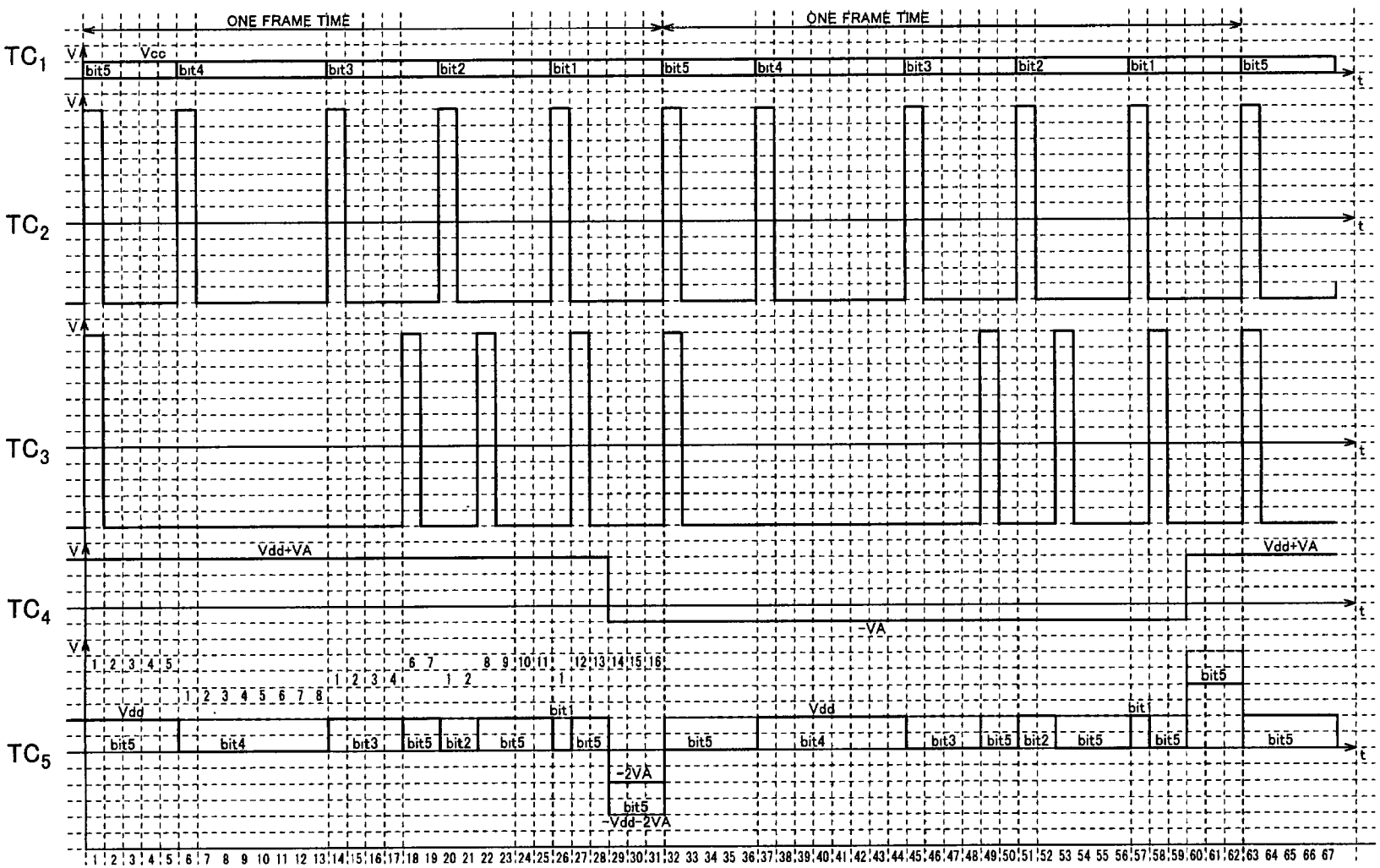
FIG. 4 is a time chart illustrating an example of a time ratio grayscale method of the display apparatus in FIG. 3.

The following description will discuss a second embodiment of the present invention with reference to FIGS. 3 and 4. By the way, it is noted that the present invention is not particularly limited to this embodiment, and members having the same functions as those described in first embodiment are given the same numbers, so that the descriptions are omitted for the sake of convenience.

the first embodiment is arranged so that the source driver may include the D/A conversion circuit as long as the voltage variation section is an operational amplifier, and it is possible to supply a multi-grayscale voltage to the display device. However, it is difficult to form the operational amplifier corresponding one to one to the display device, and thus the present invention is preferably arranged such that the image data supplied to the display device is binary image data.

In this case, as FIG. 3 shows, a display apparatus in accordance with the present invention includes storage sections (storage means) 30*a* for storing binary data, in addition to the voltage variation sections 10*a* and the voltage keeping sections in the embodiment 1.

To supply the binary image data to the display device, there are two methods such that "each pixel D/A conversion method" in which a simply arranged D/A conversion circuit is provided in each pixel Aij (i.e. in each display device) and "time ratio grayscale method" in which the time ratio grayscale is carried out.

The each pixel D/A conversion method is arranged so that the storage section is provided with respect to each display device and the D/A conversion is carried out in accordance with the stored data, and thus, when an image not moving on the whole (a static image, for instance) is displayed, it is unnecessary to acquire image data from the source driver outside the pixels Aij in each frame time. Therefore it is possible to further reduce the power consumption, compared to the case that only the voltage variation sections 10*a* are provided.

In the time ratio grayscale method, also the storage section 30*a* is also provided corresponding to each display device so that it is possible to acquire image data of desired bits from the pixels Aij as need arises. Thus, as in the each pixel D/A conversion method, it is unnecessary to acquire image data from the source driver outside the pixels Aij in each frame time, and it is possible to further reduce the power consumption, compared to the case that only the voltage variation sections 10 are provided.

The description below will discuss an example of the arrangements of the voltage variation section 10*a* and the storage section 30*a* in accordance with the present embodiment.

As FIG. 3 illustrates, the display apparatus of the present embodiment is arranged such that, in one pixel Aij, a liquid crystal device 42 as the display device and the voltage keeping section, the voltage variation section 10*a* (see embodiment 1), the storage section 30*a*, a switching TFT (n-type TFT) 52 which is a second switching device, and a control TFT 53 (n-type TFT) are provided.

More specifically, the data line Sj is connected to an output terminal of a source driver (not illustrated) and the voltage variation section 10*a*, the output terminal of the voltage variation section 10*a* is connected to the switching TFT 52, and an output terminal of the switching TFT 52 is connected to the control TFT 53 and the liquid crystal device 42. To the control TFT 53, the storage section 30*a* is connected.

In other words, the output terminal of the voltage variation section 10*a* is connected to a source terminal of the switching TFT 52, and a gate terminal of the switching TFT 52 is connected to a control line GiW. A drain terminal of the switching TFT 52 is connected to a source terminal of the control TFT 53 and a first terminal (first electrode) of the liquid crystal device 42. In the present embodiment, a junction of the first terminal of the liquid crystal device 42 and the source terminal of the control TFT 53 is termed Point A. This Point A is used in below-mentioned descriptions of the time ratio grayscale method.

Moreover, the storage section 30*a* is connected to a drain terminal of the control TFT 53, and a gate terminal of the control TFT 53 is connected to a control line Gibit 1. Furthermore, a second terminal (second electrode) of the liquid crystal device 42 is a counter electrode, and this counter electrode is connected to a power supply line VREF.

The storage section 30*a* has a static memory arrangement so as to include p-type TFTs 31 and 32 and n-type TFTs 33 and 34.

The p-type TFT 31 is arranged such that the source terminal is connected to the high voltage power supply line VDD, the drain terminal is connected to a source terminal of the n-type TFT 33 and gate terminals of the n-type TFT 34 and the p-type TFT 32, and the gate terminal is connected a gate terminal of the n-type TFT 33 and the drain terminal of the control TFT 53. The p-type TFT 32 is arranged such that the source terminal is connected to the high voltage power supply line VDD, the drain terminal is connected to the drain terminal of the control TFT 53, and the gate terminal is connected to the drain terminal of the p-type TFT 31 and the source terminal of the n-type TFT 33.

The n-type TFT 33 is arranged such that the source terminal is connected to the drain terminal of the p-type TFT 31 and the gate terminal of the p-type TFT 32, the drain terminal is connected to the reference voltage line GND, and the gate terminal is connected to the gate terminal of the p-type TFT 31 and the drain terminal of the control TFT 53. The n-type TFT 34 is arranged such that the source terminal is connected to the drain terminal of the p-type TFT 32 and the drain terminal of the control TFT 53, the drain terminal is connected to the reference voltage line GND, and the gate terminal is connected to the drain terminal of the p-type TFT 31 and the gate terminal of the p-type TFT 32.

In the descriptions of the circuit arrangement of the storage section 30*a* as below, the p-type TFT 31 and the n-type TFT 33 are collectively termed an inverter InA, and the p-type TFT 32 and the n-type TFT 34 are collectively termed an inverter InB, for the sake of convenience.

The description below discusses the operation of the storage section 30*a*. First of all, the output impedance of the inverter InB is arranged to be sufficiently higher than the sum of the output impedance of the voltage variation section 10*a* and the conducting resistances of the switching TFT 52 and the control TFT 53. On this account, when the switching TFT 52 and the control TFT 53 are in the state of conduction, to an input terminal of the inverter InA, the output voltage of the voltage variation section 10*a* is virtually applied.

Incidentally, an alternative arrangement is such that between the drain terminal of the control TFT 53 and the output terminal of the inverter InB, an additional p-type TFT 35 is provided, and a source terminal of this p-type TFT 35 is connected to an output terminal of the inverter InB, a drain terminal of the TFT 35 is connected to the drain terminal of the control TFT 53, and a gate terminal of the TFT 35 is connected to the control line GiW.

In this arrangement, the p-type TFT 35 is out of conduction when the control TFT 53 is in the state of conduction, and this prevents the output from the inverter InB being applied to the input terminal of the inverter InA. Thus even if the output impedance of the inverter InB is lower than the sum of the output impedance of the voltage variation section 10*a* and the conducting resistances of the switching TFT 52 and the control TFT 53, it is possible to apply the output voltage of the voltage variation section 10*a* to the input terminal of the inverter InA, and hence this arrangement is rather preferable.

When the control line GiW is not selected and the voltage thereof is Vns which is lower than the ground voltage Vgnd (Vns<Vgnd), the switching TFT 52 is out of conduction and the input terminal of the inverter InA receives the voltage from the output terminal of the inverter InB, and this makes it possible to keep the information stored in the storage section 30*a*.

On the contrary, when the control line Gibit 1 and the control line GiW are selected and the voltages of these two are Vs which is higher than the high voltage Vdd, the switching TFT 52 and the control TFT 53 are brought into conduction. Thus the input terminal of the inverter InA receives a voltage which is the sum of the voltage from the output terminal of the inverter InB and the output voltage of the voltage variation section 10*a*. In this case, the output impedance of the inverter InB is arranged to be higher than the output impedance of the voltage variation section 10*a* and the conducting resistances of the switching TFT 52 and the control TFT 53, so that the input terminal of the inverter InA virtually receives the output voltage of the voltage variation section 10*a*. As a result, the information stored in the storage section 30*a* is rewritten.

Moreover, when the storage section 30*a* arranged as above is adopted, to the first terminal of the liquid crystal device 42 which is the display device, either one of the following two voltage values is applied in accordance with the selection or non-selection of the control line GiW. Incidentally, the counter electrode which is the second terminal of the liquid crystal device 42 receives a counter voltage Vref via the power supply line VREF.

The switching TFT 52 is brought into conduction if the control line GiW is selected, so that the output voltage of the voltage variation section 10*a* is applied to the first terminal of the liquid crystal device 42, regardless of the state of the control TFT 53.

In the meantime, the switching TFT 52 is out of conduction if the control line GiW is not selected. Thus the control TFT 53 is brought into conduction if the control line Gibit 1 is selected, and the output voltage of the storage section 30*a* is applied to the first terminal of the liquid crystal device 42.

Moreover, both the switching TFT 52 and the control TFT 53 are out of conduction when the control line GiW and the control line Gibit 1 are not selected, so that the electrical charge applied to the liquid crystal device 42 is kept even if the counter voltage Vref varies. In other words, the liquid crystal device 42 functions as the voltage keeping section.

Incidentally, in the storage section 30*a* arranged as above, the electrode resistance of the first terminal of the liquid crystal device 42 is set so as to be sufficiently high, in order to eliminate the influence of the voltage stored in the liquid crystal device 42 on the voltage of the input terminal of the storage section 30*a* (input terminal of the inverter InA).

In the present embodiment, by providing a D/A conversion section (not illustrated) in the pixel Aij in addition to the voltage variation section 10*a* and the storage section 30*a* which are arranged as above, the each pixel D/A conversion method can be adopted as the method to supply binary image data to the display device (liquid crystal device 42). A circuit arrangement of this D/A conversion section is not limited to any particular one so that conventional arrangements can be used.

With reference to a time chart shown in FIG. 4, a case of adopting the time ratio grayscale method will be described below.

In FIG. 4, a chart TC1 of the highest tier indicates the voltage of the image data supplied to the data line Sj, the voltage being set as either the low voltage Vcc or the ground voltage Vgnd in a binary manner, a chart TC2 of the second highest tier indicates the voltage of the control data supplied to the control line GiW, a chart TC3 of the middle tier indicates the voltage of the control data supplied to the control line Gibit 1, and these voltages are equivalent to either the select voltage Vs or the non-select voltage Vns. A chart TC4 of the second lowest tier indicates the voltage applied to the counter electrode of the liquid crystal device 42, the voltage being set as either the high voltage Vdd+VA or Vdd−VA. By the way, the voltage VA is an offset voltage.

Then a chart TC5 of the lowest tier indicates the voltage applied to the Point A i.e. the first terminal of the liquid crystal device 42, the voltage being set as either the high voltage Vdd or the ground voltage Vgnd. A vertical axis indicates values of the voltages of the charts TC1 through TC5, while a horizontal axis indicates select periods. One frame period consists of 31 select periods.

First, during select periods 1 though 5, as the TC1 shows, the image data of a fifth bit is transferred to the data lien Sj. Here, as the TC2 shows, the control line GiW has the select voltage Vs in the select period 1 so that, as the TC5 shows, a signal (high voltage Vdd or ground voltage Vgnd) corresponding to the image data of the fifth bit is applied to the first terminal of the liquid crystal device 42. At the same time, as the TC3 shows, the control line Gibit 1 has the select voltage Vs, so that the image data of the fifth bit is stored in the storage section 30*a*.

Then during select periods 6 through 13, as the TC1 suggests, image data of a fourth bit is transferred to the data line Sj. Here, as the TC2 shows, the control line GiW has the select voltage Vs in the select period 6 so that, as the TC5 indicates, a signal (high voltage Vdd or ground voltage Vgnd) corresponding to the image data of the fourth bit is applied to the first terminal of the liquid crystal device 42. In these periods, the control line Gibit 1 has the non-select voltage Vns as the TC3 indicates, so that the image data of the fifth bit is stored in the storage section 30*a*.

Then during select periods 14 through 19, as the TC1 shows, image data of a third bit is transferred to the data line Sj. In the select period 14, the control line GiW has the select voltage Vs as the TC2 suggests, so that a signal (high voltage Vdd or ground voltage Vgnd) corresponding to the image data of third bit is applied to the first terminal of the liquid crystal device 42, as the TC5 shows.

Also in these periods, as the TC3 shows, the control line Gibit 1 has the non-select voltage Vns except in the select period 18, so that the supplied voltage is kept by the liquid crystal device 42. In the meantime, the control line Gibit 1 has the select voltage Vs in the select period 18 so that, as the TC5 indicates, a signal (high voltage Vdd or ground voltage Vgnd) corresponding to the image data of the fifth bit is applied to the first terminal of the liquid crystal device 42.

Then during select periods 20 through 25, as the TC1 shows, image data of a second bit is transferred to the data line Sj. Here, as the TC2 indicates, the control line GiW has the select voltage Vs in the select period 20 so that, as the TC5 suggests, a signal (high voltage Vdd or ground voltage Vgnd) corresponding to the image data of the second bit is applied to the first terminal of the liquid crystal device 42.

Moreover, in these periods, as the TC3 indicates, the control line Gibit 1 has the select voltage Vs in the select period 22 so that, as the TC5 shows, a signal (high voltage Vdd or ground voltage Vgnd) corresponding to the image data of the fifth bit is applied to the first terminal of the liquid crystal device 42.

Then during select periods 26 through 31, as the TC1 suggests, image data of a first bit is transferred to the data line Sj. Here, as the TC2 shows, the control line GiW has the select voltage Vs in the select period 26 so that, as the TC5 indicates, a signal (high voltage Vdd or ground voltage Vgnd) corresponding to the image data of the first bit is applied to the first terminal of the liquid crystal device 42.

Also in these periods, as the TC3 shows, the control line Gibit 1 has the select voltage Vs in the select period 27 so that, as the TC5 suggests, a signal (high voltage Vdd or ground voltage Vgnd) corresponding to the image data of the fifth bit is applied to the first terminal of the liquid crystal device 42.

Here, as the TC4 indicates, during the select periods 1 through 28, the voltage Vdd+VA is applied to the second terminal (counter electrode) of the liquid crystal device 42 as the counter voltage Vref, and after the select period 29, the voltage −VA is applied to the same. Here, during the select periods 29 through 31, as the TC2 and TC3 indicate, both the control line GiW and the control line Gibit 1 have the non-select voltage Vns and this makes it possible to keep the difference of the voltages between the first and second terminals of the liquid crystal device 42. In other words, as the TC5 suggests, to the first terminal of the liquid crystal device 42, the high voltage Vdd or the ground voltage Vgnd is applied during the select periods 27 and 28, while a voltage −2VA or a voltage −Vdd−2VA is applied during the select periods 29 through 31.

Since generally the speed of response of the liquid crystal device 42 is arranged so as to be around one frame period, switching the display voltage applied to the liquid crystal device 42 in the above-mentioned time division manner is equivalent to the control of an average voltage applied to the liquid crystal device 42.

That is to say, the above-mentioned driving method is arranged such that the ratio of providing the voltage Vdd for the first terminal of the liquid crystal device 42 is variable by any multiple of 1, from 0/31 through 31/31. Thus with respect to the liquid crystal device 42, it is possible to provide the voltage having any one of 32 grayscale levels from the voltage VA (equivalent to 0 grayscale level) to the voltage Vdd+VA (equivalent to 31st grayscale level).

In this manner, the present embodiment is preferably arranged so that between (i) the voltage variation section 10*a* and (ii) any one of the display device (liquid crystal device 42), the storage section 30*a*, and the voltage keeping section (in this case the liquid crystal device 42), the switching TFT 52 is provided as the second switching element.

Especially when the liquid crystal device 42 is adopted as the display device, the source terminal of the switching TFT 52 is connected to the voltage variation section 10*a*, the drain terminal of the switching TFT 52 is connected to the first terminal of the liquid crystal device 42 and the storage section 30*a*, and the gate terminal of the switching TFT 52 is connected to the control line GiW. Also the second terminal (counter electrode) of the liquid crystal device 42 is connected to the power supply line VREF. Incidentally, since the liquid crystal device 42 serves as the voltage keeping means in the present embodiment, the drain terminal of the switching TFT 52 is connected to the display device and the voltage keeping section.

On this account, it is possible to switch the voltage polarity of the counter electrode which is normally used in the liquid crystal device 42 so that the display voltage applied to the liquid crystal device 42 can be converted in an AC manner, and consequently it is possible to reduce the damage of the liquid crystal in the liquid crystal device 42.

When a multi-grayscale image is displayed in accordance with the binary image data supplied from the source driver, in some cases, it is impossible to store the bit data, which corresponds to the number of grayscale levels necessary for the desired displaying, in the storage section 30*a*.

Thus the present embodiment is arranged such that the voltage keeping section (liquid crystal device 42) captures image data of a new bit from the source driver, more specifically, the voltage keeping section (liquid crystal device 42) captures image data of not less than 2 bits in the time-division manner.

However, in this time ratio grayscale method, a period Ta, which is between the capture of the image data of the first bit from the source driver and the capture of the image data of the second bit, may exceed an appropriate display period (period during which the display voltage is supplied to the display device in accordance with the image data of the voltage keeping section) allocated for the first bit (i.e. Ta>Tb).

Thus, during an exceeded period Tb−Ta, image data of another bit, which is stored in the storage section 30*a* in advance, is displayed. On this account, it is possible to use the display periods efficiently.

That is to say, a driving method arranged as follows is adopted: between (i) a period during which the image data of the first bit is captured by the voltage keeping section and the display voltage is applied to the display device (liquid crystal device 42) in accordance with the image data in the voltage keeping section (liquid crystal device 42) and (ii) a period during which the image data of the second bit is captured by the voltage keeping section (liquid crystal device 20) and the display voltage is supplied to the display device (liquid crystal device 42) in accordance with the image data in the voltage keeping section (liquid crystal device 42), a period during which the display voltage is supplied to the display device (liquid crystal device 42) in accordance with the image data captured by the storage section 30*a*, is provided.

As a result, it is possible to efficiently use the display time and reduce the display voltage applied to the liquid crystal device 42. Moreover, as described in another embodiment, the organic EL device 41 can be arranged so as to reduce the value of the current running through the data line Sj. Consequently, it is possible to further reduce the power consumption.

Embodiment 3

The following description will discuss a third embodiment of the present invention with reference to FIGS. 5 through 8. By the way, it is noted that the present invention is not particularly limited to this embodiment, and members having the same functions as those described in embodiments 1 and 2 are given the same numbers, so that the descriptions are omitted for the sake of convenience.

Although embodiments 1 and 2 exemplified such the case as the output terminal of the source driver corresponds one to one to the display device, the present invention is not particularly limited to this arrangement, so that one output terminal of the source driver may correspond to a plurality of the display devices. This arrangement makes it possible to increase the load-carrying capacity from the output terminal of the source driver to the display devices, compared to the one-to-one correspondence, so that the effect of the present invention to reduce the power consumption can be further accentuated.

Figure 5:
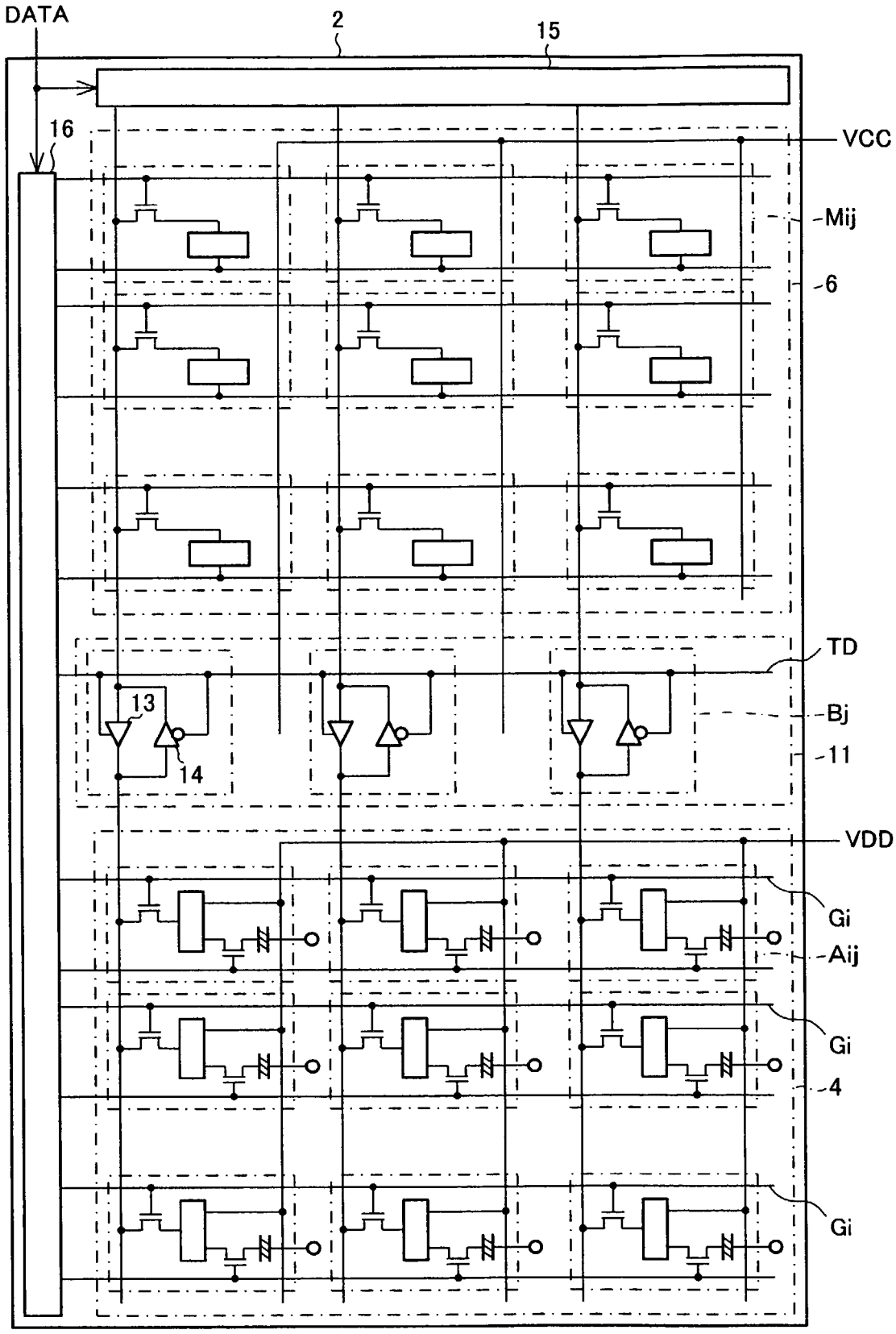
FIG. 5 is a schematic circuit diagram illustrating an example of an arrangement of a displaying substrate in a display apparatus of a third embodiment in accordance with the present invention.

More specifically, as shown in FIG. 5, a display apparatus in accordance with the present embodiment includes: a display section 4 on which a plurality of the pixels (display device circuits) Aij is arranged in a matrix manner; an outer-pixel image memory section 6 corresponding to the display section 4; a bi-directional buffer section 11 connecting the display section 4 to the outer-pixel image memory section 6; a column select driver (serial/parallel conversion circuit) 15 which selectively drives the pixels Aij in a column direction orthogonal to a scanning direction in the display section 4; and a line select driver 16 which selectively drives the pixels Aij in the scanning direction. Incidentally, the source driver is composed of the column select driver, the outer-pixel image memory section 6, and the bi-directional buffer section 11.

The display section 4 includes the pixels Aij arranged identically with those described in embodiments 1 and 2. In-depth descriptions of the arrangements of a voltage variation section 10*b*, etc. included in each of the pixels Aij in the present embodiment are provided later.

The outer-pixel image memory section 6 has a bit map arrangement so as to share the same address space with the pixels Aij included in the display section 4. More specifically, the outer-pixel image memory section 6 includes a plurality of memory cells Mij each corresponding to the respective pixels Aij.

The bi-directional buffer section 11 is arranged as a buffer circuit with a binary output, in which the display section 4 is connected to the outer-pixel image memory section 6, and to the pixels Aij in the display section, binary image data is supplied from the memory cells Mij in the outer-pixel image memory section 6. This bi-directional buffer section 11 is provided with a plurality of bi-directional buffers Bj in each of the columns, so that the binary image data can be bi-directionally input and output.

In the present embodiment, a specific arrangement of the bi-directional buffer Bj is, as FIG. 5 shows, such as a buffer amplifier 13 which transmits image data towards the display section 4 is connected in parallel with a buffer amplifier 14 which transmits image data towards the outer-pixel image memory section 6. Each bi-directional buffer Bj is connected to the line select driver 16 via a control line TD.

Circuit arrangements of the column select driver 15, the line select driver 16, and the outer-pixel image memory section 6 are not specifically limited so that these members can be conventionally arranged. Incidentally, in FIG. 5, the low voltage power supply line VCC and the high voltage power supply line VDD are provided in the outer-pixel image memory section 6 and the display section 4 respectively.

Moreover, it is possible to form the display section 4, the outer-pixel image memory section 6, the bi-directional buffer section 11, the column select driver 15, and the line select driver 16 all on a displaying substrate 2 by means of the polysilicon process. Thus, the displaying substrate 2 illustrated in FIG. 5 is equivalent to the electrode substrate which is a part of the display apparatus of the present invention.

The above-mentioned constitution is arranged such that, from the outside of the display apparatus, (i) bit image data, which corresponds to each of the pixels Aij and (ii) synchronized signals are supplied as input signals (indicated as DATA and arrows in the figure), in increments of a line in the column direction. Among the input signals, the bit image data corresponding to each of the pixels Aij is stored in a shift resister (not illustrated) included in the column select driver 15 for a while. Then the bit image data for one line is stored in a latch (not illustrated) in the column select driver 15, and from this latch to each of the memory cells Mij in the outer-pixel memory section 6, the bit image data corresponding to each of the pixels Aij is supplied so as to be stored in the latter.

The synchronized signals among the input signals are supplied to the line select driver 16, so that the signals are used for the operation of selecting a gate line Gi including a certain pixel Aij from the display section 4. Since the memory cells Mij correspond one to one to the pixels Aij in the display section 4, the bit image data stored in the memory cells Mij is transferred to the pixels Aij in appropriate timing, with the help of the drive control by the line select driver 16. Thus the image displaying can be carried out in the display section 4.

Next, the following description will discuss an example of arrangements of the pixels Aij and the voltage variation sections 10*b* in accordance with the present embodiment.

Figure 6:
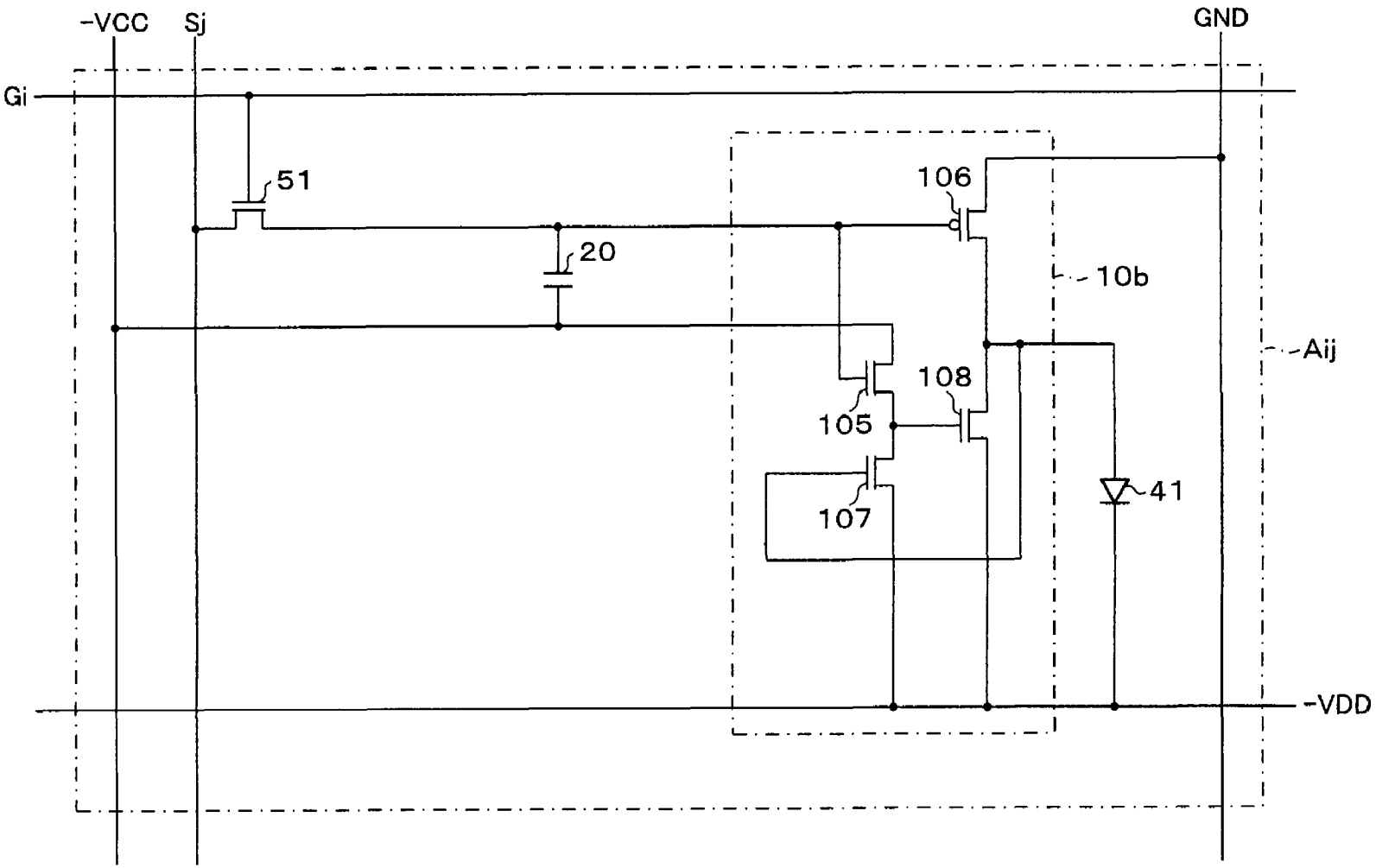
FIG. 6 is a circuit diagram illustrating an example of an arrangement of a pixel included in the displaying substrate in FIG. 5.

As illustrated in FIG. 6, one pixel Aij, provided in the display section 4 of the displaying substrate 2, includes: a switching TFT 51 (n-type TFT) which is the first switching device; the capacitor 20 which is the voltage keeping section; the organic EL device 41 which is the display device; and the voltage variation section 10*b*.

More specifically, the output terminal of the source driver (not illustrated in FIG. 6), which is composed of: the column select driver 15; the outer-pixel image memory section 6; and the bi-directional buffer section 11, is connected to the data line (first line) Sj, and between the data line Sj and the voltage variation section 10*b*, the switching TFT 51 is provided. The source terminal of this switching TFT 51 is connected to the data line Sj, while the drain terminal of the switching TFT 51 is connected to the voltage variation section 10*b*. However, although the capacitor 20 is also connected to this drain terminal in the present embodiment, this arrangement is not mandatory so that the voltage may be kept by a stray capacitance, etc. instead of the capacitor 20. Moreover, the gate terminal of the switching TFT 51 is connected to a gate line (second line) Gi.

The voltage variation section 10*b* has a circuit arrangement such that 3 n-type TFTs 105, 107, and 108, and one p-type TFT 106 are included therein.

The n-type TFT 105 is arranged such that the source terminal is connected to a low voltage power supply line −VCC (negative power source in the present embodiment), the drain terminal is connected to a source terminal of the n-type TFT 107 and a gate terminal of the n-type TFT 108, and the gate terminal is connected to a gate terminal of the p-type TFT 106 and the drain terminal of the switching TFT 51. The p-type TFT 106 is arranged such that the source terminal is connected to the reference voltage line GND, the drain terminal is connected to a source terminal of the n-type TFT 108 and a gate terminal of the n-type TFT 107, and the gate terminal is connected to the gate terminal of the n-type TFT 105 and the drain terminal of the switching TFT 51.

The n-type TFT 107 is arranged such that the source terminal is connected to the drain terminal of the n-type TFT 105 and the gate terminal of the n-type TFT 108, the drain terminal is connected to a high voltage power supply line −VDD (negative power source in the present embodiment), and the gate terminal is connected to the drain terminal of the p-type TFT 106 and the source terminal of the n-type TFT 108. The n-type TFT 108 is arranged such that the source terminal is connected to the drain terminal of the p-type TFT 106 and the gate terminal of the n-type TFT 107, the drain terminal is connected to the high voltage power supply line −VDD (negative power source in the present embodiment), and the gate terminal is connected to the drain terminal of the n-type TFT 105 and the source terminal of the n-type TFT 107.

In the voltage variation section 10*b*, the drain terminal of the switching TFT 51 is the input terminal of the voltage variation section 10*b*, and the drain terminal of the p-type TFT 106 is the output terminal of the voltage variation section 10*b*. An anode of the organic EL device 41 is connected to the drain terminal (output terminal of the voltage variation section 10*b*) of the p-type TFT 106, and a cathode of the organic EL device 41 is connected to the high voltage power supply line −VDD. Incidentally, in the voltage variation section 10*b* arranged as above, the conducting resistances of the n-type TFT 105 and the p-type TFT 106 are set so as to be lower than the conducting resistances of the n-type TFTs 107 and 108.

In the voltage variation section 10*b* arranged as above, the input voltage and output voltage to/from the voltage variation section 10*b* establish relations as illustrated in table. 2. Table. 2 also illustrates the voltage of the drain terminal of the n-type TFT 105 which is a part of the voltage variation section 10*b*.

TABLE 2

| | Input Terminal Drain Terminal of Switching TFT 51 | Drain Terminal of n-Type TFT 105 | Output Terminal Drain Terminal of p-Type TFT 106 |
|---|---|---|---|
| (I) | −Vcc | −Vdd | Vgnd |
| (II) | Vgnd | Vgnd | −Vdd |

The following descriptions will discuss the relationship between (I) and (II) in table. 2 in detail.

First of all, in (I), when the drain terminal of the switching TFT 51, which is the input terminal, has the low voltage −Vcc, the low voltage −Vcc is applied to the gate terminal of the p-type TFT 106 so that the p-type TFT 106 is brought into conduction. As a result, the drain terminal of the p-type TFT 106 has the ground voltage Vgnd.

Also, since the output from the drain terminal of the p-type TFT 106 is supplied to the gate terminal of the n-type TFT 107, the n-type TFT 107 is brought into conduction. At this moment, the gate terminal of the n-type TFT 105 receives the low voltage −VCC so that the drain terminal of the n-type TFT 105 has a voltage lower than the voltage −VCC. To the gate terminal of the n-type TFT 107, the ground voltage Vgnd which is the drain terminal output from the p-type TFT 106 is applied, and hence the n-type TFT 107 is brought into conduction. Consequently, the drain terminal of the n-type TFT 105 has a voltage within the range between the high voltage −Vdd and the low voltage −Vcc. The output from the drain terminal of the n-type TFT 105 is supplied to the gate terminal of the n-type TFT 108 so that the n-type TFT 108 is brought almost out of conduction. Thus the output voltage of the drain terminal of the p-type TFT 106, which is the output terminal, becomes stable at the ground voltage Vgnd.

Then in (II), when the drain terminal of the switching TFT 51, which is the input terminal, has the ground voltage Vgnd, the ground voltage Vgnd is applied to the gate terminal of the n-type TFT 105 so that the n-type TFT 105 is brought into conduction. As a result, the drain terminal of the n-type TFT 105 has the voltage −VCC.

Since the output from the drain terminal of the n-type TFT 105 is supplied to the gate terminal of the n-type TFT 108, the n-type TFT 108 is brought into conduction. At this moment, since the gate terminal of the p-type TFT 106 receives the ground voltage Vgnd, the p-type TFT 106 is brought out of conduction, and hence the drain terminal of the p-type TFT 106 has the high voltage −Vdd. The output from the drain terminal of the p-type TFT 106 is supplied to the gate terminal of the n-type TFT 107 so that the n-type TFT 107 is brought out of conduction, and thus the drain terminal of the p-type TFT 106, which is the output terminal, has the high voltage −Vdd.

As described above, the voltage variation section 10*b* in accordance with the present invention is arranged so that supplying either the low voltage −Vcc or the ground voltage Vgnd to the drain terminal of the switching TFT 51 makes it possible to apply either the ground voltage Vgnd or the high voltage −Vdd to the anode of the organic EL device 41. Thus, in the voltage variation section 10*b*, the voltage of the image data is increased to a voltage necessary for the luminescence of the organic EL device 41 so as to be supplied to the organic EL device 41. Therefore the output current from the source driver can be reduced so that the drive circuit consumes fewer amount of electricity, and consequently the low-power-consumption display apparatus can be realized.

By the way, the display apparatus of embodiment 3 is affected by the fluctuations of threshold voltages and the mobility of the n-type TFT 105, the p-type TFT 106, and the n-type TFTs 107 and 108 all constituting the voltage variation section 10*b*. Accordingly, the operation of the voltage variation section 10*b* in the conditions of prospective fluctuations of the threshold voltages and the mobility is tested through the motion simulations. The results thereof are illustrated in the graph of FIG. 7.

Figure 7:
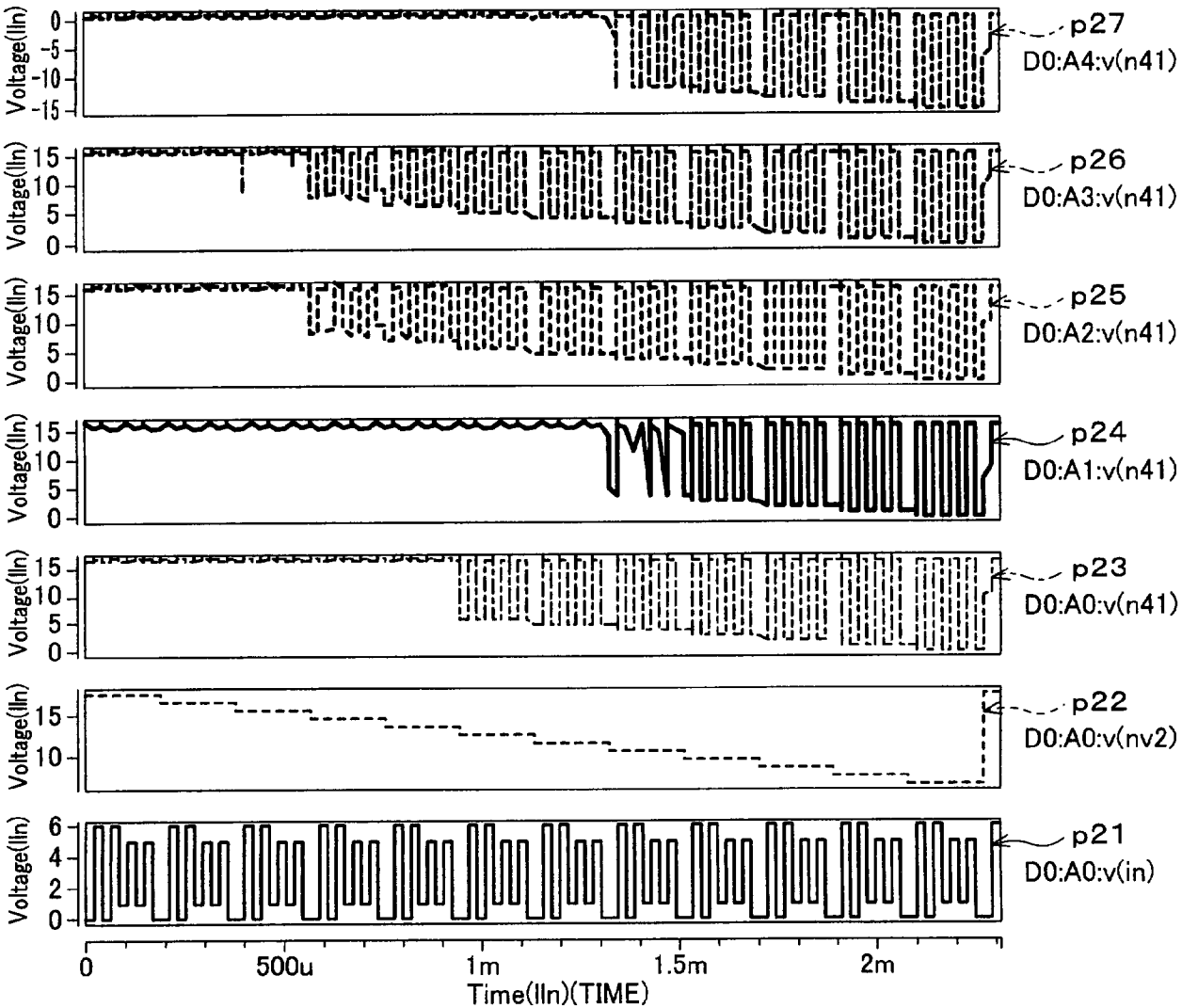
FIG. 7 is a graph showing the results of motion simulations of a voltage variation section in the display apparatus in FIG. 5.

In the graph of FIG. 7, a horizontal axis indicates the time and a vertical axis indicates the voltage. A graph p21 is a graph illustrating the voltage of the data line Sj, which is the input voltage of this voltage variation section 10*b*. A single cycle of the voltage is arranged such that after two pulses each having amplitude between −6V and 0V are repeated, two pulses each having amplitude between −5V and −1V are repeated and then the voltage returns to −6V. A graph p22 is a graph illustrating the voltage of the high voltage power supply line Vdd, arranged such that from −5V to −17V, the voltage of the data line Sj decreases by 1V with respect to each cycle.

Graphs p23 through p27 are graphs illustrating the simulations of voltages of the output terminal (drain terminal of the p-type TFT 106), and the mobility and the threshold voltage of the p-type TFT and the mobility and the threshold voltage of the n-type TFT are varied in 5 conditions as (1) the p-type TFT has the maximum mobility and the minimum threshold voltage and the n-type TFT has the minimum mobility and the maximum threshold voltage, (2) the p-type TFT has the minimum mobility and the maximum threshold voltage and the n-type TFT has the maximum mobility and the minimum threshold voltage, (3) the p-type TFT has the maximum mobility and the maximum threshold voltage and the n-type TFT has the minimum mobility and the minimum threshold voltage, (4) the p-type TFT has the minimum mobility and the minimum threshold voltage and the n-type TFT has the maximum mobility and the maximum threshold voltage, and (5) both the p-type and n-type TFTs have standard mobility and threshold voltage, so that the operations of the voltage variation section 10*b* are examined. That is to say, the results of the simulations in FIG. 7 indicate that when the input voltage of the voltage variation section 10*a* has amplitude between −1V and 5V, the voltage of the high voltage power supply line −Vdd can be varied from −15V to −17V. However, since the n-type TFT 105 in the voltage variation section 10*b* is always in the state of conduction, currents run from the low voltage power supply line −Vcc to the high voltage power supply line −Vdd when the n-type TFT 107 is brought into conduction. Thus an on-state resistance of the n-type TFT 105 has to be relatively high.

Figure 8:
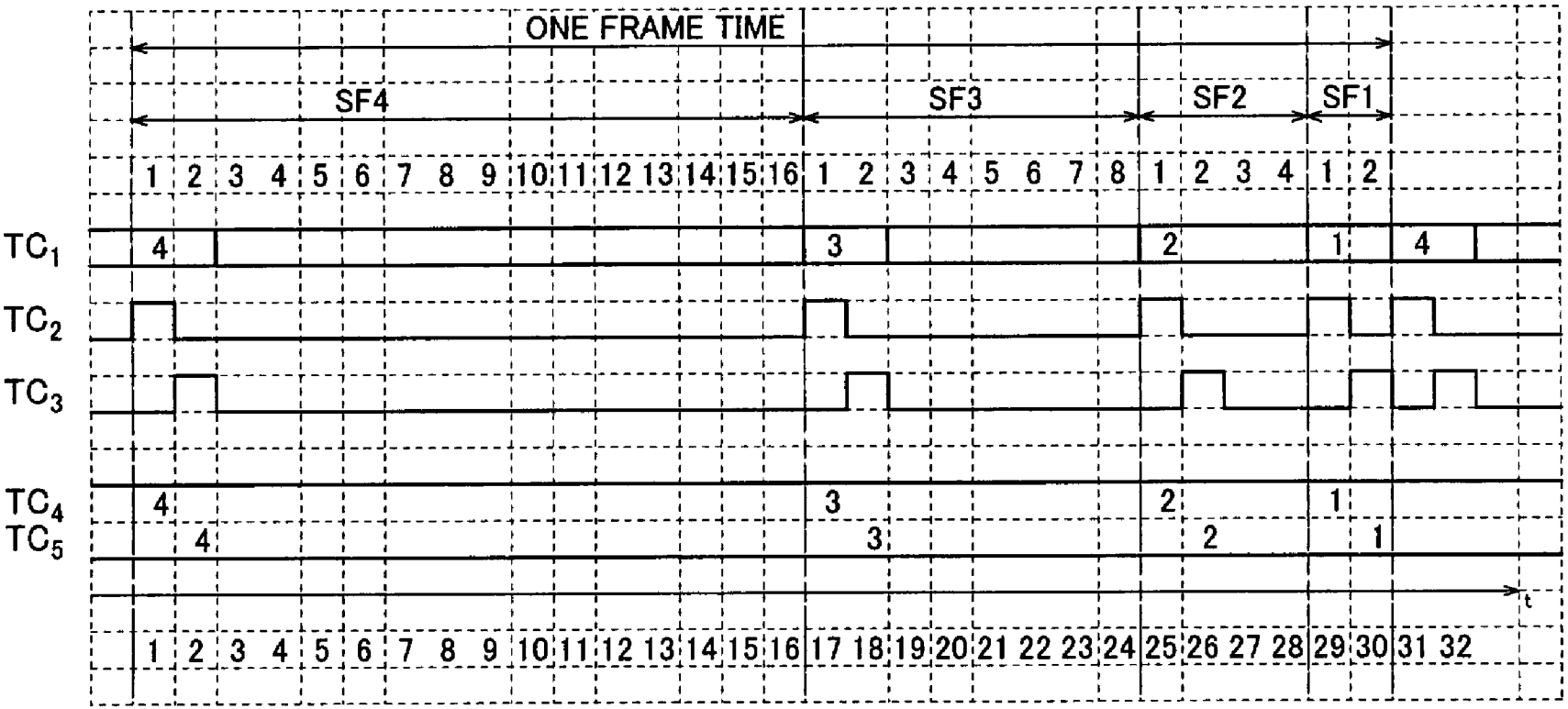
FIG. 8 is a time chart indicating an example of a time ratio grayscale method of the display apparatus in FIG. 5.

Next, the following descriptions will discuss an example such that the time ratio grayscale of 4 bits is used in the voltage variation section 10*b* arranged as above, with reference to a time chart in FIG. 8. Incidentally, in the time chart illustrated in FIG. 8, only two gate lines Gi (G1 and G2) are provided in the display section of the display apparatus in FIG. 5, for the sake of simplicity.

In FIG. 8, a chart TC1 of the highest tier indicates the voltage of the image data supplied to the data lines Sj, and this voltage is equivalent to either the low voltage Vcc or the ground voltage Vgnd. FIG. 8 shows a simplified version of the chart TC1 in FIG. 4 described in embodiment 2, so that the image data transferred from the memory cells Mij to the data lines Sj via the bi-directional buffers Bj is represented as the numeric characters assigned to the bits of the image data.

A chart TC2 of the second highest tier indicates the voltage of the control data supplied to the first gate line G1 (see FIG. 5), and a chart TC3 indicates the voltage of the control data supplied to the second gate line G2 (see FIG. 5). Incidentally, although these charts also have amplitude (select voltage Vs or non-select voltage Vns) identical with the same of the charts TC2 and TC3 illustrated in FIG. 4 in embodiment 2, the amplitude is not illustrated in FIG. 8.

A chart TC4 of the second lowest tier indicates the bit number of the image data stored in the organic EL device 41 in a pixel A1*j* (pixel Aij in the first line), and the image data is updated at periods indicated by the numeric characters. Incidentally, periods without the number in the chart indicate that the image data has been stored during the periods. Similarly, a chart TC5 of the lowest tier indicates the bit number of the image data stored in the organic EL device 41 in a pixel A2*j* (pixel Aij in the second line).

A vertical axis in FIG. 8 indicates, as in FIG. 4 described in embodiment 2, values of the voltages of the charts TC1 through TC5, while a horizontal axis signifies select periods. One frame time consists of 30 select periods.

First of all, during select periods 1 and 2, as indicated in the TC1, image data of a fourth bit is supplied from the memory cells Mij to the data lines Sj. At this moment, as shown in the TC2, the gate line G1 has the select voltage Vs in the select period 1 so that the switching TFT 51 in the pixel Aij is brought into conduction, and as the TC4 suggests, a signal corresponding to the data of the data lines Sj is captured by the capacitor 20 in the pixel A1*j*.

As indicated in the TC3, the gate line G2 has the select voltage Vs in the select period 2 so that the switching TFT 51 in the pixel A2*j* is brought into conduction, and as the TC5 shows, a signal corresponding to the image data of the data line Sj is captured by the capacitor 20 in the pixel A2*j*.

Then during select periods 3 through 16, no variations of voltages concerning the drive are observed so that the conditions are preserved intact.

Subsequently, during select periods 17 and 18, image data of a third bit is supplied from the memory cells Mij to the data lines Sj, as indicated in the TC1. At this moment, as shown in the TC2, the gate line G1 has the select voltage Vs in the select period 17 so that the switching TFT 51 in the pixel A1*j* is brought into conduction, and as shown in the TC4, a signal corresponding to the image data of the data lines Sj is captured by the capacitor 20 in the pixel A1*j*.

In the select period 18, as the TC3 indicates, the gate line G2 has the select voltage Vs so that the switching TFT 51 in the pixel A2*j* is brought into conduction, and as shown in the TC5, a signal corresponding to the image data of the data lines Sj is captured by the capacitor 20 in the pixel A2*j*.

Then during select periods 19 through 24, no variations of voltages concerning the drive are observed again, so that the conditions are preserved intact.

Subsequently, during select periods 25 and 26, image data of a second bit is supplied from the memory cells Mij to the data lines Sj as indicated in the TC1. At this moment, as shown in the TC2, the gate line G1 has the select voltage Vs in the select period 25 so that the switching TFT 51 in the pixel A1*j* is brought into conduction, and as the TC4 suggests, a signal corresponding to the image data of the data lines Sj is captured by the capacitor 20 in the pixel A1*j*.

In the select period 26, the gate line G2 has the select voltage Vs as indicated in the TC3 so that the switching TFT 51 in the pixel A2*j* is brought into conduction, and as suggested in the TC5, a signal corresponding to the image data of the data line Sj is captured by the capacitor 20 in the pixel A2*j*.

Then during select periods 27 and 28, no variations of voltages concerning the drive are observed again, so that the conditions are preserved intact.

Subsequently, during select periods 29 and 30, data of a first bit is supplied from the memory cells Mij to the data lines Sj as shown in the TC1. At this moment, as indicated in the TC2, the gate line G1 has the select voltage Vs in the select period 29 so that the switching TFT 51 in the pixel A1*j* is brought into conduction, and as the TC4 shows, a signal corresponding to the image data of the data lines Sj is captured by the capacitor 20 in the pixel A1*j*.

In the select period 30, as indicated in the TC3, the gate line G2 has the select voltage Vs so that the switching TFT 51 in the pixel A2*j* is brought into conduction, and as shown in the TC5, a signal corresponding to the image data of the data lines Sj is captured by the capacitor 20 in the pixel A2*j*.

As described above, the present embodiment is arranged so that one data line Gi corresponds to a plurality of the pixels Aij, and hence the capacity of the data line Gi is increased. However, in the present invention, the voltage variation section 10*b* is provided in each of the pixels Aij so that the power consumption is further decreased. On this account, the present invention is particularly suitable for a matrix-type display apparatus.

Embodiment 4

Figure 9:
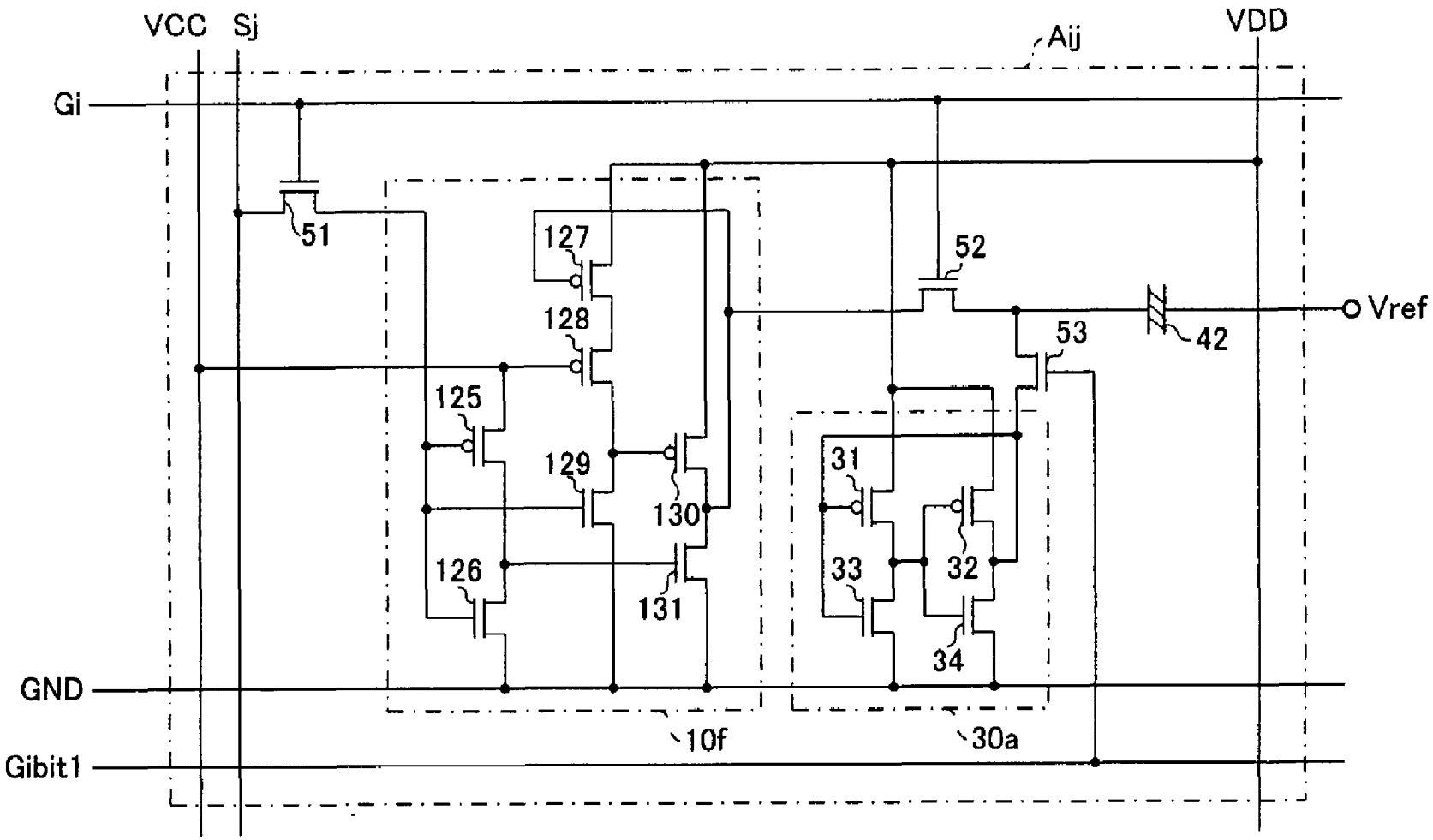
FIG. 9 is a circuit diagram illustrating an example of an arrangement of a pixel included in a display apparatus of a fourth embodiment in accordance with the present invention.
Figure 10:
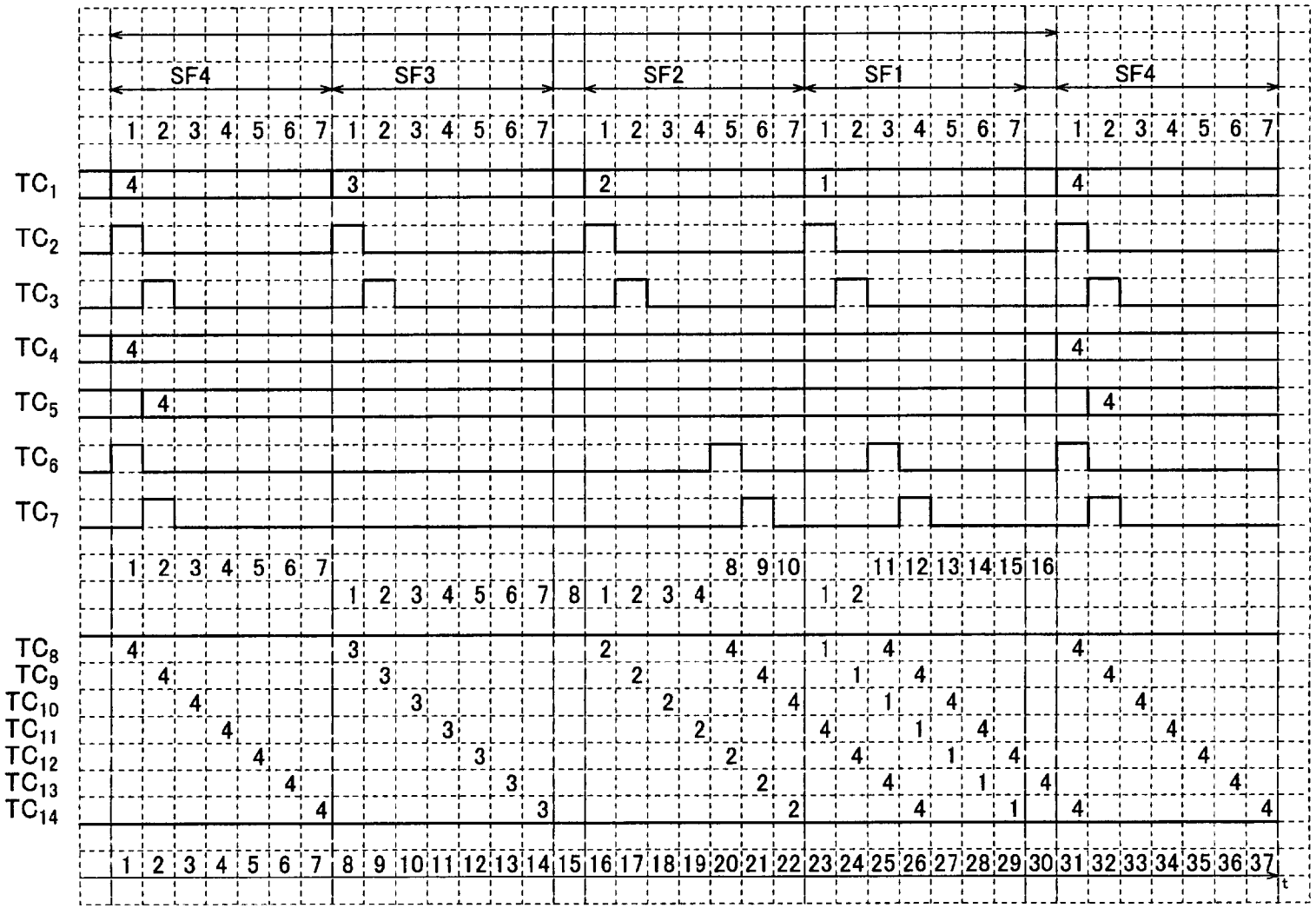
FIG. 10 is a time chart indicating a time ratio grayscale method of the display apparatus in FIG. 9.
Figure 11:
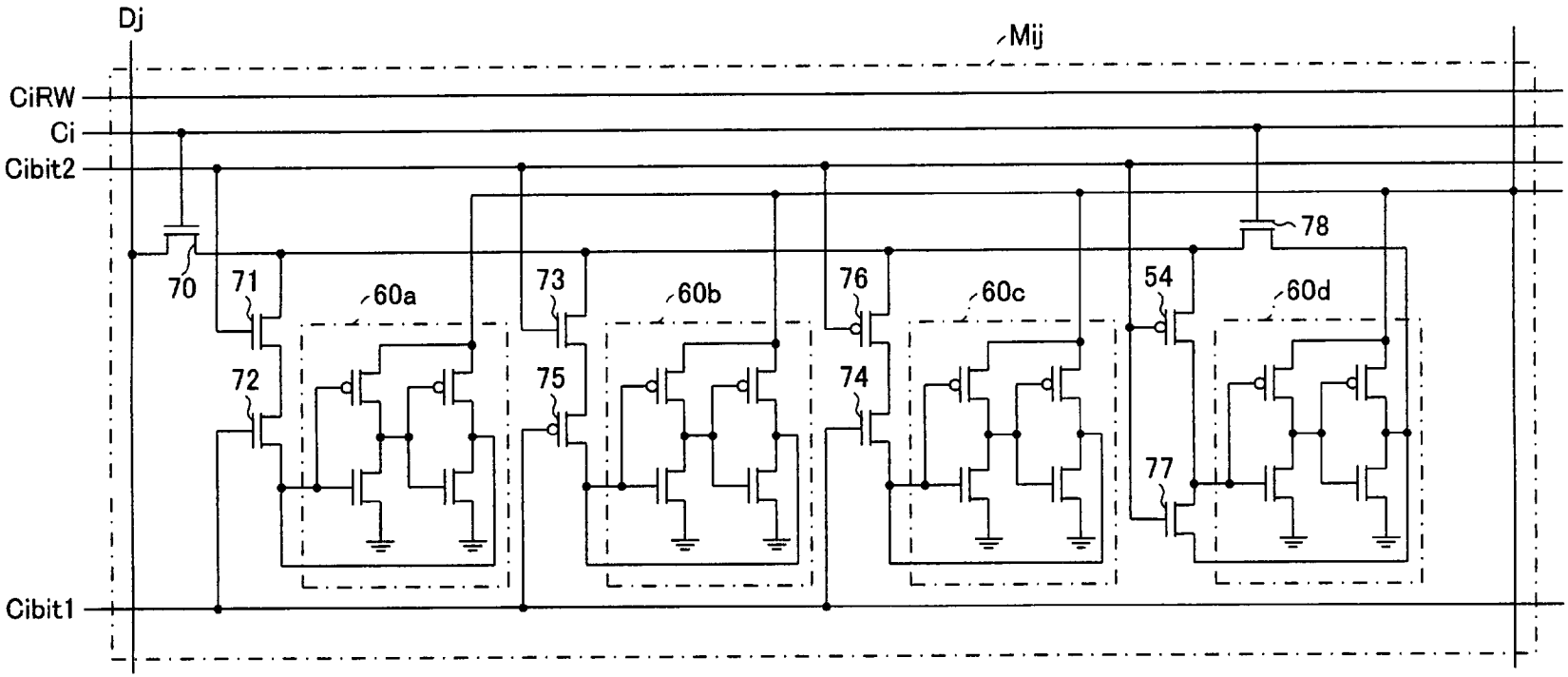
FIG. 11(*a*) is a circuit diagram showing an example of an arrangement of a memory cell in an outer-pixel image memory section in the display apparatus in FIG. 9.
Figure 11:
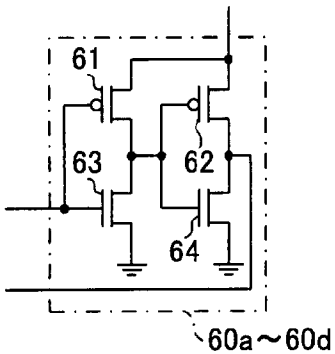

The following description will discuss a fourth embodiment of the present invention with reference to FIGS. 9 through 11. By the way, it is noted that the present invention is not particularly limited to this embodiment, and members having the same functions as those described in embodiments 1 through 3 are given the same numbers, so that the descriptions are omitted for the sake of convenience.

In embodiment 3, the operations actually associated with the drive of the display apparatus are carried out in 8 select periods out of 30 select periods constituting one frame time. In the meantime, the present embodiment is not limited to this arrangement so that it is possible to increase the number of the select periods associated with the operations, in one frame time.

As FIG. 9 illustrates, a display apparatus in accordance with the present invention, (i) including: the gate lines Gi; the data lines Sj (input voltage); and the switching TFTs 51 corresponding to the respective liquid crystal devices 42 as in embodiment 2, and (ii) further containing the storage sections 30*a*, is arranged such that a voltage variation section 10*f* is provided between each switching TFT 51 and the associated storage section 30*a*.

More specifically, the switching TFT 51 is arranged such that the source terminal is connected to the data line Sj, the drain terminal is connected to an input terminal (gate terminal of a p-type TFT 125) of the voltage variation section 10*f*, and the gate terminal is connected to the gate line Gi.

The voltage variation section 10*f* has a circuit arrangement so as to include: the p-type TFT 125; an n-type TFT 126; a p-type TFT 127 (fifth TFT); a p-type TFT 128 (first TFT); an n-type TFT 129 (second TFT); a p-type TFT 130 (third TFT); and an n-type TFT 131 (fourth TFT).

The p-type TFT 125 is arranged such that the source terminal is connected to the low voltage power supply line (second power source) VCC which is a logic line, the drain terminal is connected to a source terminal of the n-type TFT 126 and a gate terminal of the n-type TFT 131, and the gate terminal is connected to the switching TFT 51. The n-type TFT 126 is arranged such that the source terminal is connected to the drain terminal of the p-type TFT 125, the drain terminal is connected to the reference voltage line GND, and the gate terminal is connected to the switching TFT 51. The p-type TFT 127 is arranged such that the source terminal is connected to the high voltage power supply line (first power source) VDD, the drain terminal is connected to a source terminal of the p-type TFT 128, and the gate terminal is connected to a drain terminal of the p-type TFT 130 and a source terminal of the n-type TFT 131. The p-type TFT 128 is arranged such that the source terminal is connected to the drain terminal of the p-type TFT 127, the gate terminal is connected to the low voltage power supply line (logic line) VCC, and the drain terminal is connected to a gate terminal of the p-type TFT 130 and a source terminal of the n-type TFT 129. The n-type TFT 129 is arranged such that the source terminal is connected to the drain terminal of the p-type TFT 128, the gate terminal is connected to the drain terminal of the switching TFT 51, and the drain terminal is connected to the reference voltage line GND. The p-type TFT 130 is arranged such that the source terminal is connected to the high voltage power supply line VDD, the drain terminal is connected to the source terminal of the n-type TFT 131 and the gate terminal of the p-type TFT 127, and the gate terminal is connected to the drain terminal of the p-type TFT 128. The n-type TFT 131 is arranged such that the source terminal is connected to the drain terminal of the p-type TFT 130, the gate terminal is connected to the drain terminal of the p-type TFT 125, and the drain terminal is connected to the reference voltage line GND. The arrangements other than the above are identical with that of the pixel Aij in embodiment 2 so that no descriptions are provided here.

In the voltage variation section 10*f* arranged as above, the input voltage (drain terminal of the switching TFT 51) applied to the voltage variation section 10*f* and the output voltage (drain terminal of the p-type TFT 130) supplied from the voltage variation section 10*f* establish relations as shown in table. 3. Table. 3 also illustrates the voltage of the drain terminal of the p-type TFT 125 and the voltage of the drain terminal of the p-type TFT 128, the TFTs constituting the voltage variation section 10*f*.

TABLE 3

| | Input Terminal Drain Terminal of Switching TFT 51 | Drain Terminal of p-Type TFT 125 | Drain Terminal of p-type TFT 125 | Output Terminal Drain Terminal of p-Type TFT 130 |
|---|---|---|---|---|
| (I) | Vcc | Vgnd | Vgnd | Vdd |
| (II) | Vgnd | Vcc | Vdd | Vgnd |

The following is a detailed description of the relations between (I) and (II) illustrated in table. 3.

In (I), when the drain terminal of the switching TFT 51, which is the input terminal, has the low voltage Vcc, the low voltage Vcc is applied to the gate terminal of the p-type TFT 125, the gate terminal of the n-type TFT 126, and the gate terminal of the n-type TFT 129.

The n-type TFT 129 is brought into conduction when the low voltage Vcc is applied to the gate terminal thereof, and since the low voltage Vcc is also applied to the gate terminal of the p-type TFT 128, because of the difference of the conducting resistances of these two, the drain terminal of the p-type TFT 128 varies toward the ground voltage Vgnd. The output from the drain terminal of the p-type TFT 128 is supplied to the gate terminal of the p-type TFT 130 so that the p-type TFT 130 is brought into conduction.

The low voltage Vcc is also applied to the gate terminal of the p-type TFT 125 and the gate terminal of the n-type TFT 126 so that the p-type TFT 125 is brought out of conduction, whereas the n-type TFT 126 is brought into conduction. As a result, the drain terminal of the p-type TFT 125 has the ground voltage Vgnd. Since the output from the drain terminal of the p-type TFT 125 is supplied to the gate terminal of the n-type TFT 131, the n-type TFT is brought out of conduction.

As a consequence, the drain terminal of the p-type TFT 130 has the high voltage Vdd. Also, since the output from the drain terminal of the p-type TFT 130 is supplied to the gate terminal of the p-type TFT 127, the p-type TFT 127 is brought out of conduction. Thus, the drain terminal of the p-type TFT 128 has the ground voltage Vgnd, and the voltage of the drain terminal of the p-type TFT 130, the drain terminal being the output terminal, is stabilized at the high voltage Vdd.

Next, in (II), when the drain terminal of the switching TFT 51, which is the input terminal, has the ground voltage Vgnd, the ground voltage Vgnd is applied to the gate terminal of the p-type TFT 125, the gate terminal of the n-type TFT 126, and the gate terminal of the p-type TFT 129.

When the ground voltage Vgnd is applied to the gate terminals of the p-type TFT 125 and the n-type TFT 126, the p-type TFT 125 is brought into conduction, the n-type TFT 126 is brought out of conduction, and the drain terminal of the p-type TFT 125 has the low voltage Vcc. Since the output from the drain terminal of the p-type TFT 125 is supplied to the gate terminal of the n-type TFT 131, the gate terminal of the n-type TFT 131 has the low voltage Vcc and the n-type TFT 131 is brought into conduction. At this moment, even if the p-type TFT 130 is in the state of conduction, due to the difference of the conducting resistances of these two TFTs, the voltage of the drain terminal of the p-type TFT 130 approaches the ground voltage Vgnd.

Since the output from the drain terminal of the p-type TFT 130 is supplied to the gate terminal of the p-type TFT 127, the p-type TFT 127 is brought into conduction. Also, the low voltage Vcc is applied to the gate terminal of the p-type TFT 128 so that the p-type TFT 128 is brought into conduction.

In the meantime, since the ground voltage Vgnd is applied to the gate terminal of the p-type TFT 129, the p-type TFT 129 is brought out of conduction.

As a result, the drain terminal of the p-type TFT 128 has the high voltage Vdd. Also, since the output from the drain terminal of the p-type TFT 128 is supplied to the gate terminal of the p-type TFT 130, the p-type TFT 130 is brought out of conduction. Thus the drain terminal of the p-type TFT 128 has the ground voltage Vdd, and the voltage of the drain terminal of the p-type TFT 130, the drain terminal being the output terminal, is constant at the ground voltage Vgnd.

The circuit arrangement as above indicates that the voltage variation section 10*f* en masse is composed of not less than two inverter circuits. For instance, the p-type TFT 128 and the n-type TFT 129 constitute an inverter (first inverter) and the p-type TFT 130 and the n-type TFT 131 constitute another inverter (second inverter). That is, the gate terminal of the n-type TFT 129 receives the input voltage of the first inverter, the gate terminal of the p-type TFT 128 receives a power supply voltage, and the gate terminal of the p-type TFT 127 receives the output voltage of the second inverter. Incidentally, even without providing the TFT 127, it is possible to constitute voltage variation means by the first and second inverters.

According to the arrangement above, provided that the n-type TFT 129 is in the state of conduction, even if the p-type TFT 127 is in the state of conduction, the output voltage of the drain terminal of the p-type TFT 128 can acquire the amplitude necessary for controlling the conduction/non-conduction of other TFTs, since the p-type TFT 128, which is inserted between the TFTs 127 and 129, becomes a resistance component.

Being different from the voltage variation section 10*b* in FIG. 6, the voltage variation section 10*f* in FIG. 9 is arranged such that any one of the TFTs constituting each of the inverter circuits is out of conduction and hence it is possible to suitably reduce the total amount of currents running between the power sources via the inverter circuits.

Figure 21:
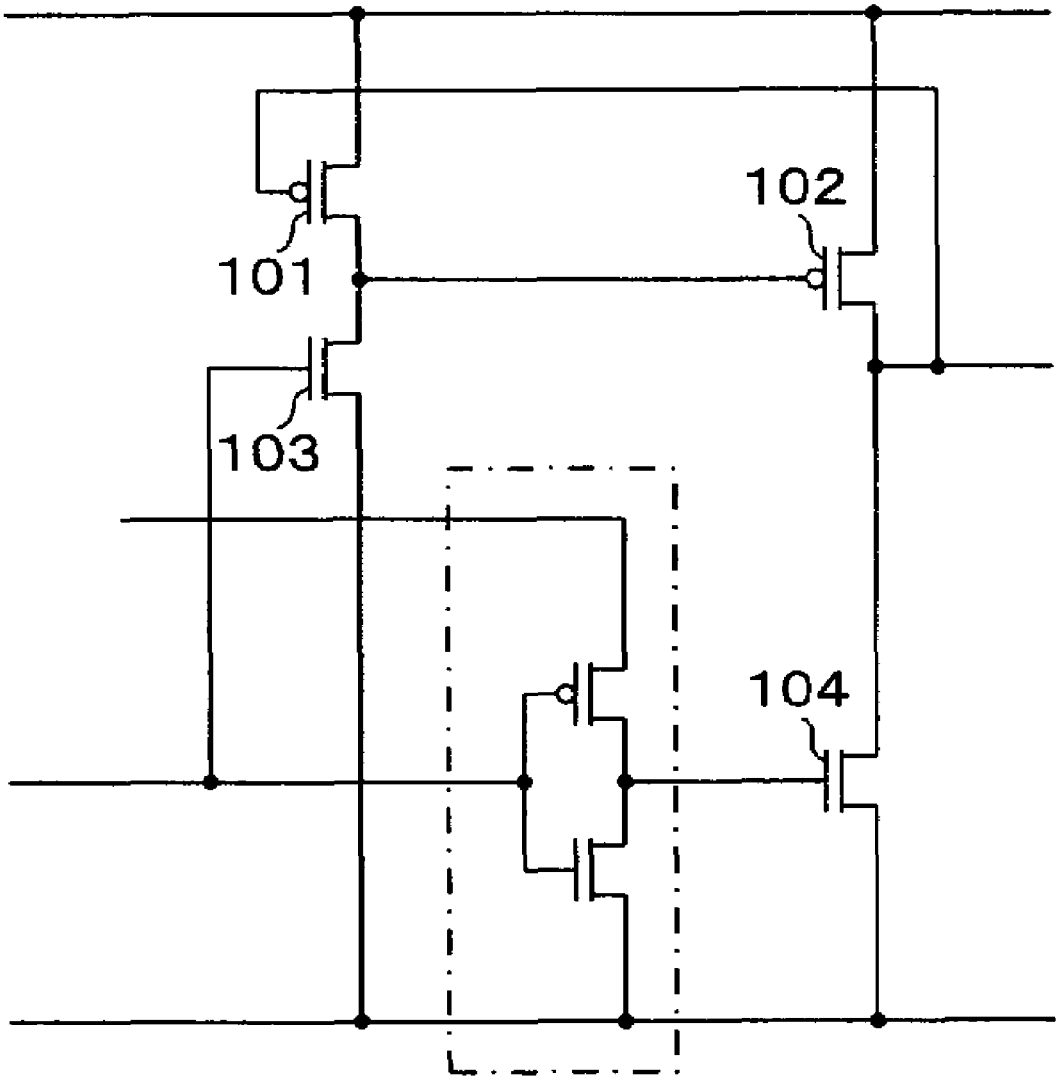
FIG. 21 is a circuit diagram showing an arrangement such that the circuit in FIG. 1 is provided with an additional inverter.

The following is the description of the difference between the circuit shown in FIG. 1 and the circuit shown in FIG. 9. According to FIG. 1, a signal, which brings the n-type TFT 103 of the third inverter (p-type TFT 101 and the n-type TFT 103) into conduction, controls the switching operation of the n-type TFT 104 of the fourth inverter. Thus, in the circuit illustrated in FIG. 1, it is not necessary to include an inverter equivalent to the p-type TFT 125 and the n-type TFT 126 in the circuit in FIG. 9. Under ordinary circumstances, the circuit in FIG. 1 further includes a fifth converter (circumscribed by dotted lines), as FIG. 21 shows. However, the circuit in FIG. 1 is arranged as above to further reduce the number of the TFTs.

Arrangements other than the above are the same as the pixel Aij described in the embodiments 2 so that the descriptions are omitted for the sake of convenience.

Now, the operation of the voltage variation section 10*f* in the prospective conditions of fluctuations of the threshold voltages and the mobility is tested through the motion simulations. The results thereof are illustrated in the graph of FIG. 19.

Figure 19:
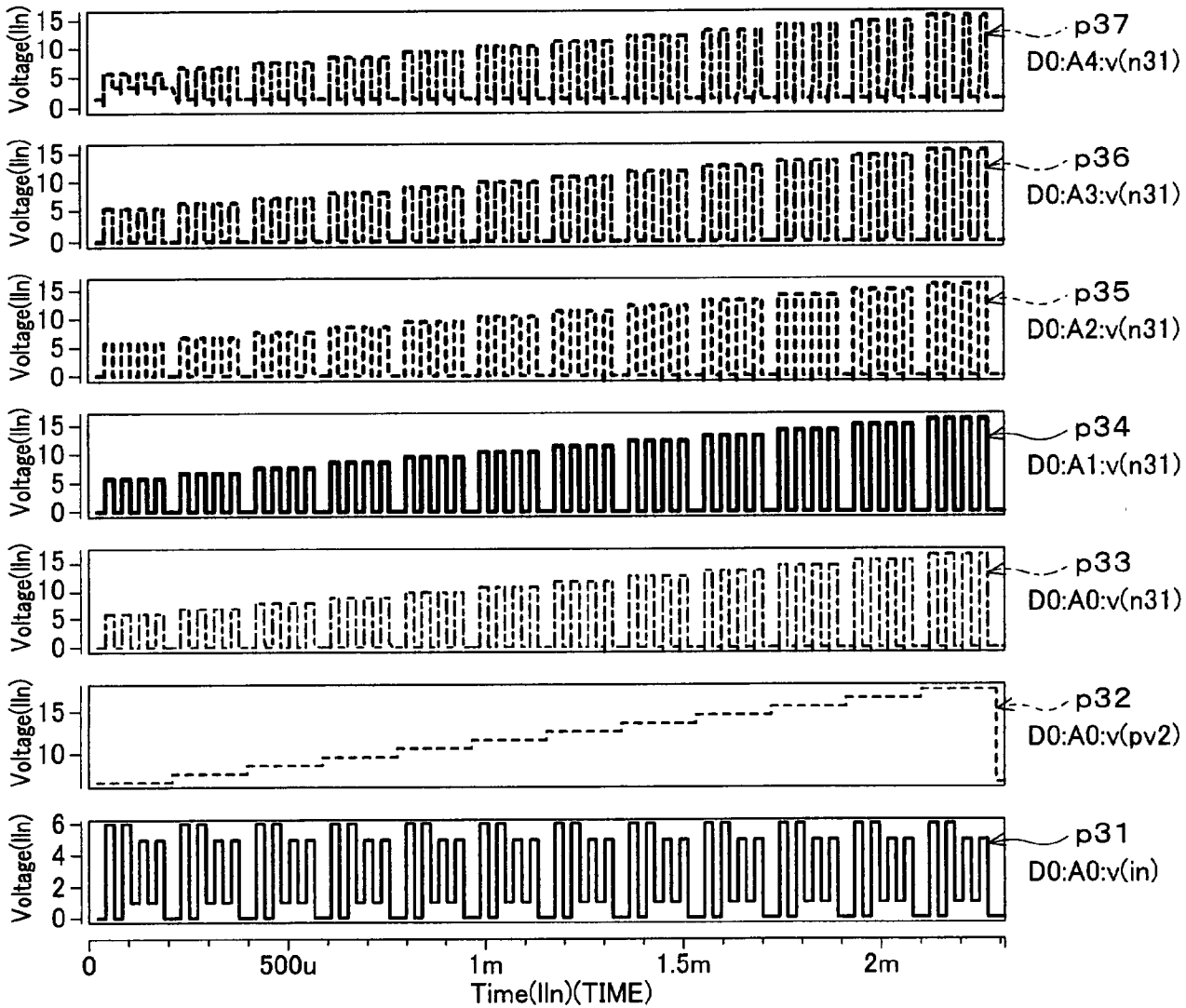
FIG. 19 is a graph illustrating the results of motion simulations of a voltage variation section in the display apparatus in FIG. 9.

In the graph of FIG. 19, a horizontal axis indicates the time and a vertical axis indicates the voltage. A graph p31 is a graph illustrating the voltage of the data line Sj, which supplies the input voltage of this voltage variation section 10*f*. A single cycle of the voltage is arranged such that after two pulses each having amplitude between 0V and 6V are repeated, two pulses each having amplitude between 1V and 5V are repeated and then the voltage returns to 0V. A graph p32 is a graph illustrating the voltage of the high voltage power supply line Vdd which is arranged such that from 5V to 16V, the voltage of the data line Sj increases by 1V with respect to each cycle.

Graphs p33 through p37 are graphs illustrating the simulations of the voltage of the output terminal (drain terminal of the p-type TFT 130) in accordance with the lapse of time, and the mobility and the threshold voltage of the p-type TFT and the mobility and the threshold voltage of the n-type TFT are varied in 5 conditions as (1) the p-type TFT has the maximum mobility and the minimum threshold voltage and the n-type TFT has the minimum mobility and the maximum threshold voltage, (2) the p-type TFT has the minimum mobility and the maximum threshold voltage and the n-type TFT has the maximum mobility and the minimum threshold voltage, (3) the p-type TFT has the maximum mobility and the maximum threshold voltage and the n-type TFT has the minimum mobility and the minimum threshold voltage, (4) the p-type TFT has the minimum mobility and the minimum threshold voltage and the n-type TFT has the maximum mobility and the maximum threshold voltage, and (5) both the p-type and n-type TFTs have standard mobility and threshold voltage, so that the operations of the voltage variation section 10*a* are examined.

That is to say, the results of the simulations in FIG. 19 indicate that if the input voltage of the voltage variation section 10*f* has amplitude between 0V and 6V, the voltage of the high voltage power supply line Vdd can be varied from 7V to 16V.

The voltage variation means of the present embodiment is not particularly limited to the voltage variation section 10*f* so that the voltage variation section 10*a* may be adopted. However, considering the objective of the present invention, the higher the ratio of the high voltage Vdd to the low voltage Vcc is, the more the power consumption can be reduced. Thus, according to the present embodiment, the high voltage Vdd supplied to the display device (liquid crystal device 42) can be suitably increased if the voltage variation section 10*f* is adopted.

Next, referring to a time chart in FIG. 10, an example in which the time ratio grayscale method of 4 bits in the display apparatus having the above-identified circuit arrangement is described below. Incidentally, in the time chart illustrated in FIG. 10, as in embodiment 3, only 7 gate lines Gi (G1 through G7) are provided in the display section of the display apparatus in FIG. 5, for the sake of simplicity.

In FIG. 10, a chart TC1 of the highest tier indicates the voltage of the image data supplied to the data lines Sj, and the voltage is equivalent to either the low voltage Vcc or the ground voltage Vgnd. FIG. 10 shows a simplified version of the chart TC1 in FIG. 4 described in embodiment 2, so that the image data transferred from the memory cells Mij to the data lines Sj via the bi-directional buffers Bj is represented as the numeric characters assigned to the bits of the image data.

A chart TC2 of the second highest tier indicates the voltage of the control data supplied to the first gate line Gi, and a chart TC3 of the third tier indicates the voltage of the control data supplied to the second gate line G2. Incidentally, although these charts have amplitude (select voltage Vs or non-select voltage Vns) identical with the charts TC2 and TC3 in FIG. 4 described in embodiment 2, the amplitude is not illustrated in FIG. 10.

A chart TC4 of the fourth tier indicates the bit number of the image data stored in the storage section 30*a* in the pixel A1*j*, and the image data is updated at periods indicated by the numeric characters. Incidentally, periods without the number in the chart indicate that the image data has been stored during the periods. Similarly, a chart TC5 of the fifth tier indicates the bit number of the image data stored in the storage section 30*a* in the pixel A2*j*.

Charts TC6 and TC7 of the second lowest and the lowest tiers indicate the voltage of the control data supplied to the control line G1 bit 1 and the voltage of the control data supplied to the control line G2 bit 1, respectively. These charts are illustrated in a simplified manner, as in the cases of the charts TC2 and TC3.

Charts TC8, TC9, TC10, TC11, TC12, TC13, and TC14 indicate the image data applied to each of the liquid crystal devices 42 in the pixels A1*j*, A2*j*, A3*j*, A4*j*, A5*j*, A6*j*, and A7*j* respectively, as bit numbers. The image data is updated at periods indicated by the numeric characters. Incidentally, periods without the number in the chart indicate that the image data has been stored during the periods.

As in FIG. 4 of embodiment 2 and FIG. 8 of embodiment 3, in FIG. 10, a vertical axis indicates values of the voltages of the charts TC1 through TC14, while a horizontal axis indicates select periods. One frame time consists of 30 select periods.

First of all, during select periods 1 through 7, as the TC1 suggests, image data of a fourth bit is supplied from the memory cells Mij to the data lines Sj. Here, as the TC2 and TC6 indicate, both of the gate line G1 and the control line G1 bit 1 have the select voltage Vs in the select period 1 so that the switching TFTs 51 and 52 and the control TFT 53 in the pixel A1*j* are brought into conduction, and as shown in the TC8, the image data of the data lines Sj is captured by the liquid crystal device 42 and the storage section 30*a*.

In the select period 2, as indicated in the TC3 and TC7, both of the gate line G2 and the control line G2 bit 1 have the select voltage Vs so that the switching TFTs 51 and 52 and the control TFT 53 in the pixel A2*j* are brought into conduction, and as the TC9 indicates, the image data of the data lines Sj is captured by the liquid crystal device 42 and the storage section 30*a*. Subsequently, the same procedures are carried out in the pixels A3*j* through A7*j*.

Then during select periods 8 through 14, as the TC1 suggests, image data of a third bit is supplied from the memory cells Mij to the data lines Sj. Here, as the TC2 indicates, the gate line G1 has the select voltage Vs in the select period 8 so that the switching TFTs 51 and 52 in the pixel A1*j* are brought into conduction, and as shown in the TC8, the image data of the data lines Sj is captured by the liquid crystal device 42.

In the select period 9, the gate line G2 has the select voltage Vs as indicated in the TC3 so that the switching TFTs 51 and 52 in the pixel A2*j* are brought into conduction, and as shown in the TC9, the image data of the data lines Sj is captured by the liquid crystal device 42. Subsequently, the same procedures are carried out in the pixels A3*j* through A7*j*.

Then in the select period 15, no variations of voltages concerning the drive are observed so that the conditions are preserved intact.

During the select periods 16 through 22, as the TC1 indicates, image data of a second bit is supplied from the memory cells Mij to the data lines Sj. Here, as shown in the TC2, the gate line G1 has the select voltage Vs in the select period 16 so that the switching TFTs 51 and 52 in the pixel A1*j* are brought into conduction, and as the TC8 indicates, the image data of the data lines Sj is captured by the liquid crystal device 42.

In the select period 17, as the TC3 suggests, the gate line G2 has the select voltage Vs so that the switching TFTs 51 and 52 in the pixel A2*j* are brought into conduction, and as indicated in the TC9, the image data of the data lines Sj is captured by the liquid crystal device 42. Subsequently, the same procedures are carried out in the pixels A3*j* through A7*j*.

During select periods 20 through 26, image data stored in the storage section 30*a* in each of the pixels Aij is applied to the liquid crystal device 42. That is, in the select period 20, as shown in the TC6, the control line G1 bit 1 has the select voltage Vs so that the control TFT 53 in the pixel A1*j* is brought into conduction, and as indicated in the TC8, the output voltage (image data) of the storage section 30*a* is captured by the liquid crystal device 42.

In the select period 21, as the TC7 suggests, the control line G2 bit 1 has the select voltage Vs so that the control TFT 53 in the pixel A2*j* is brought into conduction, and as the TC9 shows, the output voltage (image data) of the storage section 30*a* is captured by the liquid crystal device 42. Subsequently, the same procedures are carried out in the pixels A3*j* through A7*j*.

Then during select periods 23 through 29, as the TC1 indicates, image data of a first bit is supplied from the memory cells Mij to the data lines Sj. Here, as the TC2 suggests, the gate line G1 has the select voltage Vs in the select period 23 so that the switching TFTs 51 and 52 in the pixel A1*j* are brought into conduction, and as indicated in the TC8, a signal corresponding to the image data of the data lines Sj is captured by the liquid crystal device 42.

In the select period 24, as indicated in the TC3, the gate line G2 has the select voltage Vs so that the TFTs 51 and 52 in the pixel A2*j* are brought into conduction, and as the TC9 suggests, a signal corresponding to the image data of the data lines Sj is captured by the liquid crystal device 42. Subsequently, the same procedures are carried out in the pixels A3*j* through A7*j*.

Now, during select periods 25 through 31, image data from the storage section 30*a* in each of the pixels Aij is applied to the liquid crystal device 42. That is, as indicated in the TC6, the control line G1 bit 1 has the select voltage Vs in the select period 25 so that the control TFT 53 in the pixel A1*j* is brought into conduction, and as the TC8 shows, the output voltage (image data) of the storage section 30*a* is captured by the liquid crystal device 42.

In the select period 26, as indicated in the TC7, the control line G2 bit 1 has the select voltage Vs so that the control TFT 53 in the pixel A2*j* is brought into conduction, and as suggested in the TC9, the output voltage (image data) of the storage section 30*a* is captured by the liquid crystal device 42. Subsequently, the same procedures are carried out in the pixels A3*j* through A7*j*.

Then a scanning of another frame starts from the select period 31 so that the sequence of drive control from the select period 1 is repeated.

As described above, 28 out of 30 select periods constituting one frame time are associated with the drive of the display apparatus in the present embodiment.

As described above, the present embodiment is arranged such that one data line Gi corresponds to a plurality of the pixels Aij, and although the capacity of each of the data lines Gi is increased as a consequence of the above, the present embodiment is arranged so that the power consumption can be further reduced.

Moreover, in the present embodiment, it is necessary to adjust the timing of the image data of a plurality of bits, which is supplied to each of the pixels Aij, to make it possible to display the image data in accordance with each of the bits. Thus, the present embodiment is preferably arranged such that, in addition to the storage section 30*a*, the outer-pixel image memory section (see FIG. 5) as the second storage means is provided outside the display section as in embodiment 3 so that the timing adjustment is carried out.

For instance, as illustrated in FIG. 11(*a*), a specific example of the memory cell Mij in the outer-pixel image memory includes: an n-type TFT 70; memory circuits 60*a*, 60*b*, and 60*c*; n-type TFTs 71, 72, 73, and 74 and p-type TFTs 75 and 76 all connected to the memory circuits 60*a*, 60*b*, and 60*c*; a memory circuit 60*d*; and n-type TFTs 54, 77, and 78.

The n-type TFT 70 is arranged such that the source terminal is connected to a data line Dj, the gate terminal is connected to a gate line Ci, and the drain terminal is connected to source terminals of the n-type TFTs 71 and 73, the p-type TFT 76, n-type TFT 78, and the p-type TFT 54. The p-type TFT 54 is arranged such that the source terminal is connected to a drain terminal of the n-type TFT 78, the gate terminal is connected to the gate line Ci, and the drain terminal is connected to an input terminal of the memory circuit 60*d* and a source terminal of the n-type TFT 77.

The n-type TFT 77 is arranged such that the source terminal is connected to the drain terminal of the p-type TFT 54, the gate terminal is connected to the gate line Ci and the gate terminal of the n-type TFT 77, and the drain terminal is connected to the source terminal of the n-type TFT 77 and an output terminal of the memory circuit 60*d*. The n-type TFT 78 is arranged such that the source terminal is connected to the drain terminal of the n-type TFT 77 and an input terminal of the memory circuit 60*d*, the gate terminal is connected to a control line CiRW, and the drain terminal is connected to the source terminals of the n-type TFTs 71 and 73, the p-type TFT 76, the n-type TFT 78, and the p-type TFT 54.

The drain terminals of the n-type TFTs 71 and 73 and the p-type TFT 76 are connected to the source terminals of the n-type TFT 72, the p-type TFT 75, and the n-type TFT 74 respectively. The drain terminals of the n-type TFT 72, the p-type TFT 75, and the n-type TFT 74 are connected to the memory circuits 60*a* through 60*c* respectively. The gate terminals of the n-type TFTs 71 and 73 and the p-type TFT 76 are connected to a control line Cibit 2, and the gate terminals of the n-type TFT 72, the p-type TFT 75, and the n-type TFT 74 are connected to a control line Cibit 1.

As illustrated in FIG. 11(*b*), memory circuits 60*a*, 60*b*, 60*c*, and 60*d* share the same circuit arrangement so as to include two p-type TFTs 61 and 62 and two n-type TFTs 63 and 64.

More specifically, the p-type TFT 61 is arranged such that the source terminal is connected to a source terminal of the p-type TFT 62, the drain terminal is connected to a source terminal of the n-type TFT 63 and gate terminals of the p-type TFT 62 and the n-type TFT 64, and the gate terminal is connected to a gate terminal of the n-type TFT 63. The p-type TFT 62 is arranged such that the source terminal is connected to the source terminal of the p-type TFT 61, the drain terminal is connected to a source terminal of the n-type TFT 64, and the gate terminal is connected to the drain terminal of the p-type TFT 61, the source terminal of the n-type TFT 63, and a gate terminal of the n-type TFT 64.

The n-type TFT 63 is arranged such that the source terminal is connected to the drain terminal of the p-type TFT 61, the gate terminal of the p-type TFT 62, and the gate terminal of the n-type TFT 64, and the gate terminal is connected to the gate terminal of the p-type TFT 62. The n-type TFT 64 is arranged such that the source terminal is connected to the drain terminal of the p-type TFT 61, and the gate terminal is connected to the drain terminal of the p-type TFT 61, the gate terminal of the p-type TFT 62, and the source terminal of the n-type TFT 63. The drain terminals of the n-type TFTs 63 and 64 are grounded.

In the memory cell Mij arranged as above, when the n-type TFT 70 is in the state of conduction so that the column select driver produces an output, image data of the data line Dj is stored in the memory circuits 60*a* through 60*c* selected by the control lines Cibit1 and Cibit2. That is to say, the image data supplied from the data line Dj is read from or kept in the memory circuits 60*a* through 60*c* and 60*d* in a manner illustrated in table. 4.

TABLE 4

| Control Circuit | | Memory Circuit | | | Control Line | Memory Circuit |
|---|---|---|---|---|---|---|
| Cibit2 | Cibit1 | 60a | 60b | 60c | CiRW | 60d |
| Low | Low | Kept | Kept | Kept | Low | Kept |
| High | Low | Kept | Kept | Written | Low | Kept |
| Low | High | Kept | Written | Kept | Low | Kept |
| High | High | Written | Kept | Kept | Low | Kept |

In contrast, when the n-type TFT 70 is in the state of conduction and no output is supplied from the column select driver, data is supplied from the memory circuits 60*a* through 60*c* selected by the control lines Cibit1 and 2 to the data line Dj. That is to say, the image data supplied from the data line Dj is written or kept by the memory circuits 60*a* through 60*c* and 60*d* in a manner illustrated in table. 5.

TABLE 5

| Control Circuit | | Memory Circuit | | | Control Line | Memory Circuit |
|---|---|---|---|---|---|---|
| Cibit2 | Cibit1 | 60a | 60b | 60c | CiRW | 60d |
| Low | Low | Kept | Kept | Kept | Low | Kept |
| High | Low | Kept | Kept | Output | Low | Kept |
| Low | High | Kept | Output | Kept | Low | Kept |
| High | High | Output | Kept | Kept | Low | Kept |

As described above, the image data is read/written using the memory cell Mij so that the timing adjustment as indicated in FIG. 10 can be carried out. Consequently, it is unnecessary to provide an additional IC circuit for the timing adjustment outside the electrode substrate, so that the arrangement of the display apparatus can be further simplified.

In the present embodiment, although not illustrated, the arrangement described in embodiment 3 (see FIG. 6) may be arranged such that a drain terminal of an additional TFT is provided on the side where the drain terminal of the switching TFT 51 is provided, and a source terminal of this additional TFT is connected to the reference voltage line GND and a gate terminal of the additional TFT is connected to an additional control line Ej.

According to this arrangement, the above-identified TFT is brought into conduction by the use of the additional control line Ej so that the capacitor has the ground voltage Vgnd. Thus, after the output voltage of each bit is applied to the capacitor via the gate line Gi, the above-mentioned reset procedure is carried out after the lapse of time in proportion to the weight of the bit, so that the number of the pixels Aij corresponding to one data line Sj can be further increased, compared to the driving method illustrated in embodiment 3.

Incidentally, in the above-mentioned arrangement using the TFT for resetting, the application of voltage is discontinued at the moment of resetting. However, the driving method of the present embodiment is arranged such that the voltage is continuously applied so that the above-mentioned arrangement is preferable since an instantaneous voltage can be reduced.

As described above, display data, which cannot be stored in the storage section 30*a* which is the first storage means, is preferably stored in the outer-pixel image memory section (memory cell Mij, see FIG. 5) which is the second storage means, provided outside the display section (pixel area).

On this account, image data necessary for the displaying can be captured by the display section and this makes it possible to display images by the display section without receiving new image data from outside. Thus it is possible to reduce the power consumptions of the drive circuits, etc. provided outside the electrode substrate (display substrate).

Moreover, in the above-mentioned time ratio grayscale method, it is necessary to adjust image data of a plurality of bits, which is supplied to each of the pixels Aij, to make it possible to display the image data in accordance with each of the bits. In contrast, the present embodiment is arranged so that the timing adjustment can be done by the use of the display section and the second storage means provided outside the display section, and hence it is unnecessary to provide an additional IC circuit for the timing adjustment outside the display section. As a result it is possible to simplify and downsize the arrangement of the display apparatus.

Embodiment 5

Figure 12:
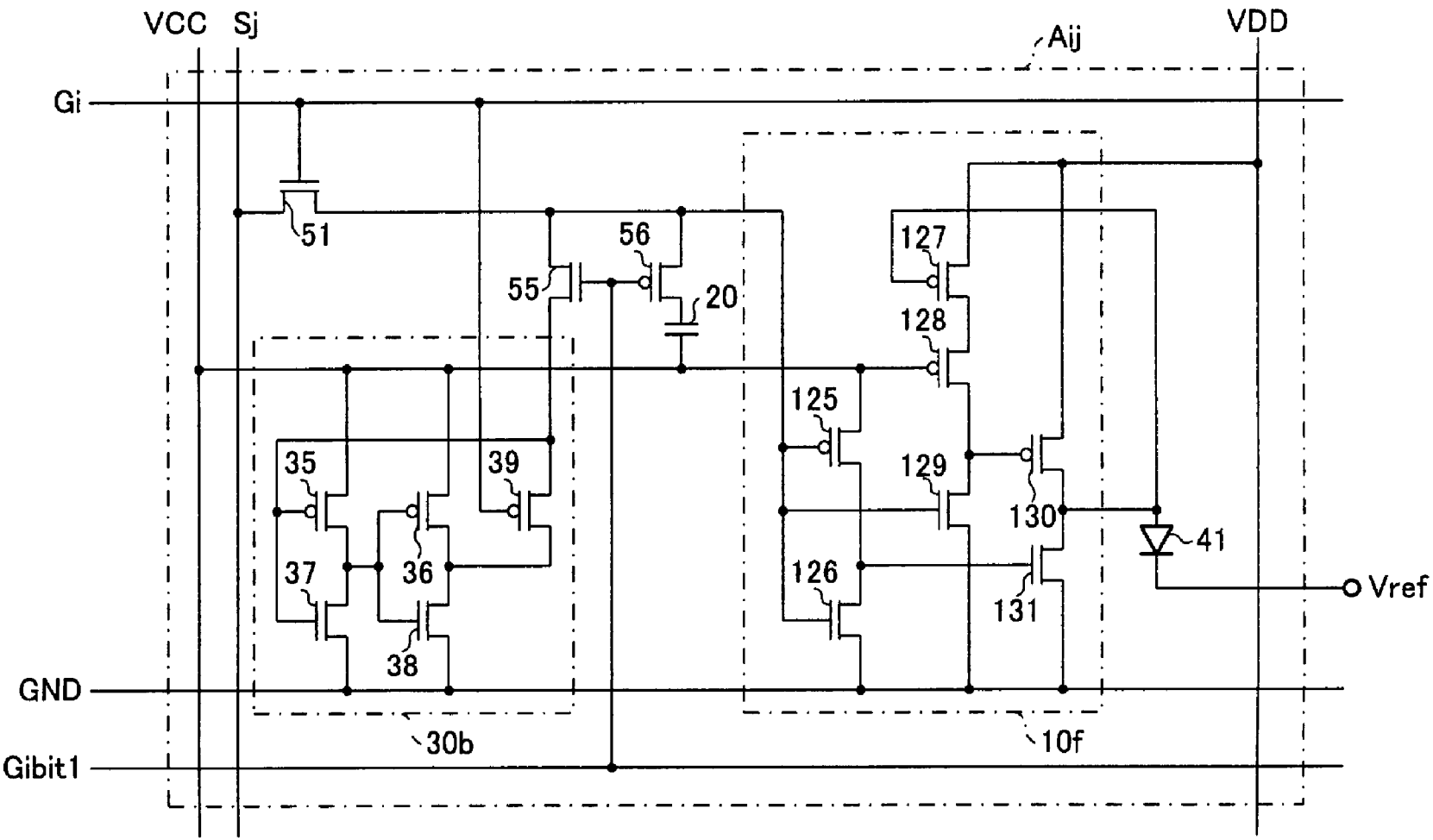
FIG. 12 is a circuit diagram illustrating an example of an arrangement of a pixel included in a display apparatus of a fifth embodiment in accordance with the present invention.

The following description will discuss a fifth embodiment in accordance with the present invention with reference to FIG. 12. By the way, it is noted that the present invention is not particularly limited to this embodiment, and members having the same functions as those described in embodiments 1 through 4 are given the same numbers, so that the descriptions are omitted for the sake of convenience.

A display apparatus of the present embodiment is arranged such that additional storage means is provided in each of the pixels of the display apparatus described in embodiments 1 through 3.

More specifically, as illustrated in FIG. 12, the display apparatus in accordance with the present invention is arranged such that, in each of the pixels Aij, a storage section 30*b* which is a static memory circuit is provided between the switching TFT 51 which is the first switching device and the voltage variation section 10*f*.

According to this arrangement, the switching TFT 51 is arranged such that the source terminal is connected to the data line Sj, the drain terminal is connected to the voltage variation section 10*f*, a source terminal of a control TFT 55, and a source terminal of a control TFT 56, and the gate terminal is connected to the gate line Gi. The control TFT 55 is arranged such that the drain terminal is connected to the storage section 30*b*, and the gate terminal is connected to the control line Gibit1. Similarly, the control TFT 56 is arranged such that the drain terminal is connected to the capacitor (voltage keeping section) 20 and the gate terminal is connected to the control line Gibit1. Moreover, the output terminal of the voltage variation section 10*f* is connected to the anode of the organic EL device 41, while the cathode of the organic EL device 41 is connected to the reference voltage line GND.

The control TFT 55 is an n-type TFT while the control TFT 56 is a p-type TFT. That is, when the voltage of the control line Gibit 1 is high, the control TFT 55 is brought into conduction, and when the control line Gibit1 has a negative voltage, the control TFT 56 is brought into conduction. Incidentally, as long as the electrical charge charged in the capacitor 20 is arranged so as not to influence on the voltage of an input terminal of the storage section 30*b*, the control TFT 56 is not necessarily provided.

The storage section 30*b* has a circuit arrangement such that three p-type TFTs 35, 36, and 39 and two n-type TFTs 37 and 38 are included. However, a detailed description of this section 30*b* is omitted because the same is arranged identically with the storage section 30*a* (see FIG. 3) in embodiment 2, except the following points that: a power supply voltage supplied to the section 30*b* is different from the same supplied to the section 30*a*; a p-type TFT 39 is provided between (i) the inverter InA consisting of the p-type TFT 35 and the n-type TFT 37 and (ii) the inverter InB consisting of the p-type TFT 36 and the n-type TFT 37; and the p-type TFT 35 is arranged such that the source terminal is connected to the output terminal of the inverter InB, the drain terminal is connected to the input terminal of the inverter InA, and the gate terminal is connected to the control line Gi. Also, the driving method of the section 30*b* is identical with the method described in embodiment 4 so as to be omitted.

As described above, in the present embodiment, it is possible to set the power supply voltage of the storage section 30*b* as the low voltage Vcc which is lower than the high voltage Vdd, so that the effect of the present invention to reduce the power consumption can be further accentuated.

Embodiment 6

Figure 13:
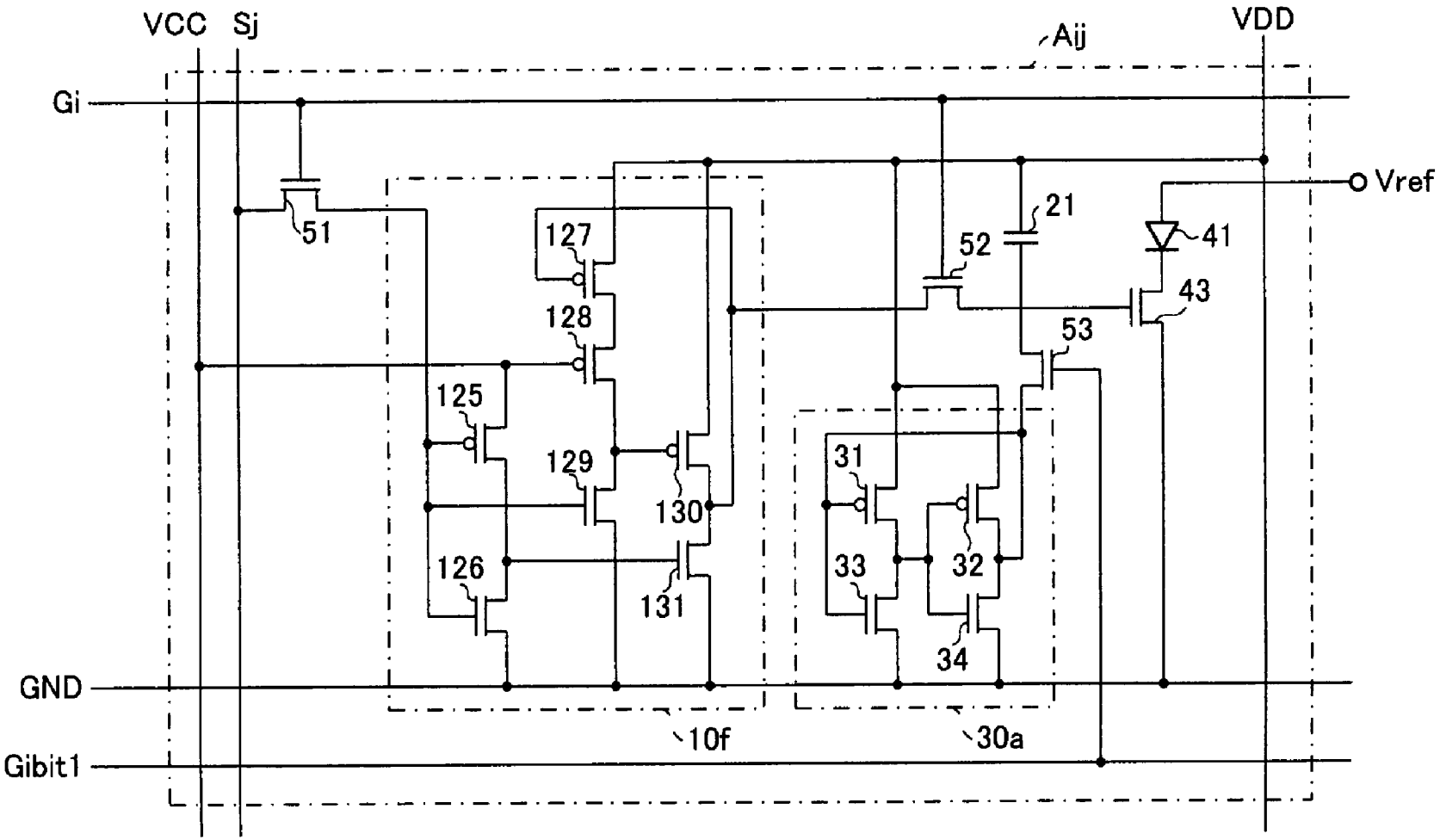
FIG. 13 is a circuit diagram illustrating an example of an arrangement of a pixel included in a display apparatus of a sixth embodiment in accordance with the present invention.

The following description will discuss a sixth embodiment in accordance with the present invention with reference to FIG. 13. By the way, it is noted that the present invention is not particularly limited to this embodiment, and members having the same functions as those described in embodiments 1 through 5 are given the same numbers, so that the descriptions are omitted for the sake of convenience.

A display apparatus of the present embodiment is arranged identically with the display apparatus of embodiment 2 except that the organic EL device 41 is adopted as the display device.

More specifically, as illustrated in FIG. 13, the display apparatus in accordance with the present embodiment is arranged such that, in each of the pixel Aij, the voltage variation section 10*f*, the storage section 30*a*, the switching TFT 51 which is the first switching device, the switching TFT 52 which is the second switching device, and the control TFT 53 are provided, and moreover, the organic EL device 41 and a display TFT 43 which are the display devices and a capacitor 21 are further provided.

As the arrangement illustrated in FIG. 13 clearly shows, the arrangement of the above-identified pixel Aij is identical with the arrangement of the pixel Aij in embodiment 4 except that the organic EL device 41, the display TFT 43 for driving the device 41, and the capacitor 21 are provided instead of the liquid crystal device 42, so that detailed descriptions of the present arrangement are omitted.

The display TFT 43 (n-type TFT) is arranged such that the gate terminal is connected to the source terminal of the control TFT 53, the drain terminal of the switching TFT 52, and the capacitor 21, the source terminal is connected to the cathode of the organic EL device 41, and the drain terminal is connected to the reference voltage line GND. Incidentally, the capacitor 21 is provided for keeping the gate voltage of the display TFT 43, and hence the stray capacitance of the gate terminal of the display TFT 43 can be utilized instead of the capacitor 21.

In the present embodiment, the power supply line VREF for driving the organic EL device 41 is provided independently of the high voltage power supply line VDD in the voltage variation section 10*f* so that the voltage of the power supply line VREF can be arbitrarily set. Moreover, since the power supply line VREF is independently provided, the voltage thereof can vary in the AC manner so that the degradation of characteristics of the organic EL device 41 can be moderated.

Embodiment 7

Figure 14:
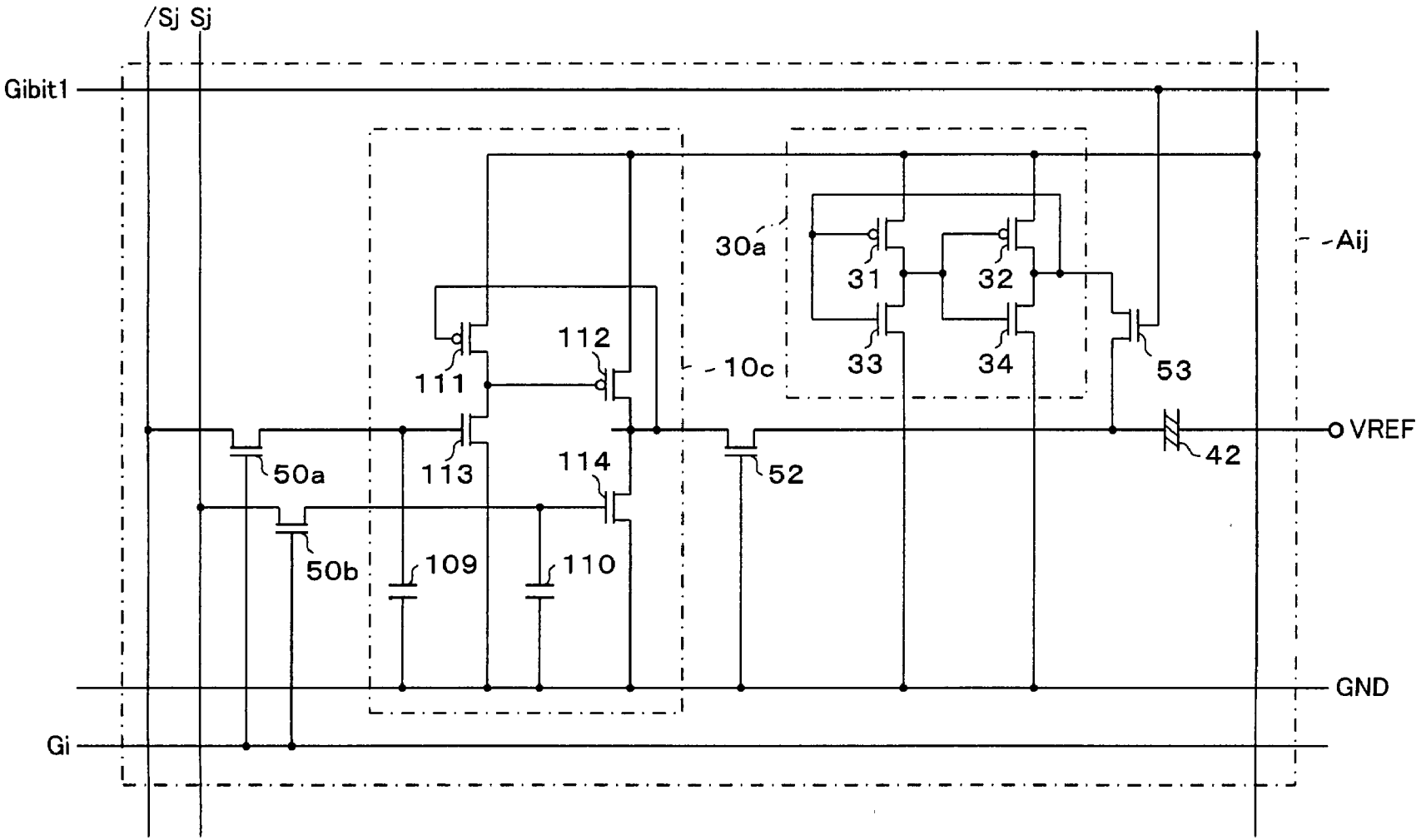
FIG. 14 is a circuit diagram illustrating an example of an arrangement of a pixel included in a display apparatus of a seventh embodiment in accordance with the present invention.

The following description will discuss a seventh embodiment in accordance with the present invention with reference to FIG. 14. By the way, it is noted that the present invention is not particularly limited to this embodiment, and members having the same functions as those described in embodiments 1 through 6 are given the same numbers, so that the descriptions are omitted for the sake of convenience.

Specific examples of the voltage variation means in the present invention are not limited to the voltage variation sections 10*a*, 10*b*, and 10*f* so that an alternative arrangement can be adopted.

More specifically, as illustrated in FIG. 14, the present embodiment adopts a voltage variation section 10*c* in the pixel Aij, and this section 10*c* is different from all of the voltage variation sections 10*a*, 10*b*, and 10*f*. Moreover, the present embodiment is provided with: the liquid crystal device 42 as the display device; the storage section 30*a*; the TFT 52 which is the second switching device; the control TFT 53; switching TFTs 50*a* and 50*b* (both n-type) which are the first switching devices; and capacitors 109 and 110 as the voltage keeping sections. In short, two first switching devices are adopted in the present embodiment.

The voltage variation section 10*c* has a circuit arrangement so as to include two capacitors 109 and 110, two p-type TFTs 111 and 112, and two n-type TFTs 113 and 114.

More specifically, the p-type TFT 111 is arranged such that the source terminal is connected to the high voltage power supply line VDD, the drain terminal is connected to a source terminal of the n-type TFT 113 and a gate terminal of the p-type TFT 112, and the gate terminal is connected to a drain terminal of the p-type TFT 112. The p-type TFT 112 is arranged such that the source terminal is connected to the high voltage power supply line VDD, the drain terminal is connected to a source terminal of the n-type TFT 114 and the gate terminal of the p-type TFT 111, and the gate terminal is connected to the drain terminal of the p-type TFT 111 and the source terminal of the n-type TFT 113.

The n-type TFT 113 is arranged such that the source terminal is connected to the drain terminal of the p-type TFT 111, the drain terminal is connected to the reference voltage line GND, and the gate terminal is connected to the capacitor 109 and a drain terminal of the switching TFT 50*a*. The n-type TFT 114 is arranged such that the source terminal is connected to the drain terminal of the p-type TFT 112 and the gate terminal of the p-type TFT 111, the drain terminal is connected to the reference voltage line GND, and the gate terminal is connected to the capacitor 110 and a drain terminal of the switching TFT 50*b*.

The capacitor 109 is provided so as to connect the drain terminal of the switching TFT 50*a* and the gate terminal of the n-type TFT 113 with the reference voltage line GND, and the capacitor 110 is provided so as to connect the drain terminal of the switching TFT 50*b* and the gate terminal of the n-type TFT 114 with the reference voltage line GND, so that voltages of the gate terminals of the n-type TFTs 113 and 114 are kept when the switching TFTs 50*a* and 50*b* are out of conduction.

In the voltage variation section 10*c* arranged as above, conducting resistances of the n-type TFTs 113 and 114 are arranged to be lower than the conducting resistances of the p-type TFTs 111 and 112.

In the present embodiment, a negative data line /Sj is provided in addition to the data line Sj, as illustrated in FIG. 14. The voltage of this negative data line /Sj is opposite to the voltage of the data line Sj. That is to say, when the data line Sj has the ground voltage Vgnd, the negative data line /Sj has the voltage Vcc, and when the data line Sj has the voltage Vcc, the negative data line /Sj has the voltage Vgnd.

The switching TFT 39 is arranged such that the source terminal is connected to the data line Sj, and the gate terminal is connected to the gate line Gi. The switching TFT 50*a* is arranged such that the source terminal is connected to the negative data line /Sj, and the gate terminal is connected to the gate line Gi.

In the voltage variation section 10*c* arranged as above, the input voltage and output voltage to/from the voltage variation section 10*c* establish relations as illustrated in table. 6. Table. 6 also shows the voltage of the drain terminal of the p-type TFT 111 constituting the voltage variation section 10*c*.

TABLE 6

| | Input Terminal Data Line Sj | Drain Terminal of p-Type TFT 111 | Output Terminal Drain Terminal of p-Type TFT 112 |
|---|---|---|---|
| (I) | Vcc | Vdd | Vgnd |
| (II) | Vgnd | Vgnd | Vdd |

The relationship between (I) and (II) in table. 6 will be described in detail.

When the gate line Gi has the select voltage Vs and the switching TFTs 50*a* and 50*b* are in the state of conduction, in (I), provided that the data line Sj which is the input terminal has the low voltage Vcc, the low voltage Vcc is applied to the gate terminal of the n-type TFT 114 so that the n-type TFT 114 is brought into conduction. As a result the drain terminal of the p-type TFT 112 has the ground voltage Vgnd.

Since the output from the drain terminal of the p-type TFT 112 is supplied to the gate terminal of the p-type TFT 111, the p-type TFT 111 is brought into conduction. At this moment, the gate terminal of the n-type TFT 113 receives the ground voltage Vgnd which is the voltage of the negative data line /Sj so that the n-type TFT 113 is brought out of conduction, and consequently, the drain terminal of the p-type TFT 111 has the high voltage Vdd. Moreover, the output from the drain terminal of the p-type TFT 111 is supplied to the gate terminal of the p-type TFT 112 so that the p-type TFT 112 is brought out of conduction. Thus the drain terminal of the p-type TFT 112, which is the output terminal, has the ground voltage Vgnd.

Next, in (II), provided that the data line Sj which is the input terminal has the ground voltage Vgnd, the negative data line /Sj has the low voltage Vcc so that the gate terminal of the n-type TFT 113 receives the low voltage Vcc so as to be brought into conduction. As a result, the drain terminal of the p-type TFT 113 has the ground voltage Vgnd.

Since the output from the drain terminal of the p-type TFT 111 is supplied to the gate terminal of the p-type TFT 112, the p-type TFT 112 is brought into conduction. At this moment, the gate terminal of the n-type TFT 114 receives the ground voltage Vgnd which is the voltage of the data line Sj so that the n-type TFT 114 is brought out of conduction. Consequently, the drain terminal of the p-type TFT 112 has the high voltage Vdd. Moreover, the output from the drain terminal of the p-type TFT 112 is supplied to the gate terminal of the p-type TFT 111 so that the p-type TFT 111 is brought out of conduction. Thus the drain terminal of the p-type TFT 112, which is the output terminal, has the low voltage Vcc.

According to the simulation (not illustrated) of the operation of the voltage variation section 10*c* arranged as above, the section 10*c* properly operated in conditions such that the power supply voltage is fixed at the low voltage Vcc (=5V) and the output voltage is varied up to 18V. Thus the simulation proved that the voltage variation section 10*c* can properly operate with the output voltage equal to the high voltage Vcc>5V.

In this manner, the voltage variation section 10*c* in accordance with the present embodiment is arranged so that the higher the ratio of the high voltage Vdd supplied as the power supply voltage to the low voltage Vcc (Vdd/Vcc) is, the fewer amount of electricity the display apparatus of the present invention consumes.

Embodiment 8

Figure 15:
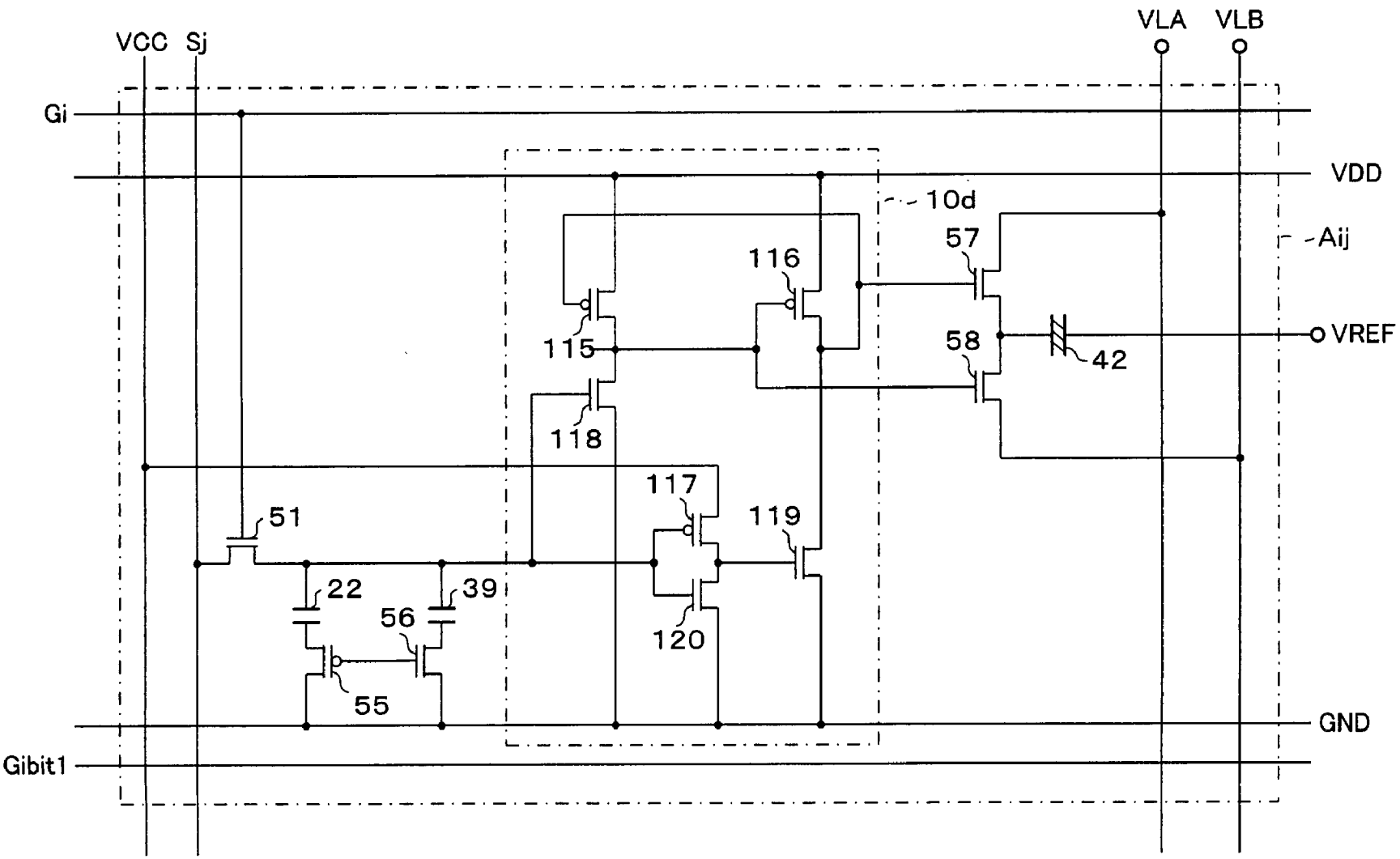
FIG. 15 is a circuit diagram illustrating an example of an arrangement of a pixel included in a display apparatus of an eighth embodiment in accordance with the present invention.

The following description will discuss an eighth embodiment of the present invention with reference to FIG. 15. By the way, it is noted that the present invention is not particularly limited to this embodiment, and members having the same functions as those described in embodiments 1 through 7 are given the same numbers, so that the descriptions are omitted for the sake of convenience.

A display apparatus of the present embodiment is arranged such that a capacitor is adopted as the storage means and an alternatively arranged voltage variation section 10*c* illustrated in embodiment 7 is adopted as the voltage variation means.

More specifically, as illustrated in FIG. 15, the display apparatus in accordance with the present embodiment is arranged so that each of the pixel Aij includes: the liquid crystal device 42 as the display device; the switching TFT 51 which is the first switching device; the capacitor 22 which is the voltage keeping section; a capacitor 39 which is the storage section; the control TFTs 55, 56, 57, and 58; and a voltage variation section 10*d*. Moreover, as power supply lines for driving the liquid crystal 42, two liquid crystal driving power supply lines VLA and VLB are provided. Incidentally, the control TFT 55 is an n-type TFT and the control TFTs 56, 57, and 58 are p-type TFTs.

The switching TFT 51 is arranged such that the source terminal is connected to the data line Sj, the drain terminal is connected to the voltage variation section 10*d* and the capacitors 22 and 39, and the gate terminal is connected to the gate line Gi. The control TFT 55 (p-type TFT) is arranged such that the source terminal is connected to the capacitor 22, and the drain terminal is connected to the reference voltage line GND. The control TFT 56 (n-type TFT) is arranged such that the source terminal is connected to the capacitor 39, and the drain terminal is connected to the reference voltage line GND. The gate terminals of the control TFTs 55 and 56 are mutually connected and also connected to the control line Gibit1.

Thus, when the control line Gibit1 has a high voltage, the control TFT 56 is brought into conduction so that image data stored in the capacitor 39 which is the storage section is supplied to the voltage variation section 10*d*. When the control line Gibit1 has a negative voltage, the control TFT 55 is brought into conduction so that image data stored in the capacitor 22 which is the voltage keeping section is supplied to the voltage variation section 10*d*.

Now, a specific arrangement of the voltage variation section 10*d* will be described below. First of all, the voltage variation section 10*d* has a circuit arrangement so as to include three p-type TFTs 115, 116, and 117, and three n-type TFTs 118, 119, and 120.

The p-type TFT 115 is arranged such that the source terminal is connected to the high voltage power supply line VDD, the drain terminal is connected to a source terminal of the n-type TFT 118 and gate terminals of the p-type TFT 116 and the n-type TFT 119, and the gate terminal is connected to a gate terminal of the control TFT 57 and the drain terminal of the p-type TFT 116.

The p-type TFT 116 is arranged such that the source terminal is connected to the high voltage power supply line VDD, the drain terminal is connected to the gate terminal of the p-type TFT 115, a source terminal of the n-type TFT 119, and the gate terminal of the control TFT 57, and the gate terminal is connected to the drain terminal of the p-type TFT 115, the source terminal of the n-type TFT 118, and a gate terminal of the control TFT 58.

The p-type TFT 117 is arranged such that the source terminal is connected to the low voltage power supply line VCC, the drain terminal is connected to a gate terminal of the n-type TFT 119 and a source terminal of the n-type TFT 120, and the gate terminal is connected to a gate terminal of the n-type TFT 120, a gate terminal of the n-type TFT 118, and a drain terminal of the switching TFT 51.

The n-type TFT 118 is arranged such that the source terminal is connected to the drain terminal of the p-type TFT 115, the gate terminal of the p-type TFT 116, and the gate terminal of the n-type TFT 58, the drain terminal is connected to the reference voltage line GND, and the gate terminal is connected to the gate terminals of the p-type TFT 117 and the n-type TFT 120 and the drain terminal of the switching TFT 51.

The n-type TFT 119 is arranged such that the source terminal is connected to the drain terminal of the p-type TFT 116, the drain terminal is connected to the reference voltage line GND, and the gate terminal is connected to the drain terminal of the p-type TFT 117 and the source terminal of the n-type TFT 120.

The n-type TFT 120 is arranged such that the source terminal is connected to the drain terminal of the p-type TFT 117 and the gate terminal of the n-type TFT 119, the drain terminal is connected to the reference voltage line GND, and the gate terminal is connected to the gate terminals of the p-type TFT 117 and the n-type TFT 118 and the drain terminal of the switching TFT 51. Incidentally, the p-type TFT 117 and the n-type TFT 120 constitute an inverter circuit.

Thus, when the n-type TFT 118 has the low voltage Vcc, the gate terminal of the n-type TFT 119 receives the ground voltage Vgnd. In contrast, when the n-type TFT 118 has the ground voltage Vgnd, the gate terminal of the n-type TFT 119 receives the low voltage Vcc. As a result, the operation of the voltage variation section 10*d* is identical with that of the voltage variation section 10*c* in embodiment 7.

In the voltage variation section 10*d* arranged as above, the input voltage and output voltage to/from the voltage variation section 10*d* establish relations as illustrated in table. 7. Table. 7 also shows the voltage of the drain terminal of the p-type TFT 116 constituting the voltage variation section 10*d*.

TABLE 7

| | Input Terminal Data Line Sj | Output Terminal Drain Terminal of p-Type TFT 116 | Output Terminal Drain Terminal of p-Type TFT 115 |
|---|---|---|---|
| (I) | Vcc | Vdd | Vgnd |
| (II) | Vgnd | Vgnd | Vdd |

The control TFT 57 is arranged such that the source terminal is connected to the liquid crystal driving power supply line VLA, the drain terminal is connected to the first terminal of the liquid crystal device 42 and the source terminal of the TFT 58, and the gate terminal is connected to the voltage variation section 10*d* (the drain terminal of the p-type TFT 116 and the gate terminal of the p-type TFT 115). Similarly, the control TFT 58 is arranged such that the source terminal is connected to the first terminal of the liquid crystal device 42 and the drain terminal of the control TFT 57, the drain terminal is connected to the liquid crystal driving power supply line VLB, and the gate terminal is connected to the voltage variation section 10*d* (the gate terminal of the p-type TFT 116, the drain terminal of the p-type TFT 115, and the source terminal of the n-type TFT 118).

The second terminal (counter electrode) of the liquid crystal device 42 is connected to the power supply line VREF and has the counter voltage Vref. Also, the voltages of the liquid crystal driving power supply lines VLA and VLB are Va and Vb respectively.

Thus, when the output voltage of the p-type TFT 115 is the high voltage Vdd, the output voltage of the p-type TFT 116 is the ground voltage Vgnd and hence the control TFT 58 is brought into conduction, so that the liquid crystal device 42 receives a display voltage Vb−Vref. When the output voltage of the p-type TFT 115 is the ground voltage Vgnd, the output voltage of the p-type TFT 116 is the low voltage Vcc so that the control TFT 57 is brought into conduction, and consequently the liquid crystal device 42 receives a display voltage Va−Vref.

Thus, if the input voltage to the voltage variation section 10*d* is switched in a time division manner, it is possible to apply a multi-grayscale display voltage to the liquid crystal device 42. Incidentally, the voltages Va and Vb establish relations as Vdd>Va, Vb>Vgnd.

As described above, the detailed arrangement of the voltage variation means in accordance with the present invention is not particularly limited. Moreover, the layout of the voltage variation means, the storage means, and the display device is not particularly limited as well. That is to say, as described in embodiment 2, the storage means may be provided between the voltage variation means and the display device (see FIG. 3), the voltage variation section may be provided between the storage means and the display device (see FIG. 9), or as in the present embodiment, the storage means may be provided between the voltage variation means and the first switching device (see FIG. 15).

Especially, as in the present embodiment, if the storage means (capacitor 39) is provided between the voltage variation means (voltage variation section 51) and the first switching device (switching TFT 51), it is possible to drive the circuits including the storage means with a low voltage so that the power consumption of the storage means can be reduced.

Embodiment 9

Figure 16:
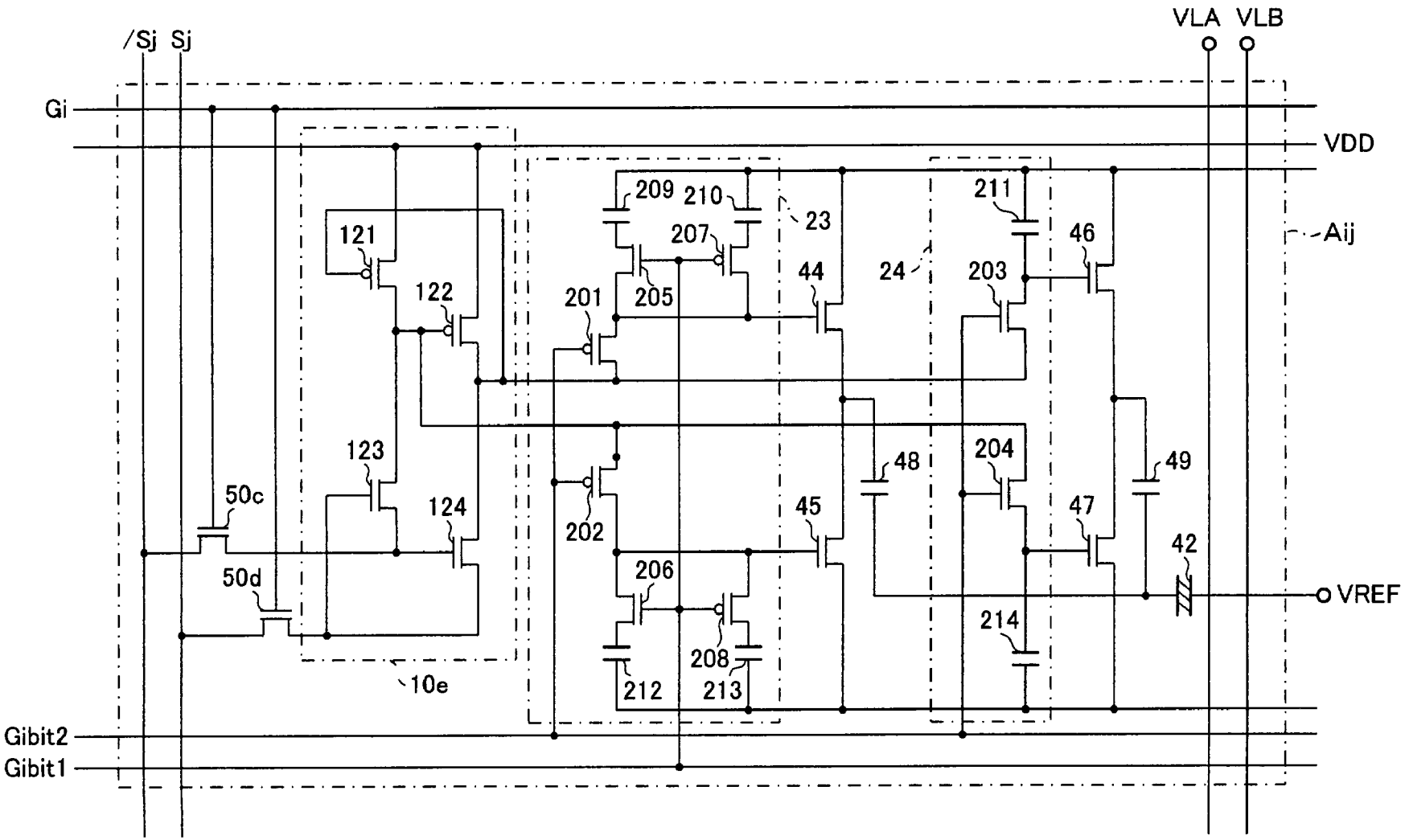
FIG. 16 is a circuit diagram illustrating an example of an arrangement of a pixel included in a display apparatus of a ninth embodiment in accordance with the present invention.

The following description will discuss a ninth embodiment in accordance with the present invention with reference to FIG. 16. By the way, it is noted that the present invention is not particularly limited to this embodiment, and members having the same functions as those described in embodiments 1 through 8 are given the same numbers, so that the descriptions are omitted for the sake of convenience.

A display apparatus of the present embodiment is arranged such that a plurality of capacitors are adopted as the storage means, a voltage variation section with a further arrangement is adopted as the voltage variation means, and a liquid crystal device which is the display device receives a display voltage via the capacitors.

More specifically, as illustrated in FIG. 16, the display apparatus in accordance with the present embodiment includes the pixels Aij each provided with: the liquid crystal device 42 as the display device; switching TFTs 50*c* and 50*d* (both n-type TFTs) which are the first switching devices; a voltage variation section 10*e*; memory drive circuits 23 and 24 each including a plurality of capacitors; control TFTs 44, 45, 46, and 47 (all n-type TFTs); and capacitors 48 and 49.

As described above, in the present embodiment, the voltage applied to the capacitor 48 is switched in accordance with the lapse of time so as to be superposed on the voltage applied to the capacitor 49, and hence the display voltage applied to the liquid crystal device 42 can be controlled, and consequently it is possible to apply a multi-grayscale display voltage to the liquid crystal device 42.

Embodiment 10

The following description will discuss a tenth embodiment in accordance with the present invention with reference to FIGS. 5, 11, 17, and 18. By the way, it is noted that the present invention is not particularly limited to this embodiment, and members having the same functions as those described in embodiments 1 through 9 are given the same numbers, so that the descriptions are omitted for the sake of convenience.

The embodiments above realize the time ratio grayscale display using the storage means provided in each of the pixels. However, the present invention is not limited to this arrangement so that the storage means can be used for the switching displaying of a plurality of images as well. Incidentally, a display apparatus of the present embodiment is arranged identically with the display apparatus described in embodiment 3 (see FIG. 5).

Figure 17:
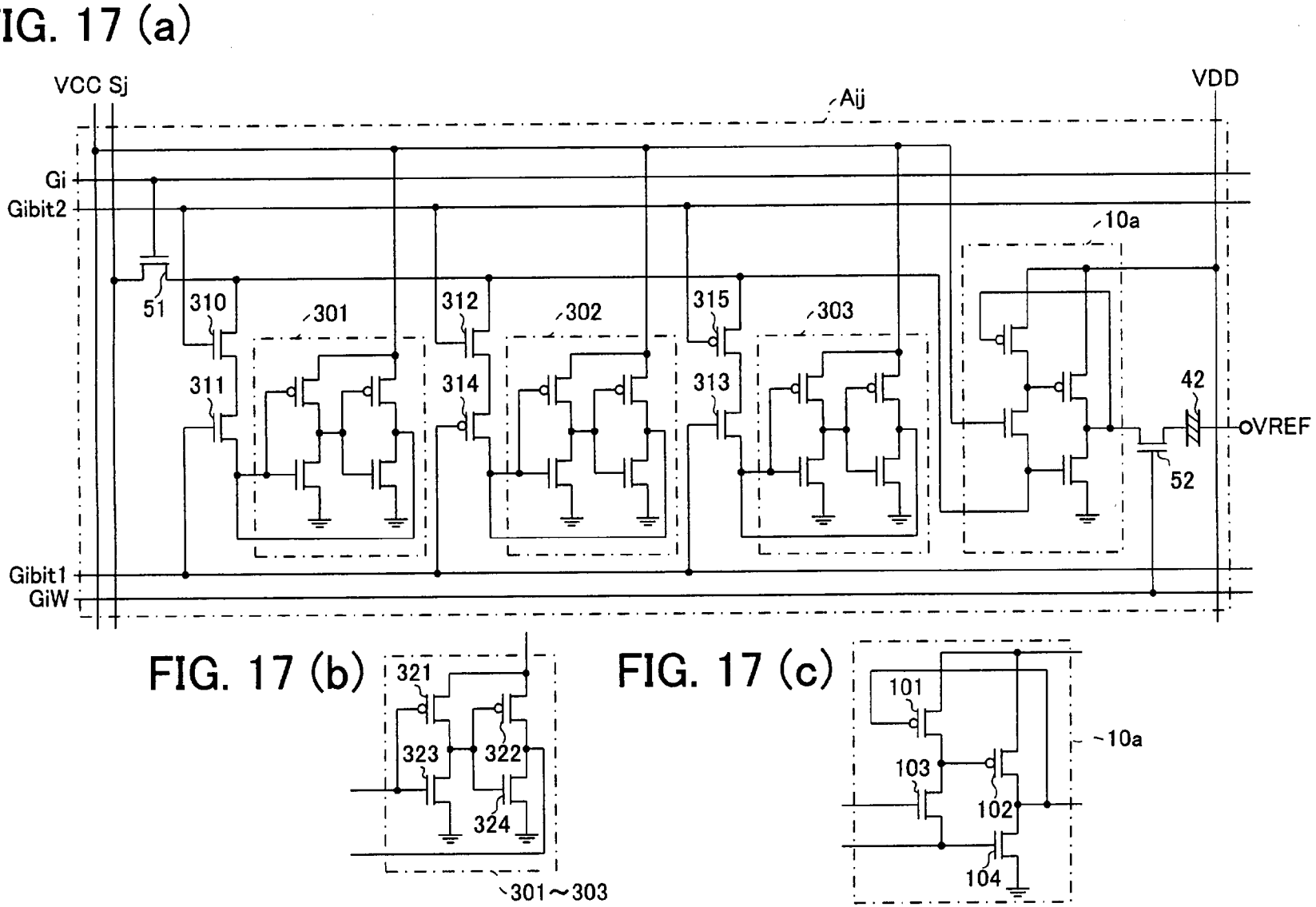
FIG. 17(*a*) is a circuit diagram illustrating an example of an arrangement of a pixel included in a display apparatus of a tenth embodiment in accordance with the present invention.

For instance, as illustrated in FIG. 17(*a*), the display apparatus in accordance with the present invention includes the pixels Aij each provided with: the liquid crystal device 42 as the display device; the switching TFT 51 which is the first switching device; the voltage variation section 10*a*; the second switching device 52; three memory circuits (storage sections) 301, 302, and 303; and n-type TFTs 310, 311, 312, and 313 and p-type TFTs 314 and 315, all TFTs accompanied with the memory circuits 301 through 303.

The arrangements of the memory circuits 301 through 303 and the p-type TFTs 321 and 322 which are illustrated in FIG. 17(*b*) and constitute the memory circuits 301 through 303, the n-type TFTs 323 and 324, the n-type TFTs 310 through 313 accompanied with the memory circuits 301 through 303, and the p-type TFTs 314 and 315 are identical with the arrangements of the memory circuits 60*a*, etc. provided in each of the memory cells Mij (see FIG. 11 (b)) in embodiment 3, so that the descriptions of these members are omitted.

The voltage variation section 10*a* has, as illustrated in FIG. 17(*c*), a circuit arrangement so as to include two p-type TFTs 101 and 102 and two n-type TFTs 103 and 104.

Figure 18:
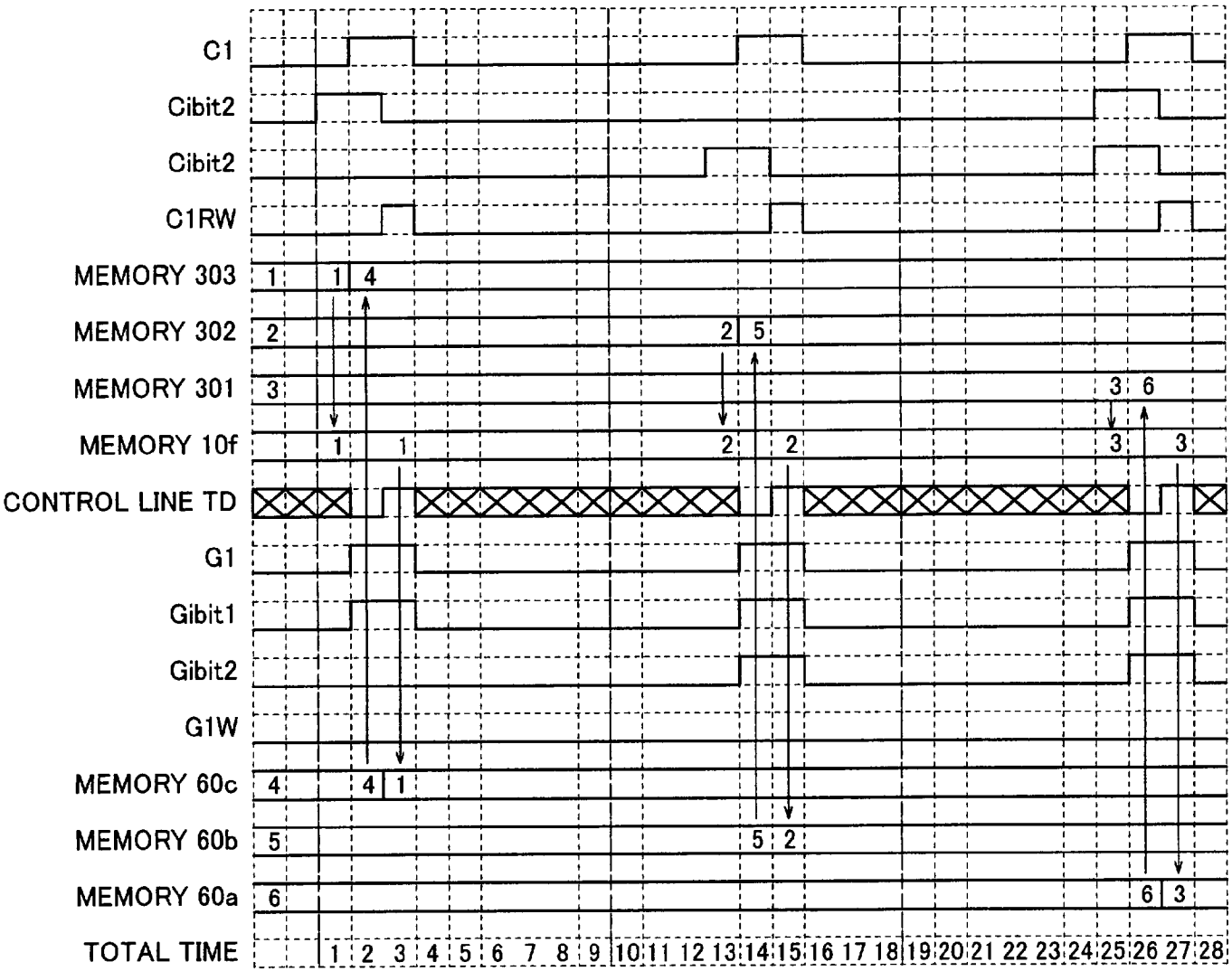
FIG. 18 is a time chart indicating an example of a time ratio grayscale method in the display apparatus in FIGS. 17(*a*) thorough 17(*c*).

The writing of the image data in accordance with the present embodiment is carried out in accordance with a time chart of FIG. 18. This time chart of FIG. 18 is identical with the time charts described in the embodiments above.

The present invention is not limited to the use of the time ratio grayscale driving method and hence can be suitably used for the switching displaying of a plurality of images as well. That is to say, the arrangement in which the storage section is provided and the bit data thereof is switching displayed as in the present embodiment is suitable for not only the multi-grayscale display but also the switching displaying of a plurality of images. Especially, when a plurality of images is switching displayed, provided that the storage section is storage means of m bits, it is possible to switch m images in the case of 2-level-grayscale display, without turning on the IC circuits outside the display area. Thus the power consumption can be further reduced.

When the switching displaying is carried out, as described in the present embodiment, it is preferable to provide memory circuits (memory cells Mij) in addition to the memory circuits corresponding to the pixels Aij, since the number of displayable pixels can be increased.

In particular, the arrangement in accordance with the present embodiment enables to switch a plurality of images without turning the external CPU, etc. on. As a result, adopting the display apparatus of the present invention to portable devices, etc. makes it possible to reduce the power consumption of the devices.

Next, the display apparatus in accordance with the present invention will be described further in detail, with reference to examples and conventional examples. Incidentally, the present embodiment is not limited to these examples.

EXAMPLE 1

Provided that the display apparatus including the pixels Aij illustrated in FIG. 1, which is described in embodiment 1, is arranged such that the high voltage Vdd is 12V and the load carrying capacity Cxy of the data line Sj is around 10 nF, a required power consumption W1 per one scanning was calculated, letting the low voltage Vcc is 5V and the load-carrying capacity Cpx of the drain terminal of the p-type TFT 16 is around 0.2 nF. The equation is as follows.

$$\begin{aligned} W1 &= Cxy \times Vcc^2 + Cpx \times Vdd^2 \\ &= 10[\mathrm{nF}] \times (5[V]^2) + 0.2[\mathrm{nF}] \times (12[V])^2 \\ &\fallingdotseq 0.28[\mu W] \end{aligned}$$

-continued

The power consumption is calculated on per-scanning basis for the reason that the electricity is consumed each time the voltage of the data line Sj is changed (to be either the low voltage Vcc or the grounding voltage Vgnd). Thus, if the scanning is carried out 3600 times in a second, the total power consumption in the case of the conventional example is 1.44 μW×3600 ≈5.2 mW, and the same in the case of the present embodiment is 0.28 μW×3600≈1 mW.

Conventional Example 1

The power consumption W1 per one scanning was calculated in the condition identical with example 1, except that the conventional arrangement is adopted. The equation is as follows.

$$\begin{aligned} W1 &= Cxy \times Vdd^2 \\ &= 10[\mathrm{nF}] \times (12[V])^2 \\ &= 1.44[\mu W] \end{aligned}$$

The comparison of example 1 to conventional example 1 clearly shows, adopting the arrangement of embodiment 1 of the present invention to the display apparatus makes it possible to considerably reduce the power consumption.

EXAMPLE 2

Provided that the display apparatus including the pixels Aij illustrated in FIG. 3, which is described in embodiment 2, is arranged such that the high voltage Vdd is 6V, the load carrying capacity Cxy of the data line Sj is around 10 nF, and the capacity of the liquid crystal device 20 is around 1 nF, a required power consumption W1 per one scanning was calculated, letting the low voltage Vcc is 5V and the load-carrying capacity Cpx of the drain terminal of the p-type TFT 16 constituting the voltage variation section 13 is around 0.2 nF. The equation is as follows.

$$\begin{aligned} W1 &= Cxy \times Vcc^2 + Cpx \times Vdd^2 \\ &= 10[\mathrm{nF}] \times (5[V])^2 + 1.2[\mathrm{nF}] \times (6[V])^2 \\ &\fallingdotseq 0.29[\mu W] \end{aligned}$$

Conventional Example 2

The power consumption W1 per one scanning was calculated in the condition identical with example 2, except that the conventional arrangement is adopted. The equation is as follows.

$$\begin{aligned} W1 &= Cxy \times Vdd^2 \\ &= 11[\mathrm{nF}] \times (6[V])^2 \fallingdotseq 0.40[\mu W] \end{aligned}$$

As example 2 and comparative example 2 clarify, adopting the arrangement of embodiment 2 of the present invention to the display apparatus also makes it possible to considerably reduce the power consumption.

Comparing example 1 with example 2, the power consumption is further reduced in example 1. However, the threshold voltage of a polysilicon TFT suitably used in the present invention is considered to be further reduced in the future, so that it is assumed that the low voltage Vcc will be reduced to 4V, 3V, or less. Thus the arrangement of example 2, i.e. the arrangement of embodiment 2 of the present invention is expected to become more effective.

EXAMPLE 3

In relation to the time ratio grayscale method (see FIG. 4) described in embodiment 2, a power consumption W2 per one frame time was calculated, provided that in one frame time, data transfer to the data lines Sj is carried out 5 times and data transfer to the liquid crystal is carried out 9 times. The equation is as follows.

$$\begin{aligned} W2 &= Cxy \times Vcc^2 \times 5 + Cpx \times Vdd \times 9 \\ &= 10[\mathrm{nF}] \times (5[V])^2 \times 5 + 1.2[\mathrm{nF}] \times (6[V])^2 \times 9 \\ &\fallingdotseq 1.64[\mu W] \end{aligned}$$

According to the equation above, when image data is transferred to the data lines Sj only once in one frame time using a conventional technique and in an analog manner, the power consumption in one frame time is equal to the power consumption W1=0.40[μW] acquired in conventional example 2. This indicates that the power consumption in accordance with the data transfer is greater in the case of the time ratio grayscale.

However, the increase of the power consumption due to the provision of the D/A conversion circuit is generally greater than the increase of the power consumption due to the adoption of the time ratio grayscale, and hence it is possible to downsize the source driver by removing the D/A conversion circuit of 5 bits and adopting the embodiment (embodiment 2) of the present invention.

As described above, the display apparatus in accordance with the present invention consumes fewer amount of electricity, so as to be suitably adopted in low-power-consumption devices like a display unit for portable devices such as a mobile phone and a PDA.

Incidentally, apart from the aforementioned examples, voltage variation circuits which can be adopted to the present invention are such as a charging pump circuit in which a plurality of capacitors connected in parallel are reconnected to be in series so that the voltage is increased, etc.

To solve the aforementioned problems, the display apparatus in accordance with the present invention may include: a plurality of display devices formed in a display area; and voltage variation means, provided for each of the display devices, for respectively changing a display voltage supplied to the display devices.

According to this arrangement, the pixels has the voltage variation means corresponding to respective the display devices so that the voltage from the source driver to the voltage variation means corresponding to the respective display devices can be restrained, and hence it is possible to restrain the output voltages from the D/A conversion circuit and the buffer circuit. As a result, it is possible to reduce the power consumption related to the load-carrying capacity of the lines.

Moreover, if the threshold voltage of the voltage variation means corresponding to the respective display devices is restrained to be smaller than the amplitude of the output voltages from the D/A conversion circuit and the buffer circuit, the time necessary for transferring data from the source driver to each of the display devices can be shortened, and this can be considered as an effective countermeasure against the line delay which is a problem in carrying out the time ratio grayscale display in a large display apparatus.

As a matter of course, in a display apparatus in which the time ratio grayscale is carried out yet the line delay is no serious problem, the reduction of the driver output voltage makes it possible to restrain the increase of the power consumption accompanied with the increase of the driver output frequency.

Furthermore, if the driver output voltage is reduced, it is possible to reduce the size of, for instance, a switching device such as the TFT in the driver circuit of the display apparatus. Thus it is possible to reduce the area occupied with the source driver and hence the whole display apparatus can be downsized.

In addition to the arrangement above, the display apparatus in accordance with the present invention may include voltage keeping means for keeping a voltage supplied to the voltage variation means.

According to this arrangement, the voltage variation means makes it possible to keep the output voltage, supplied to the display device such as an electro-optical device, constant. Therefore if the input voltage supplied to the voltage variation means is kept by the use of the voltage keeping means such as a capacitor, the operation of the display device such as the electro-optical device can be stabilized. That is to say, it is possible to keep the voltage, supplied from the voltage variation means to the display devices such as the electro-optical device, constant so that the display device can operate properly even if the voltage supplied to the voltage variation means is unstable to some degree.

In addition to the arrangements above, the display apparatus in accordance with the present invention preferably includes storage means, provided for the respective display devices, for storing image data.

According to this arrangement, providing the storage means makes it possible to reduce the number of times of capturing image data such as a static image from the outside of the pixels, and hence the reduction of the power consumption can be further accelerated. Also, if the arrangement of multi-grayscale display by the use of the time grayscale display is adopted, it is possible to read image data of required bits from the pixels in desirable timing. As a result, it is possible to further lower the power consumption, compared with the case that image data is captured from the outside of the pixels each time the data is required.

Moreover, if both of the voltage keeping means and the storage means are provided in the pixels (each of the display devices), the capacity of the memories provided outside of the pixels can be reduced so that the peripheral circuits outside of the display area can be downsized, and hence the display apparatus can be further downsized.

In addition to the arrangements above, the display apparatus in accordance with the present invention may include a plurality of first lines and a plurality of second lines which intersect with each other, wherein the display devices are provided at respective intersections of the first lines and the second lines; and switching devices corresponding to the respective display devices and having first and second terminals, wherein the first terminals of the switching devices are connected to the respective first lines, and the second terminals of the switching devices are connected to the respective display devices via the respective voltage variation means.

According to this arrangement, the pixels are provided in the display area in a matrix manner and also the load-carrying capacity of the first line is increased due to the provision of the switching device for the respective display devices, so that there is an inevitable necessity to achieve the first and third objectives. Thus the present invention is suitably adopted to a liquid crystal display apparatus and an organic EL display apparatus using the TFT substrate arranged as above.

In addition to the arrangements above, the display apparatus in accordance with the present invention may be arranged such that the second terminals of the switching devices are connected to either the respective storage means or the respective voltage keeping means, and either the storage means or the voltage keeping means are connected to the respective display devices via the respective voltage variation means.

According to this arrangement, it is possible to carry out the time ratio grayscale display using the storage means or the voltage keeping means so that the time ratio grayscale display can be realized with the operation requiring lower voltage and the power consumption of the display apparatus can be further reduced. Consequently, the display apparatus consumes fewer amount of electricity, and the size thereof can be further reduced due to the provision of memories in the pixels and the omission of the D/A conversion circuit.

In addition to the arrangements above, the display apparatus in accordance with the present invention may include second switching devices each provided between (i) any one of the storage means, the voltage keeping means, and the voltage variation means and (ii) each of the display devices.

According to this arrangement, due to the provision of the second switching devices, especially when the display devices are liquid crystal devices, it is possible to switch the voltage polarity of the counter electrode which is generally used in each of the liquid crystal devices so that the voltage applied to the liquid crystal devices can be converted to an AC-like voltage, and hence the damage to the liquid crystal can be reduced.

In addition to the arrangements above, the display apparatus in accordance with the present invention may include second storage means provided outside the display area, for storing image data.

According to this arrangement, providing the second storage means outside of the pixels in addition to the storage means (first storage means) provided in each of the pixels makes it possible to store image data which cannot be stored in the first storage means. Moreover, it is possible to display images without obtaining image data from the outside of the apparatus so that the reduction of the power consumption can be further accentuated. Furthermore, this second storage means can be utilized for the timing adjustment in the time ratio grayscale driving method.

In addition to the arrangements above, the display apparatus in accordance with the present invention may be arranged such that either an electro-optical device including a reflective liquid crystal device or a self-luminous device including an organic EL device is adopted as the display devices.

According to this arrangement, using the aforementioned display devices further accentuates the reduction of the power consumption in accordance with the present invention.

In addition to the arrangements above, the display apparatus in accordance with the present invention may be arranged such that an electrode constituting each of switching devices for switching the display devices and pixels composed of the voltage variation means are formed on the displaying substrate.

According to this arrangement, if, for instance, the display apparatus in accordance with the present invention is a TFT liquid crystal panel, using the polysilicon process, a TFT constituting the voltage variation means can be formed on the electrode substrate along with the TFTs which is the switching devices and the electrodes constituting the display devices, so that a TFT substrate (displaying substrate) can be realized. Thus, in addition to the simplification of the manufacturing process of the display apparatus, even if the manufacturing process is not completed, it is possible to sell the substrate, which is incomplete as the display apparatus, to manufacturers of liquid crystal and organic EL, as the displaying substrate.

In addition to the arrangements above, the display apparatus in accordance with the present invention may be arranged such that the display devices are provided for respective pixels formed in the display area; the storage means, the voltage keeping means, and the voltage variation means are provided for the respective display devices, and when a display voltage as image data is applied to the display devices, an intermediate voltage applying period, in which the display voltage is applied to the display devices in accordance with image data captured by the storage means, is provided between (i) a first voltage applying period in which first bit data is captured by the voltage keeping means, and in accordance with a voltage kept by the voltage keeping means, a voltage is applied to the display devices and (ii) a second voltage applying period in which second bit data is captured by the voltage keeping means, and in accordance with a voltage kept by the voltage keeping means, a voltage is applied to the display devices.

According to this arrangement, when images are displayed using the time ratio grayscale and the display period of a first bit is shorter than the time for scanning, the displaying can be carried out by means of the image data stored in the storage means so that the display periods can be effectively utilized. That is to say, in the above-identified arrangement, it is possible to carry out a driving method favorable for the present invention, and since the number of times to transfer signals supplied from the source driver can be reduced, the reduction of the power consumption can be further accentuated. Incidentally, in the above-mentioned driving method, the bit data of the first bit may be stored in the storage means instead of the voltage keeping means.

In addition to the arrangements above, the display apparatus of the present invention may be arranged such that the display devices are provided for respective pixels formed in the display area; the storage means, the voltage keeping means, and the voltage variation means are provided for the respective display devices, and when a display voltage as image data is applied to the display devices, output voltages from either the storage means or the voltage keeping means are switched so as to be applied to the display devices.

According to this arrangement, since the bit data is switched so as to be displayed on account of the storage means or the voltage keeping means, it is possible to realize the multi-grayscale display and the switching display of a plurality of images. Especially, when the switching display of a plurality of images is carried out, providing storage means of m bits makes it possible to easily switch m images in the case of 2-level-grayscale display. Thus also in the above-identified arrangement, the driving method which is favorable for the present invention is carried out, and thus it is unnecessary to turn on an IC circuit, etc. outside of the display area, so that the reduction of the power consumption can be further accentuated.

In addition to the arrangements above, the display apparatus in accordance with the present invention may be arranged such that the voltage variation means includes a first inverter and a second inverter connected in series, and: the first inverter is arranged such that (i) between a first power source and a ground line, a first TFT of a first type and a second TFT of a second type are connected in series and in this order, (ii) a gate terminal of the first TFT is connected to a second power source, (iii) a gate terminal of the second TFT receives an input voltage, and (iv) a junction of the first and second TFTs performs as an output terminal of the first inverter; and the second inverter is arranged such that (i) between the first power source and the ground line, a third TFT of the first type and a fourth TFT of second type are connected in this order, (ii) a gate terminal of the third TFT is connected to the output terminal of the first inverter, (iii) while a gate terminal of the forth TFT receives a ground voltage when the input voltage is equal to a second power supply voltage, the gate terminal of the fourth TFT receives a first power supply voltage when the input voltage is equal to the ground voltage, and (iv) a junction of the third and fourth TFTs performs as an output terminal of the second inverter.

When the first type is p-type and the second type is n-type, the first power source and the second power source are arranged so as to be positive, meanwhile, when the first type is n-type and the second type is p-type, the first power source and the second power source are arranged so as to be negative.

According to this arrangement, when the input voltage is equal to the second power supply voltage, the gate terminals of the first and second TFTs receive the second power supply voltage so that the first TFT is brought out of conduction and the second TFT is brought into conduction. On this account, the output terminal of the first inverter is connected to the ground line. In other words, the output of the first inverter becomes equal to the ground voltage. Then since the gate terminal of the third TFT receives the ground voltage, the third TFT is brought into conduction. The gate terminal of the fourth TFT also receives the ground voltage so that the fourth TFT is brought out of conduction. On this account, the first power supply voltage is output from the second inverter.

In contrast, when the input voltage is equal to the ground voltage, the gate terminals of the first and second TFTs receive the second power supply voltage so that the first TFT is brought out of conduction and the second TFT is brought into conduction. On this account, the output from the first inverter becomes equal to the ground voltage. Then since the gate terminal of the third TFT receives the ground voltage, the third TFT is brought into conduction. Also, the gate terminal of the fourth TFT receives the second power supply voltage so that the fourth TFT is brought into conduction. On this account, the output from the second inverter becomes equal to the ground voltage.

In other words, providing the first and second inverters as the voltage variation means makes it possible to output either (i) the first power supply voltage when the input voltage is equal to the second power supply voltage or (ii) the ground voltage when the input voltage is equal to the ground voltage. On this account, it is possible to amplify the voltage (second power supply voltage) to be the greater voltage (first power supply voltage) so that the power consumption can be reduced.

In addition to the arrangements above, the display apparatus in accordance with the present invention may include a fifth TFT of first type provided between the second power source and the first TFT, wherein the output terminal of the second inverter is connected to a gate terminal of the fifth TFT.

According to this arrangement, when the input voltage is equal to the second power supply voltage, the fifth TFT which is out of conduction is further connected between the first TFT which is out of conduction and the first power source. On this account, the fifth TFT is out of conduction when the output from the second inverter is equal to the first power supply voltage, meanwhile the fifth TFT is brought into conduction when the output from the second inverter is equal to the ground voltage. On this account, in accordance with the output level of the second inverter, it is possible to obtain the amplitude necessary for stabilizing the switching operation (conduction/out of conduction) of each TFT in the first inverter.

In addition to the arrangements above, the display apparatus in accordance with the present invention may be arranged such that a time ratio grayscale display is carried out.

The time ratio grayscale method is a method to increase the number of displayable grayscale levels by dividing the frame time per bit into multiple periods.

According to this arrangement, carrying out the time ratio grayscale display makes it possible to realize the multi-grayscale display surpassing the ability of the D/A conversion circuit so that the increase of the areas occupied with the D/A conversion circuit and the drive circuit can be avoided.

Moreover, the display apparatus in accordance with the present invention makes it possible to reduce the output voltages of the source driver and the gate driver so that the increase of the output frequencies of the source and gate drivers can be restrained. Furthermore, when the output voltages of the source and gate drivers are kept constant, a pixel circuit starts to operate with the voltage in the midst of the process of the rise of the waveform so that it is possible to recover the delay of the speed of waveform rise (drop) on account of the load-carrying capacity and the resistant elements of the source driver electrode. As a result, even a large-sized display apparatus can adopt the time ratio grayscale display method so that better displaying can be realized.

The portable device in accordance with the present invention is may be arranged such that the display apparatus having one or more of the arrangements above is included.

According to this arrangement, the above-mentioned display apparatuses consume fewer amount of electricity and further downsized, compared to conventional apparatuses, so that the display apparatuses in accordance with the present invention can be suitably used as display means for portable devices such as a mobile phone and a PDA.

In addition to the arrangements above, the display apparatus in accordance with the present invention may be arranged such that the voltage variation means includes a third inverter and a forth inverter connected in series; the third inverter is arranged such that (i) between a first power source and an input terminal of the voltage variation means, a sixth TFT of a first type and a seventh TFT of a second type are connected in series and in this order, (ii) a gate terminal of the seventh TFT is connected to a second power source, and (iii) a junction of the sixth and seventh TFTs performs as an output terminal of the third inverter; the fourth inverter is arranged such that (i) between the first power source and a ground line, an eighth TFT of the first type and a ninth TFT of the second type are connected in series and in this order, (ii) a gate terminal of the eighth TFT is connected to the output terminal of the third inverter, (iii) a gate terminal of the ninth TFT receives an input voltage, and (iv) a junction of the eighth and ninth TFTs performs an output terminal of the fourth inverter; and the output terminal of the fourth inverter is connected to a gate terminal of the sixth TFT.

When the first type is p-type and the second type is n-type, the first power source and the second power source are arranged so as to be positive, in the meantime when the first type is n-type and the second type is p-type, the first power source and the second power source are arranged so as to be negative.

According to this arrangement, when the input voltage is equal to the ground voltage, the gate terminal of the ninth TFT receives the ground voltage so that the ninth TFT is brought out of conduction. Meanwhile, the drain terminal of the seventh TFT receives the second power supply voltage so that the seventh TFT is brought into conduction. On this account, the output terminal of the third inverter outputs the ground voltage. Then since the gate terminal of the eighth TFT receives the ground voltage, the eighth TFT is brought into conduction and the output terminal of the fourth inverter is connected to the first power source. Therefore, the output from the fourth inverter becomes equal to the first power supply voltage. At this moment, the gate terminal of the sixth TFT receives the first power supply voltage so that the sixth TFT is brought out of conduction.

In contrast, when the input voltage is equal to the second power supply voltage, the drain terminal of the seventh TFT receives the second power supply voltage so that the seventh TFT is brought out of conduction. Also, the gate terminal of the ninth TFT receives the second power supply voltage so that the ninth TFT is brought into conduction. On this account, the output from the fourth inverter is equal to the ground voltage and the gate terminal of the sixth TFT receives the ground voltage. Thus since the sixth TFT is brought into conduction, the output from the third inverter becomes equal to the first power supply voltage. Moreover, since the eighth TFT receives the first power supply voltage, the eighth TFT is brought out of conduction.

That is to say, constituting the third and fourth inverters as the voltage variation means makes it possible to output either (i) the ground voltage when the input voltage is equal to the second power supply voltage or (ii) the first power supply voltage when the input voltage is equal to the ground voltage. On this account, it is possible to amplify the voltage (second power supply voltage) to be the greater voltage (first power supply voltage) so that the power consumption can be reduced.

Moreover, according to the arrangement above, the sixth TFT is brought into conduction when the input voltage is equal to the second power supply voltage, while the sixth TFT is brought out of conduction when the input voltage is equal to the ground voltage. On this account, in accordance with the output level of the fourth inverter, it is possible to obtain the amplitude necessary for stabilizing the switching operation of each TFT in the third inverter.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display apparatus comprising:

a plurality of display devices formed in a display area;

voltage variation means, provided for each of said display devices, for respectively changing voltages at control terminals of active elements which supply voltages to said display devices, wherein the voltage variation means includes two inverters and has a memory function; and storage means, provided for each of said respective display devices separately from the voltage variation means, for storing image data, wherein the storage means includes two inverters and has a different structure than the voltage variation means.

2. The display apparatus as defined in claim 1, further comprising voltage keeping means for keeping a voltage supplied to said voltage variation means.

3. The display apparatus as defined in claim 2, further comprising switching devices each provided between (i) any one of said storage means, said voltage keeping means, and said voltage variation means and (ii) each of said display devices.

4. The display apparatus as defined in claim 1, further comprising a plurality of first lines and a plurality of second lines which intersect with each other wherein said display devices are provided at respective intersections of said first lines and said second lines; and switching devices corresponding to said respective display devices and having first and second terminals, wherein the first terminals of said switching devices are connected to said respective first lines, and the second terminals of said switching devices are connected to said respective display devices via said respective voltage variation means.

5. The display apparatus as defined in claim 4, wherein said second terminals of said switching devices are connected to either said respective storage means or said respective voltage keeping means, and either said storage means or said voltage keeping means are connected to said respective display devices via said respective voltage variation means.

6. The display apparatus as defined in claim 1, further comprising storage means provided outside said display area, for storing image data.

7. The display apparatus as defined in claim 1, wherein either an electro-optical device including a reflective liquid crystal device or a self-luminous device including an organic EL device is adopted as said display devices.

8. The display apparatus as defined in claim 1, wherein an electrode constituting each of switching devices for switching said display devices and pixels composed of said voltage variation means are formed on said displaying substrate.

9. The display apparatus as defined in claim 2, wherein said display devices are provided for respective pixels formed in said display area; said storage means, said voltage keeping means, and said voltage variation means are provided for said respective display devices, and wherein, when a display voltage as image data is applied to said display devices, output voltages from either said storage means or said voltage keeping means are switched so as to be applied to said display devices.

10. The display apparatus as defined in claim 1, wherein a time ratio grayscale display is carried out.

11. The display apparatus as defined in claim 1, wherein voltage generated by the voltage variation means is stored by the storage means.

12. A display apparatus comprising:

a plurality of display devices formed in a display area;

voltage variation means, provided for each of said display devices, for respectively changing voltages at control terminals of active elements which supply voltages to said display devices;

voltage keeping means for keeping a voltage supplied to said voltage variation means; and storage means, provided for said respective display devices, for storing image data, wherein said display devices are provided for respective pixels formed in said display area; said storage means, said voltage keeping means, and said voltage variation means are provided for said respective display devices, and wherein, when a display voltage as image data is applied to said display devices, an intermediate voltage applying period, in which said display voltage is applied to said display devices in accordance with image data captured by said storage means, is provided between (i) a first voltage applying period in which first bit data is captured by said voltage keeping means, and in accordance with a voltage kept by said voltage keeping means, a voltage is applied to said display devices and (ii) a second voltage applying period in which second bit data is captured by said voltage keeping means, and in accordance with a voltage kept by said voltage keeping means, a voltage is applied to said display devices.

13. A display apparatus comprising:

a plurality of display devices formed in a display area; and voltage variation means, provided for each of said display devices, for respectively changing voltages at control terminals of active elements which supply voltages to said display devices, wherein said voltage variation means includes a first inverter and a second inverter connected in series, and:

said first inverter is arranged such that (i) between a first power source and a ground line, a first TFT of a first type and a second TFT of a second type are connected in series, (ii) a gate terminal of said first TFT is connected to a second power source, (iii) a gate terminal of said second TFT receives an input voltage, and (iv) a junction of said first and second TFTs performs as an output terminal of said first inverter; and said second inverter is arranged such that (i) between said first power source and said ground line, a third TFT of said first type and a fourth TFT of second type are connected, (ii) a gate terminal of said third TFT is connected to said output terminal of said first inverter, (iii) while a gate terminal of said forth TFT receives a ground voltage when said input voltage is equal to a second power supply voltage, said gate terminal of said fourth TFT receives a first power supply voltage when said input voltage is equal to said ground voltage, and (iv) a junction of said third and fourth TFTs performs as an output terminal of said second inverter.

14. The display apparatus as defined in claim 13, further comprising a fifth TFT of first type provided between said second power source and said first TFT, wherein said output terminal of said second inverter is connected to a gate terminal of said fifth TFT.

15. A display apparatus comprising:

a plurality of display devices formed in a display area; and voltage variation means, provided for each of said display devices, for respectively changing voltages at control terminals of active elements which supply voltages to said display devices, said voltage variation means includes a first inverter and a second inverter connected in series;

said first inverter is arranged such that (i) between a first power source and an input terminal of said voltage variation means, a first TFT of a first type and a second TFT of a second type are connected in series, (ii) a gate terminal of said second TFT is connected to a second power source, and (iii) a junction of said first and second TFTs performs as an output terminal of said first inverter;

said second inverter is arranged such that (i) between said first power source and a ground line, a third TFT of said first type and a fourth TFT of said second type are connected in series, (ii) a gate terminal of said third TFT is connected to said output terminal of said first inverter, (iii) a gate terminal of said fourth TFT receives an input voltage of the input terminal of said voltage variation means, and (iv) a junction of said third and fourth TFTs performs an output terminal of said second inverter; and said output terminal of said second inverter is connected to a gate terminal of said first TFT.

16. A portable device, comprising:

a display apparatus provided with a plurality of display devices formed in a display area, voltage variation means, provided for said respective display devices, for changing voltages at control terminals of active elements which supply voltages to said display devices, wherein the voltage variation means includes two inverters and has a memory function; and storage means, provided for each of said respective display devices separately from the voltage variation means, for storing image data, wherein the storage means includes two inverters and has a different structure than the voltage variation means.

17. The display apparatus as defined in claim 16, wherein voltage generated by the voltage variation means is stored by the storage means.

* * * * *